US009333630B2

(12) United States Patent
Palmer

(10) Patent No.: US 9,333,630 B2
(45) Date of Patent: May 10, 2016

(54) DUAL-DRIVE, SELF-RATCHETING, MECHANISM WITH MULTIPLE INPUT PORTS

(71) Applicant: Leon Robert Palmer, Somerset, MA (US)

(72) Inventor: Leon Robert Palmer, Somerset, MA (US)

( * ) Notice: Subject to any disclaimer, the term of this patent is extended or adjusted under 35 U.S.C. 154(b) by 308 days.

(21) Appl. No.: 13/987,640

(22) Filed: Aug. 19, 2013

(65) Prior Publication Data

US 2015/0047472 A1 Feb. 19, 2015

(51) Int. Cl.

| | |
|---|---|
| ***B25B 15/04*** | (2006.01) |
| ***B25B 7/00*** | (2006.01) |
| ***B25B 13/46*** | (2006.01) |
| ***B25B 17/00*** | (2006.01) |

(52) U.S. Cl.

CPC ..... *B25B 15/04* (2013.01); *B25B 13/46* (2013.01); *B25B 17/00* (2013.01)

(58) Field of Classification Search

CPC ..... B25B 13/46; B25B 15/00; B25B 15/04; B25B 17/00; B25B 17/02; F16H 31/002; B25G 1/063

USPC ..... 81/57, 57.22, 57.29, 57.3, 57.31

See application file for complete search history.

(56) References Cited

U.S. PATENT DOCUMENTS

| | | | | | |
|---|---|---|---|---|---|
| 4,545,268 | A | * | 10/1985 | Stuckey | 81/57.31 |
| 4,770,071 | A | * | 9/1988 | Steier | 81/57.22 |
| 5,881,609 | A | * | 3/1999 | Palmer | 81/57 |
| 5,931,062 | A | * | 8/1999 | Marcovici | 81/57.31 |
| 2012/0096991 | A1 | * | 4/2012 | Palmer | 81/60 |

* cited by examiner

*Primary Examiner* — Hadi Shakeri

(57) ABSTRACT

The invention is a dual-drive, self-ratcheting multiple input ports mechanism, that converts oscillatory motion applied to its input, to unidirectional axial rotation motion at its output and is able to be switched to produce solely clockwise rotation at its output, regardless of the direction of rotation applied to the input and is able to be switched to produce solely counterclockwise rotation at its output, regardless of the direction of rotation applied to the input and is provided with a detachable input handle, that can be coupled to said multiple input ports.

4 Claims, 97 Drawing Sheets

DUAL-DRIVE, SELF-RATCHETING, MECHANISM WITH MULTIPLE INPUT PORTS

FIELD OF THE INVENTION

This invention relates to mechanical drive systems and more particularly to those in which the output rotation can be solely clockwise, regardless of the direction of the input rotation and the output rotation can be solely counterclockwise, regardless of the direction of the input rotation. The direction of output rotation, from an oscillatory input, is selective within the same embodiment. The mechanism can be described as devices such as, but not limited to, a mechanical converter, a mechanical rectifier and a converter of oscillatory input motion to unidirectional rotational output motion. In order for its advantages to be appreciated, the mechanism must be embodied into an application. The selected exemplification from numerous applications, is a ratcheting screwdriver.

BACKGROUND OF THE INVENTION

This invention, a dual-drive, self-ratcheting mechanism, has numerous applications in consumer, medical and industrial products, while, a ratcheting screwdriver is the preferred item to serve as the exemplification of the advantages, that the mechanism provides. Conventional ratcheting screwdrivers, employ a single ratcheting mechanism, that is required to be intermittently-ratcheted between drives and therefore only ready-to-drive hardware 50% of the time, while the remaining 50% is time and effort, that is unproductively spent, ratcheting-up. Hence, a screwdriver, mechanized with a conventional single-ratcheting mechanism, is only 50% efficient. Whereas, a screwdriver, mechanized with the self-ratcheting system, eliminates the user's need to waste time and effort ratcheting between drives. The ratcheting occurs automatically within the mechanism, as reciprocating input-motion is applied, while the screwdriver is being operated.

The dual-drive self-ratcheting mechanism is comprised of driving elements, such as, but not limited to, a pair of a ratchet wheels and pawls, or a plurality of one-way roller-type clutches, or a plurality of two-way roller-type clutches. Solely for exemplification and simplicity, the included illustrations depict a proposed assembly procedure of a dual-drive self-ratcheting mechanism, that employs roller-type clutches.

BRIEF SUMMARY OF THE INVENTION

The invention is a mechanism, that converts oscillatory motion applied to its input, into unidirectional axial rotation at its output. The mechanism can be set to produce solely clockwise rotation at its output, regardless of the direction of rotation of the input and can be set to produce solely counterclockwise rotation at its output, regardless of the direction of rotation of the input. The mechanism must be embodied into a product, in order for its advantages to be useful.

Even though the mechanism has numerous applications, the manually-operated ratchet screwdriver is selected, not as the invention, but, as an ideal exemplification of an application.

One objective of this exemplification, is to create a manually-operated, dual-drive self-ratcheting screwdriver hand tool, that ratchets-up automatically during use, thereby eliminating the user's need to perform the unproductive ratcheting-up motion, between each productive drive.

Another objective, is to create a manually-operated, self-ratcheting dual-drive self-ratcheting screwdriver hand tool, that is operated single-handedly, thereby enabling fastening hardware, to be held in place, with user's opposite hand.

Another objective is to provide a manually-operated self-ratcheting dual-drive self-ratcheting screwdriver hand tool, whereby resistance-to-backwards-rotation, from the screw during its installation into a material, to enable ratcheting-up, is no longer necessary.

Another objective is to create a manually-operated, dual-drive self-ratcheting screwdriver, whereby the self-ratcheting mechanism is operated via the clockwise and counterclockwise axial turning of an input handle, that can be coupled to the reversing mechanism to operate the dual-drive self-ratcheting mechanism, or, can be coupled to a driving element to operate the dual-drive self-ratcheting, as well as radially swung for increased leverage for applying finishing-torque and breaking the finishing torque and loosen fastening hardware.

BRIEF DESCRIPTION OF THE DRAWINGS

Note.

FIG. 1: Spring 22 is prepared to be placed into opening provided in Driveshaft 5. Ball 23 is prepared to be placed onto Spring 22.

Note: FIG. 21: Second Input Receptacle Insert 16, is prepared to be coupled to First Rotating Element 7

FIG. 22: Second Input Receptacle Insert 16 is coupled to First Rotating Element 7.

FIG. 23: The assembly of Second Input Receptacle Insert 16 and First Rotating Element 7 of FIG. 9, is prepared to be inserted into a through-hole of Reversing Mechanism Housing 17.

FIG. 24: The assembly of Second Input Receptacle Insert 16 and First Rotating Element 7 of FIG. 9, is inserted into a through-hole of Reversing Mechanism Housing 17 for rotating freely.

FIG. 25: Exploded view of the Second Rotating Element 6 of the Reversing Mechanism and a two-piece axle comprised of First Axle Component 18 and Second Axle Component 19.

FIG. 26: The Second Rotating Element 6 of the Reversing Mechanism is prepared to be rotatably attached to the Reversing Mechanism Housing 17, by the fastening together of First Axle Component 18 and Second Axle Component 19 through the bore of Second Rotating Element 6.

FIG. 27: The First Axle Component 19 of the Two-Piece Axle is inserted into bore of Second Rotating Element 6, while the Second Axle Component 19 of the Two-Piece Axle is prepared to be fastened to the First Axle Component 18.

FIG. 28: The Second Axle Component 19 of the Two-Piece Axle is fastened to the First Axle Component 18, thereby forming a complete Axle, about which the Second Rotating Element 6 rotates.

FIG. 41: Driving End 1B of Detachable Adjustable Handle 1 is coupled to first Driving Element 2.

FIG. 53: Component rotation analysis with Detachable Adjustable Handle 1 coupled to Second Input Receptacle 16 and with double-drive mechanism set to counter-clockwise output mode; clockwise input produces counter-clockwise output. Solid arrows indicate direction of rotation; dashed arrows indicate direction of overrun.

FIG. 58 illustrates such a mechanism using a plurality of ratchet wheels engaged by pawls, to entrain a driveshaft to rotate axially; the reversing mechanism is being 'directly-driven' by and directly coupled to an input handle, that is repeatedly and alternatingly turned axially, in clockwise then counterclockwise rotation.

DESCRIPTION OF THE PREFERRED EMBODIMENT

The following is a description of the mechanics of the mechanism, involving a rotational analysis of the cooperation of components of the self-ratcheting dual-drive mechanism.

Figure 1:
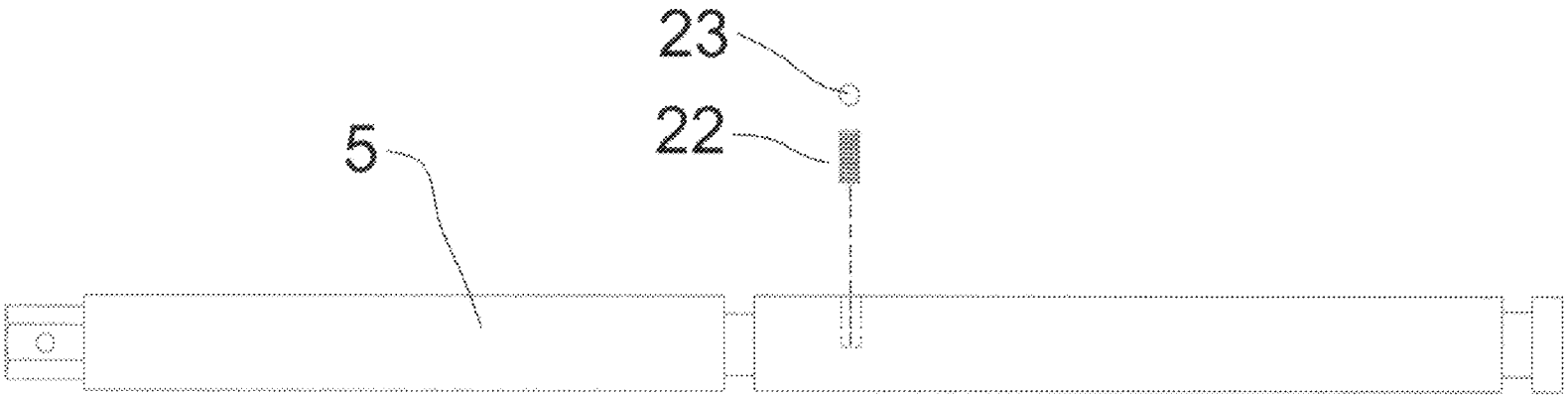
FIG. 1 through FIG. 53 illustrate a suggested step-by-step procedure, for assembling the elements of a self-ratcheting, double-drive mechanism, that converts oscillatory motion applied to an input, into unidirectional rotation motion at the output for clockwise and counterclockwise direction.
Figure 2:
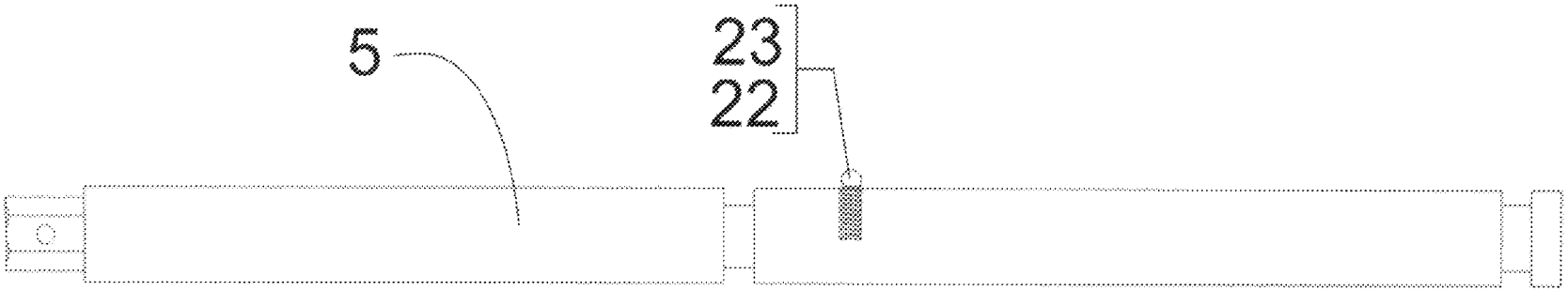
FIG. 2 Spring 22 is placed into opening provided in Driveshaft 5. Ball 23 is placed onto Spring 22.
Figure 3:
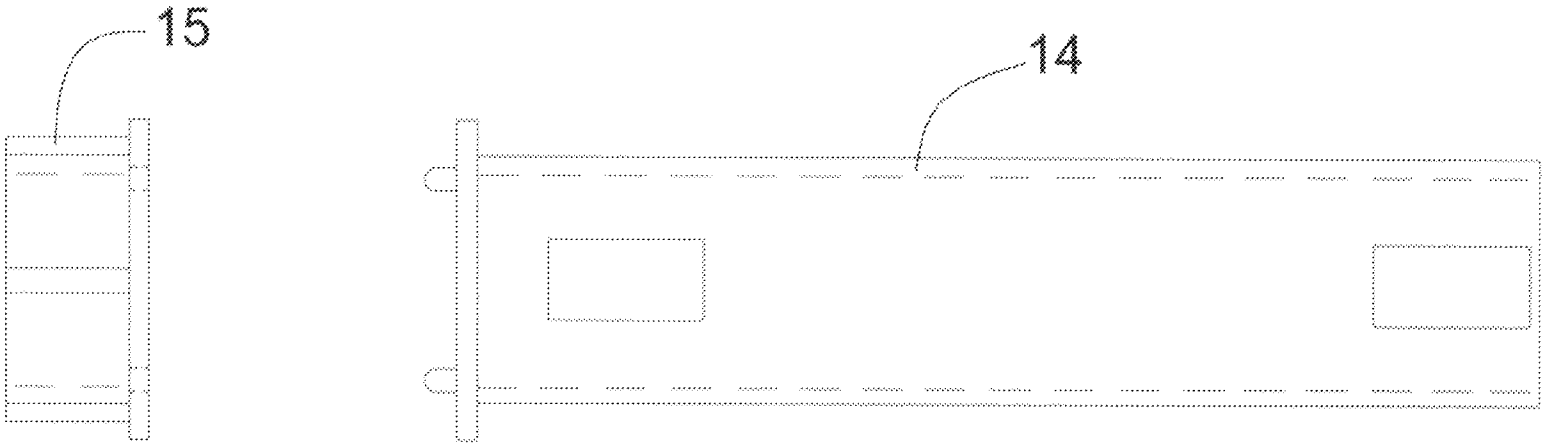
FIG. 3: A two-dimensional illustration; Clutching Element Housing 14 and Switch Element 15 are prepared to be keyed together. Switch Element 15 is provided with a plurality of keys, that mate with channels provided in Clutching Element Housing 14.
Figure 4:
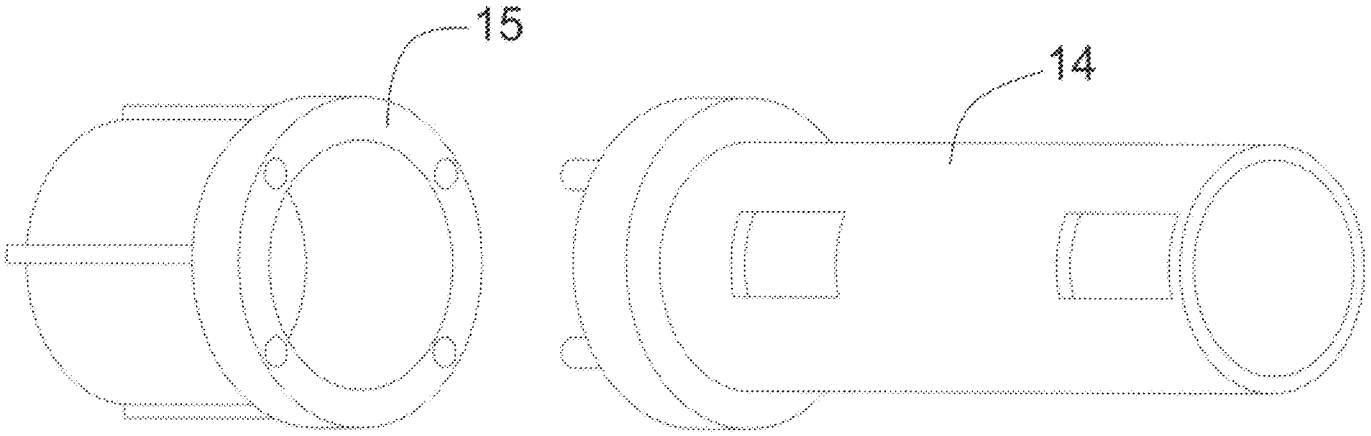
FIG. 4: A three-dimensional illustration; Clutching Element Housing 14 and Switch Element 15 are prepared to be keyed together. Switch Element 15 is provided with a plurality of keys, that mate with channels provided in Clutching Element Housing 14.
Figure 5:
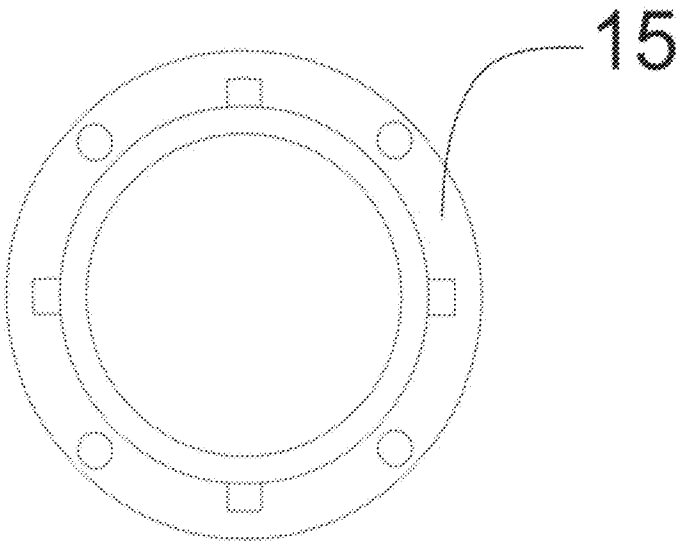
FIG. 5: Posterior view of Switch Element 15.
Figure 6:
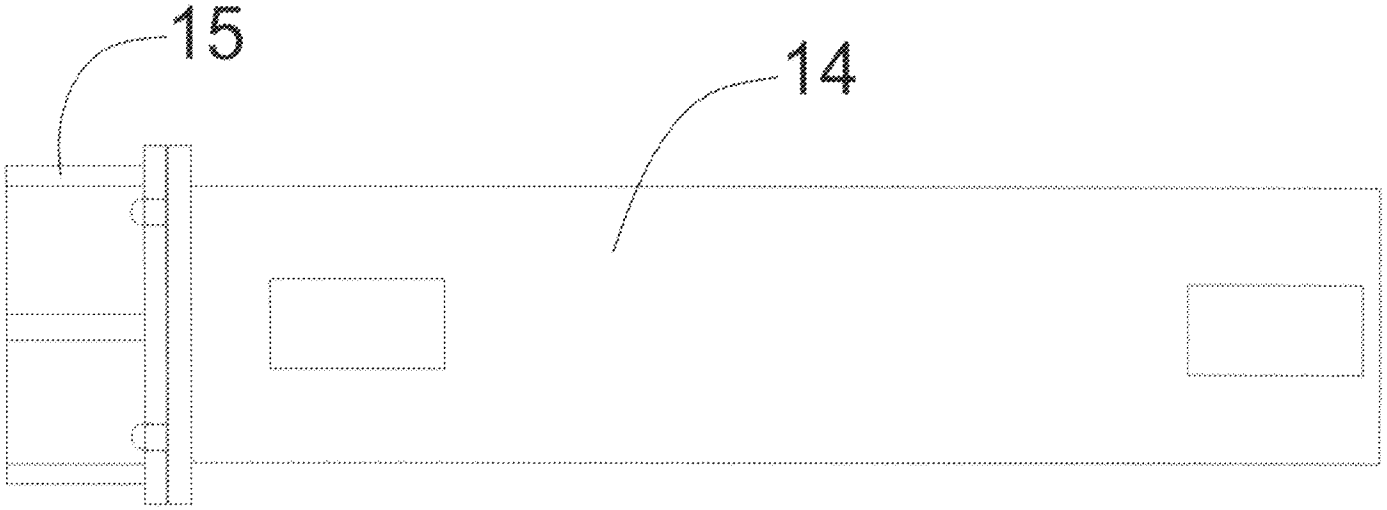
FIG. 6: Two-dimensional illustration of Clutching Element Housing 14 and Switch Element 15 keyed together.
Figure 7:
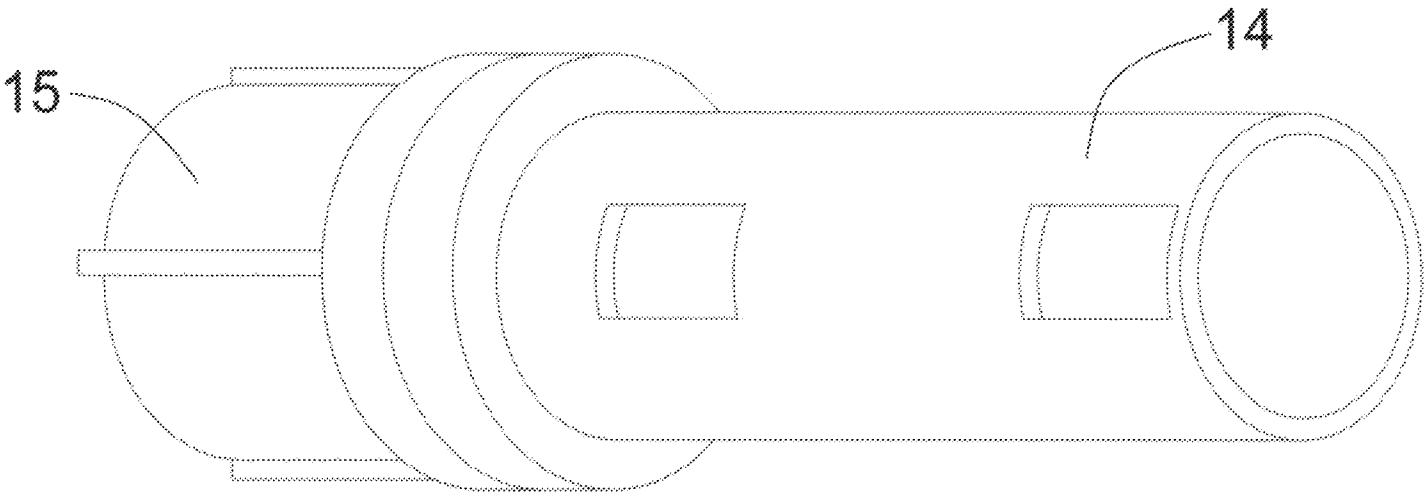
FIG. 7: Three-dimensional illustration of Clutching Element Housing 14 and Switch Element 15 keyed together
Figure 8:
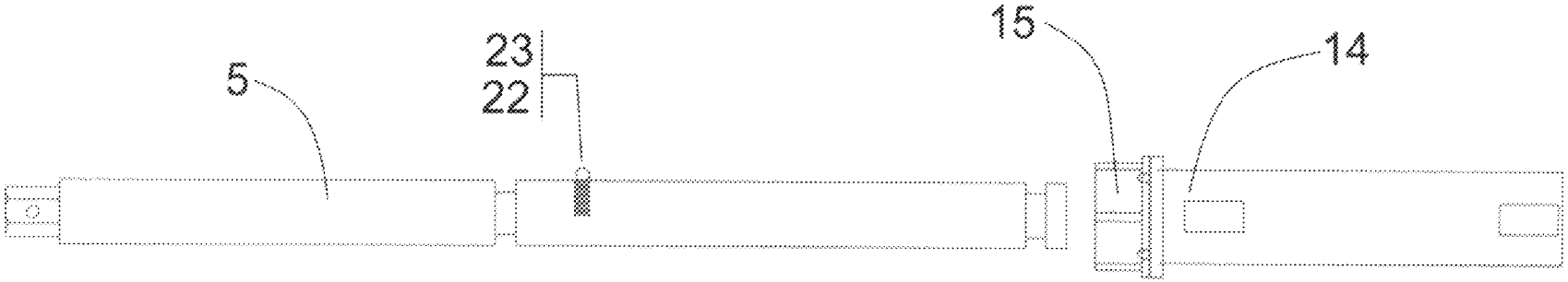
FIG. 8: Clutching Element Housing 14 and Switch Element 15 are prepared to be slid onto Driveshaft 5 and over spring-loaded Ball 23.
Figure 9:
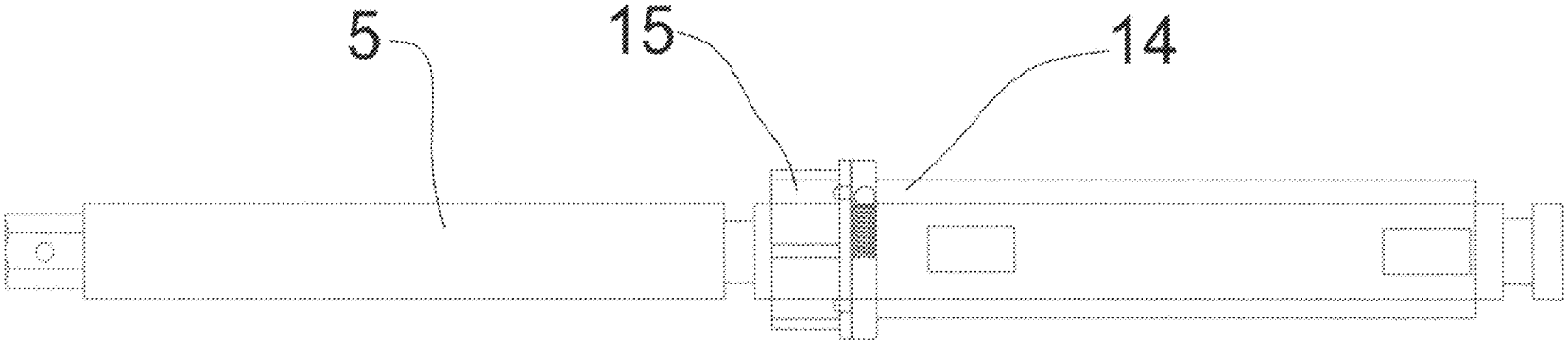
FIG. 9: Clutching Element Housing 14 and Switch Element 15 are slid onto Driveshaft 5 and over spring-loaded Ball 23
Figure 10:
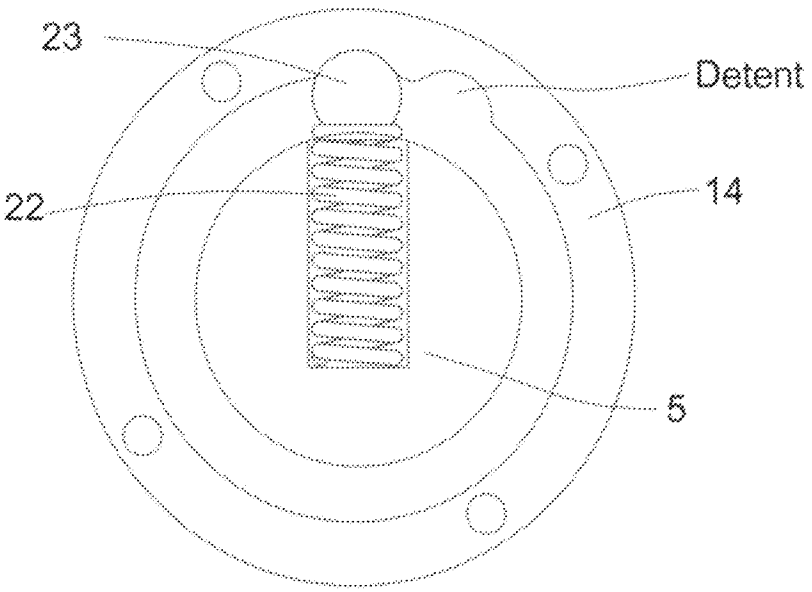
FIG. 10: Spring-loaded Ball 23 is shown captured in recessed detent provided in flange of Clutch Housing 14, to retain Switch Element 15 and Clutch Housing 14 in position, to cause Driveshaft 5 to rotate axially in only clockwise direction.
Figure 11:
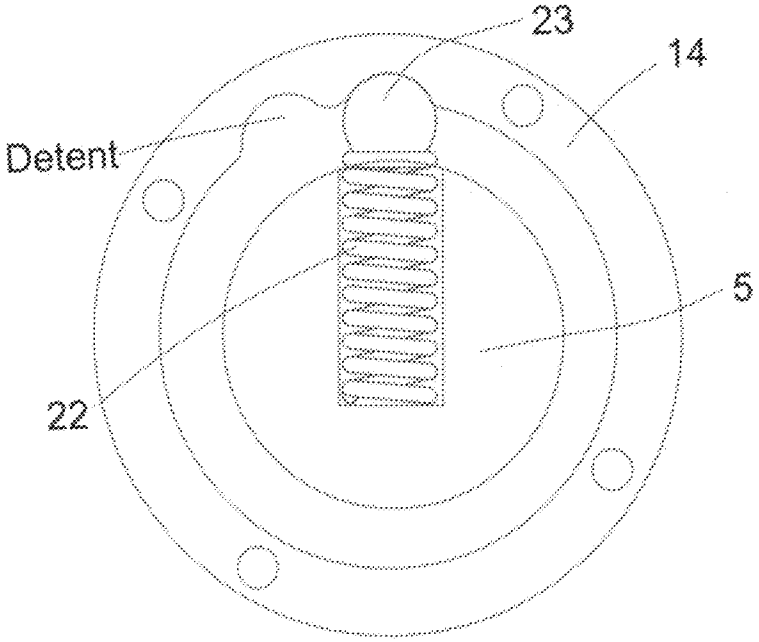
FIG. 11: Spring-loaded Ball 23 is shown captured in opposite detent provided in flange of Clutch Housing 14, to retain Switch Element 15 and Clutch Housing 14 in position, to cause Driveshaft 5 to rotate axially in only counterclockwise direction.
Figure 12:
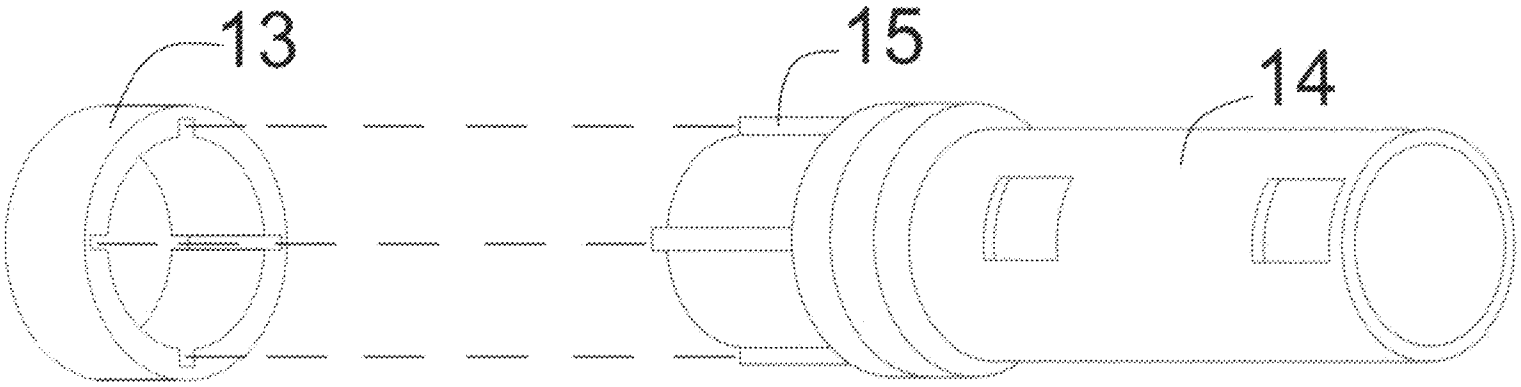
FIG. 12: Three-dimensional illustration of channeled detail of Anterior Housing 13 prepared to be slid onto Drive Shaft 5 and keyed to Switch Element 15.
Figure 13:
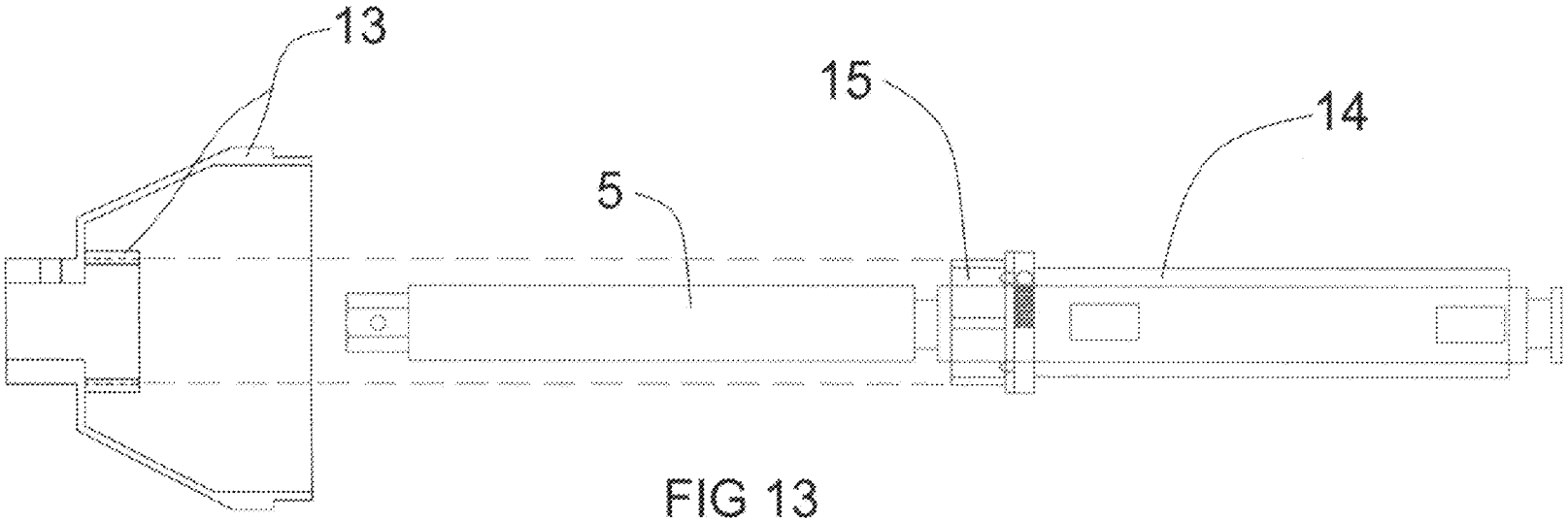
FIG. 13: Dashed lines show the alignment of the keys of Switch Element 15, with the channels of Anterior Housing 13.
Figure 14:
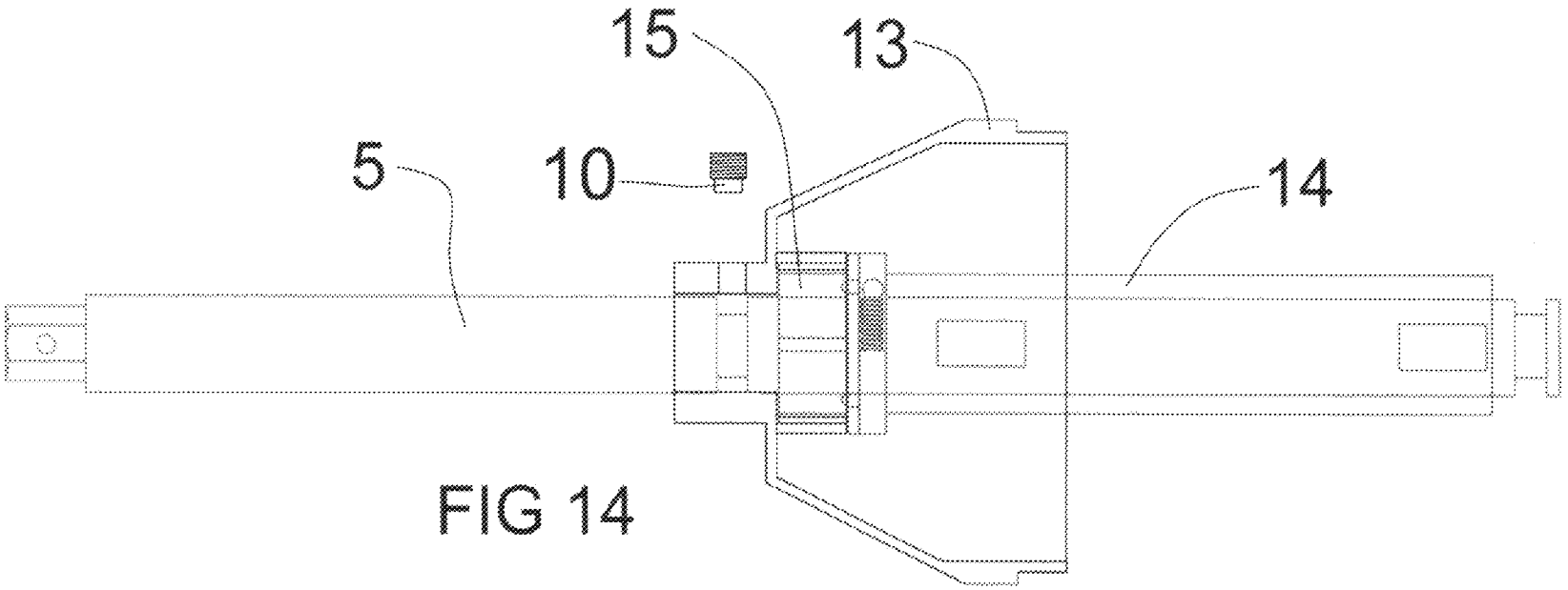
FIG. 14: Anterior Housing 13 is slid into onto Drive Shaft 5 and keyed to Switch Element 15. Retaining Element 10 is prepared to be installed into groove provided in Driveshaft 5.
Figure 15:
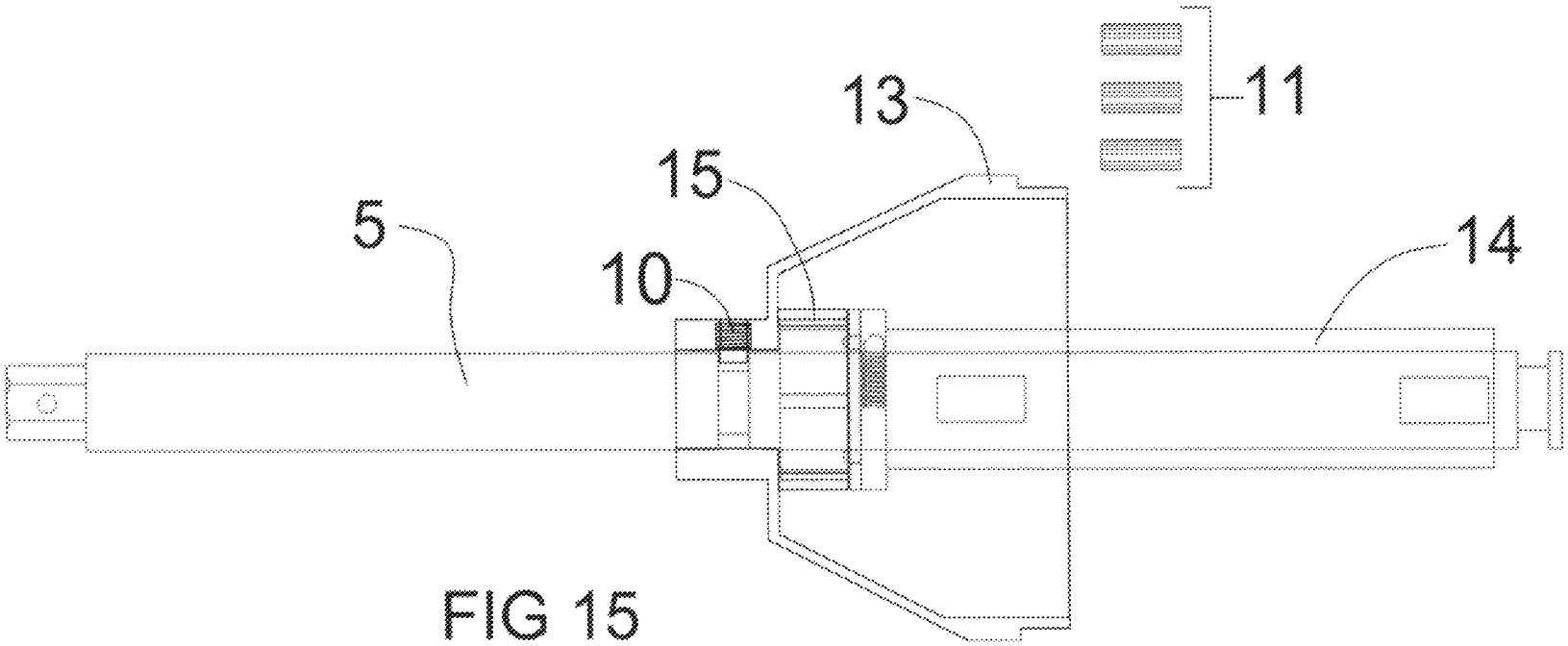
FIG. 15: Retaining Element 10 is installed to retain Anterior Housing 13 in place on Driveshaft 5. Clutching Components 11 are prepared for being inserted into their respective slots provided in Clutching Element Housing 14.
Figure 16:
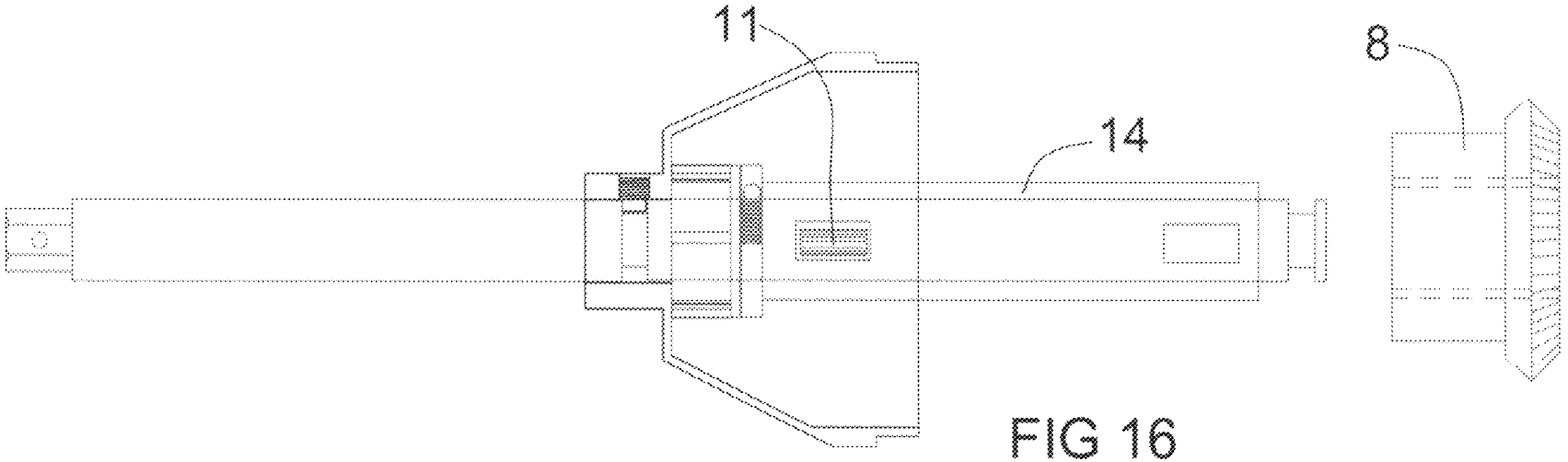
FIG. 16: Clutching Components 11 are inserted into their respective slots provided in Clutching Element Housing 14. Driving Element 8 is prepared for being slid onto Clutching Element Components 11.
Figure 17:
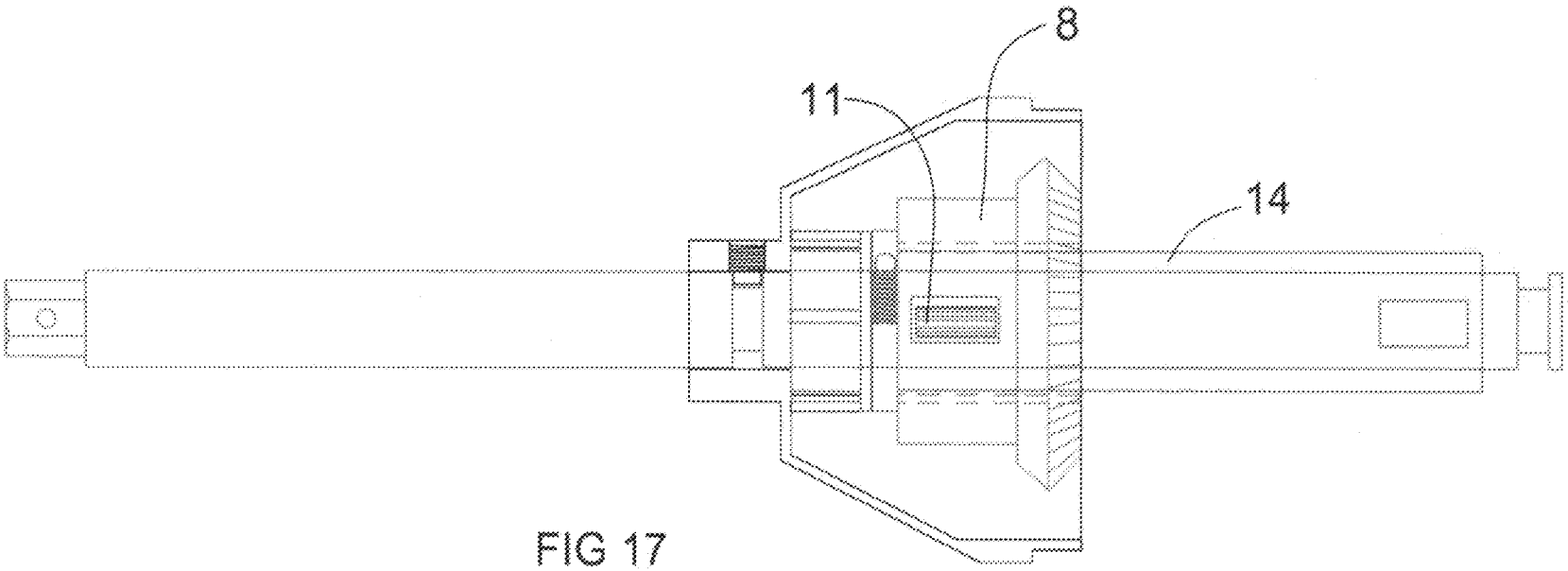
FIG. 17: Driving Element 8 is slid onto Clutching Element Components 11.
Figure 18:
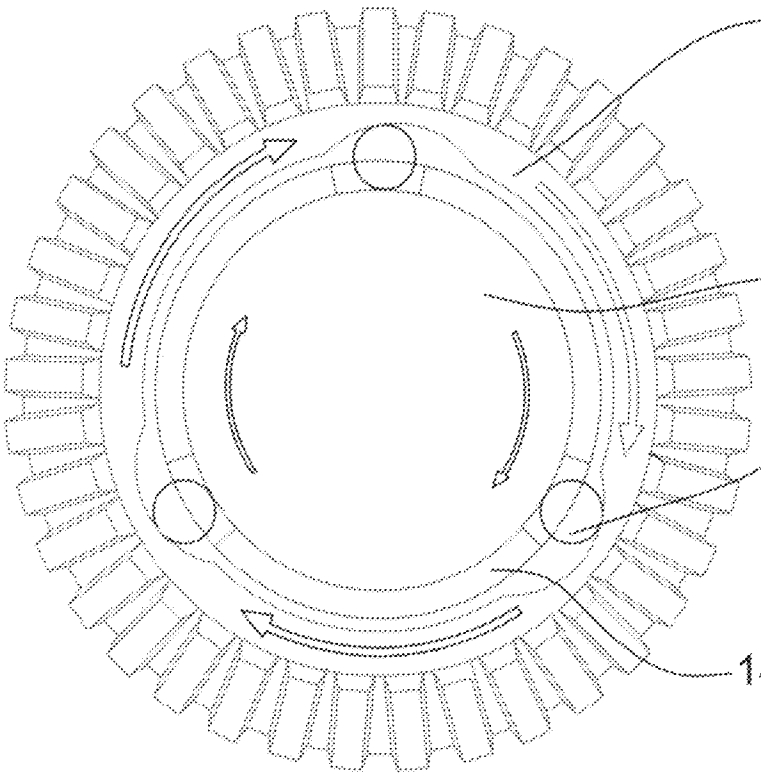
FIG. 18: Driving Element 8 is rotated clockwise; Clutch Element Components 11 become wedged between ramp surface and Driveshaft 5 surface; Driveshaft 5 is entrained to rotate axially only in clockwise direction.
Figure 19:
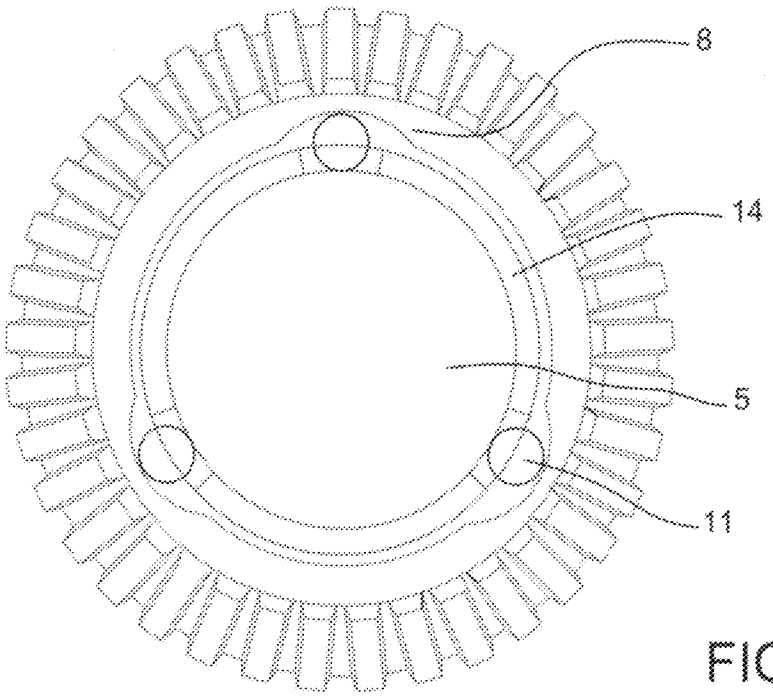
FIG. 19: Driving Element 8 is in override mode whereby, Clutch Element Components 11 are not wedged between ramp surface and Driveshaft surface, thereby override Driveshaft surface 5.
Figure 20:
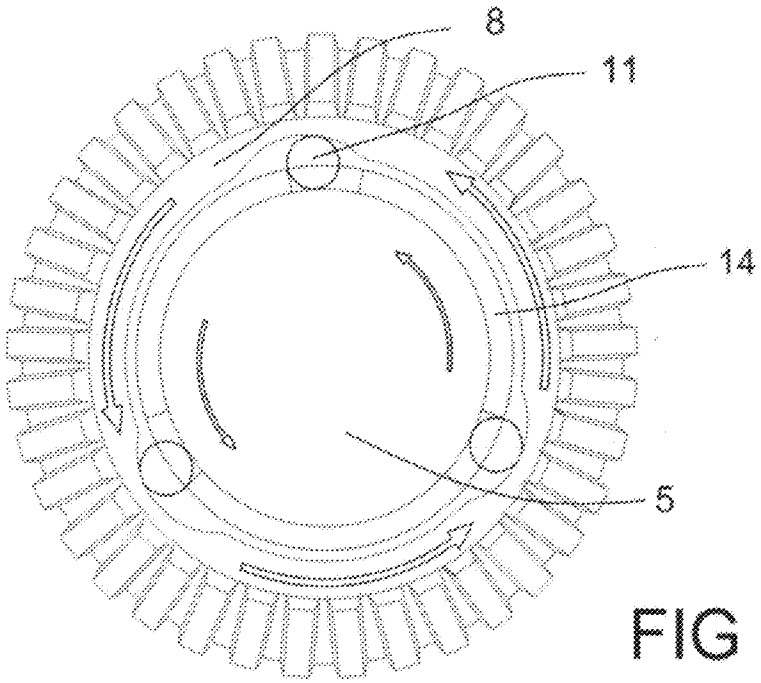
FIG. 20: Driving Element is rotated counterclockwise; Clutch Element Components 11 become wedged between ramp surface and Driveshaft 5 surface; Driveshaft 5 is entrained to rotate axially only in counter-clockwise direction.
Figure 21:
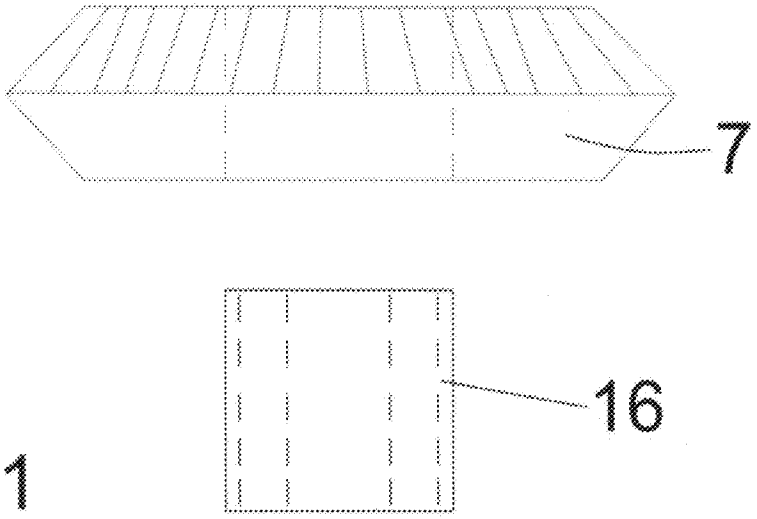
FIG. 21 through FIG. 28 describe a suggested procedure for the Reversing Mechanism Assembly
Figure 22:
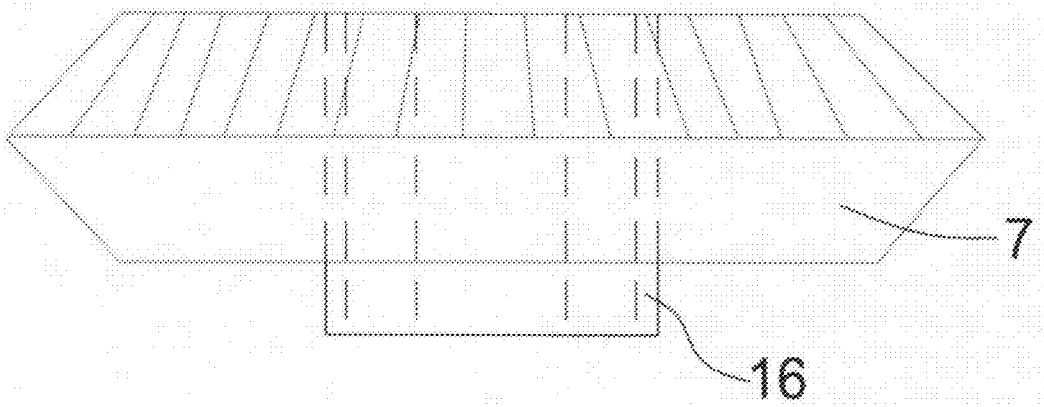
Figure 23:
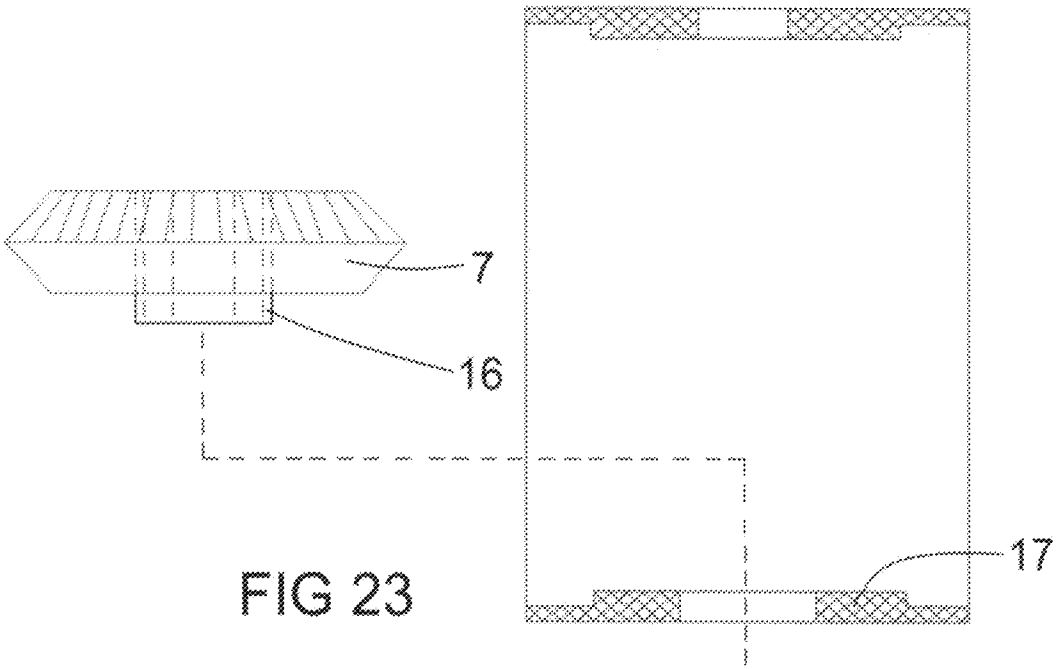
Figure 24:
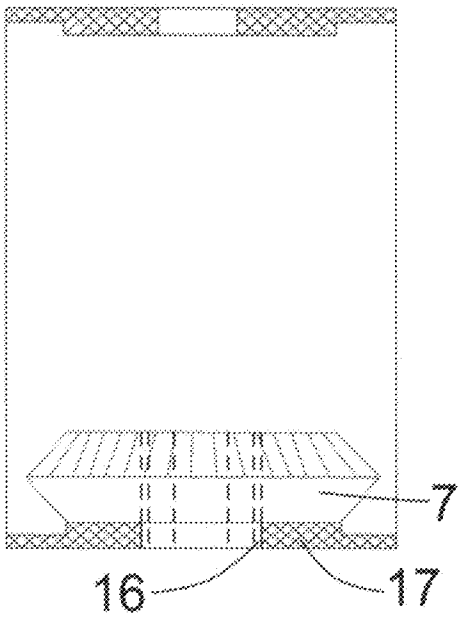
Figure 25:
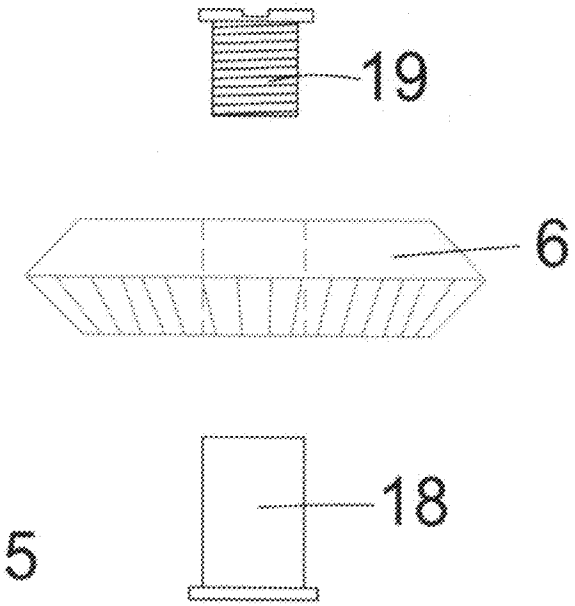
Figure 26:
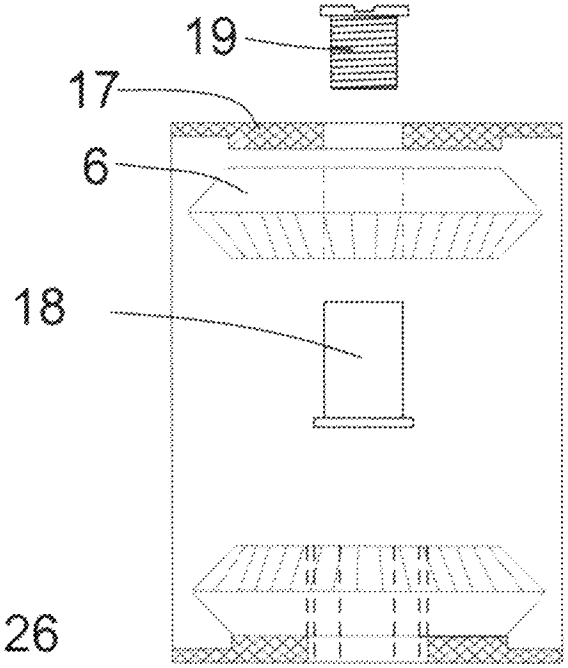
Figure 27:
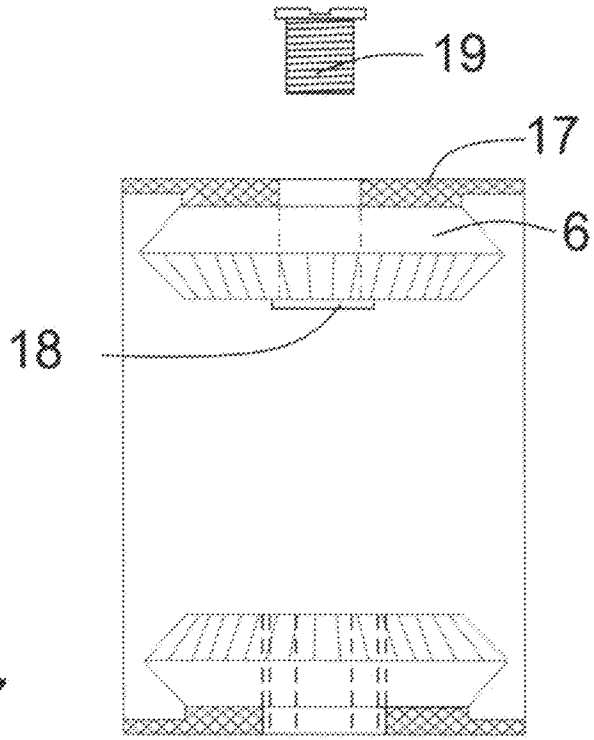
Figure 28:
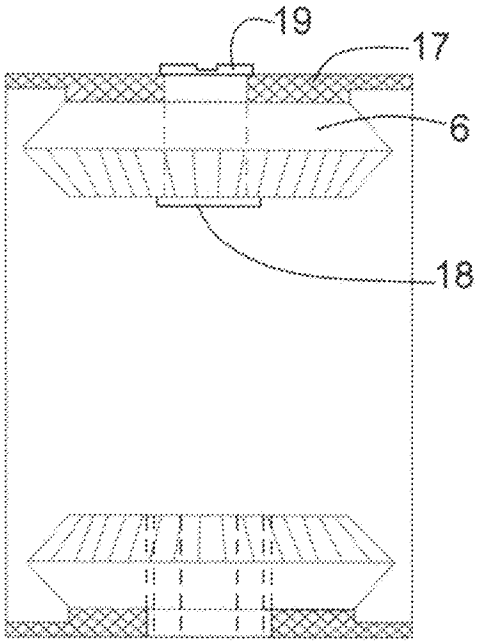
Figure 29:
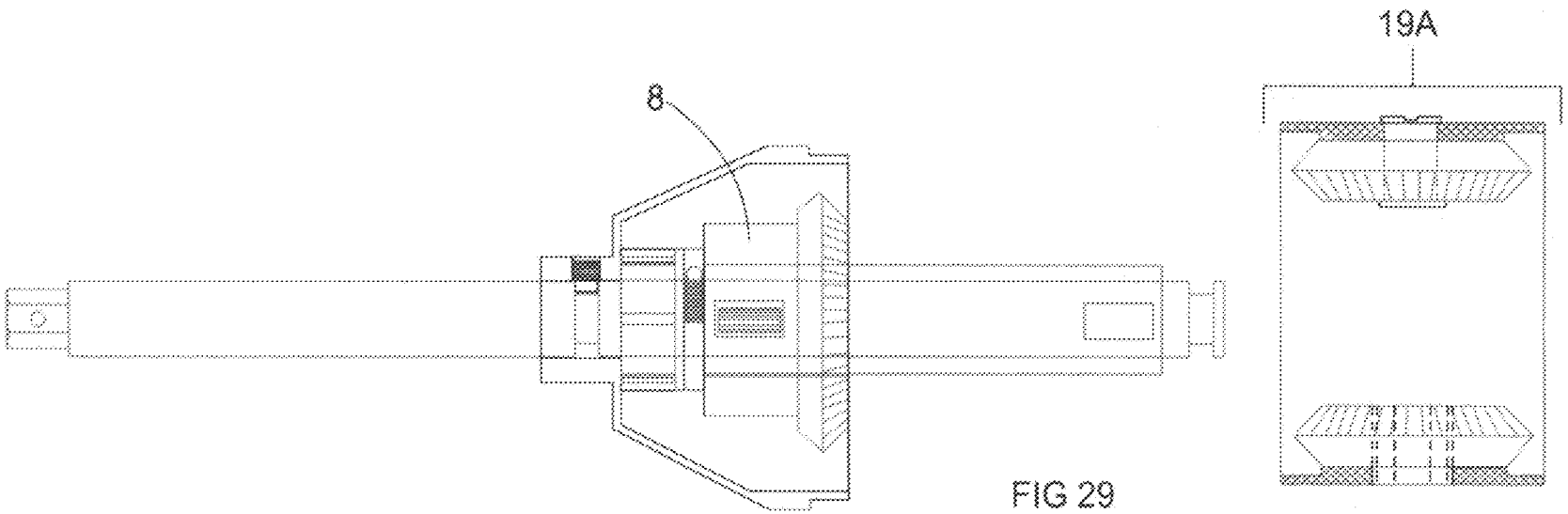
FIG. 29: Reversing Mechanism Assembly 19A, is prepared for being positioned, to mesh with the Second Driving Element 8.
Figure 30:
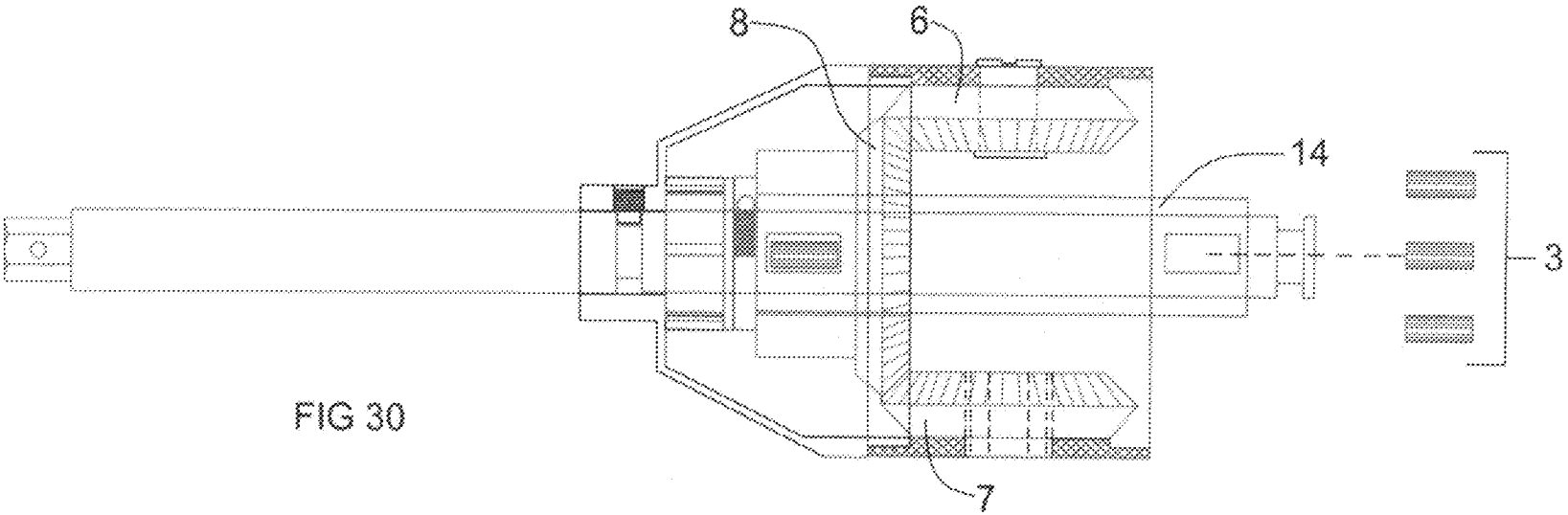
FIG. 30: Reversing Mechanism 19A is in place, with its First Rotating Element 6 and Second Rotating Element 7, meshing with the Second Driving Element 8. Components 3 of the Clutching Element, are prepared for installation into slots provided in Clutching Element Housing 14.
Figure 31:
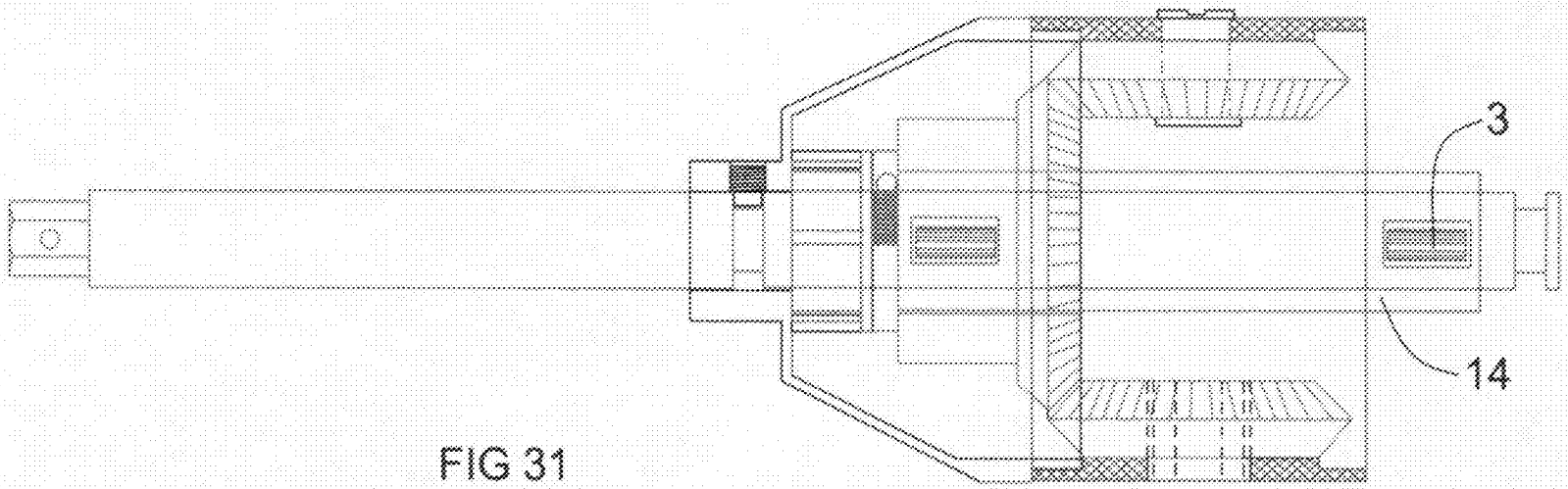
FIG. 31: Components 3 of the Clutching Element are installed into their respective slots provided in Clutching Element Housing 14.
Figure 32:
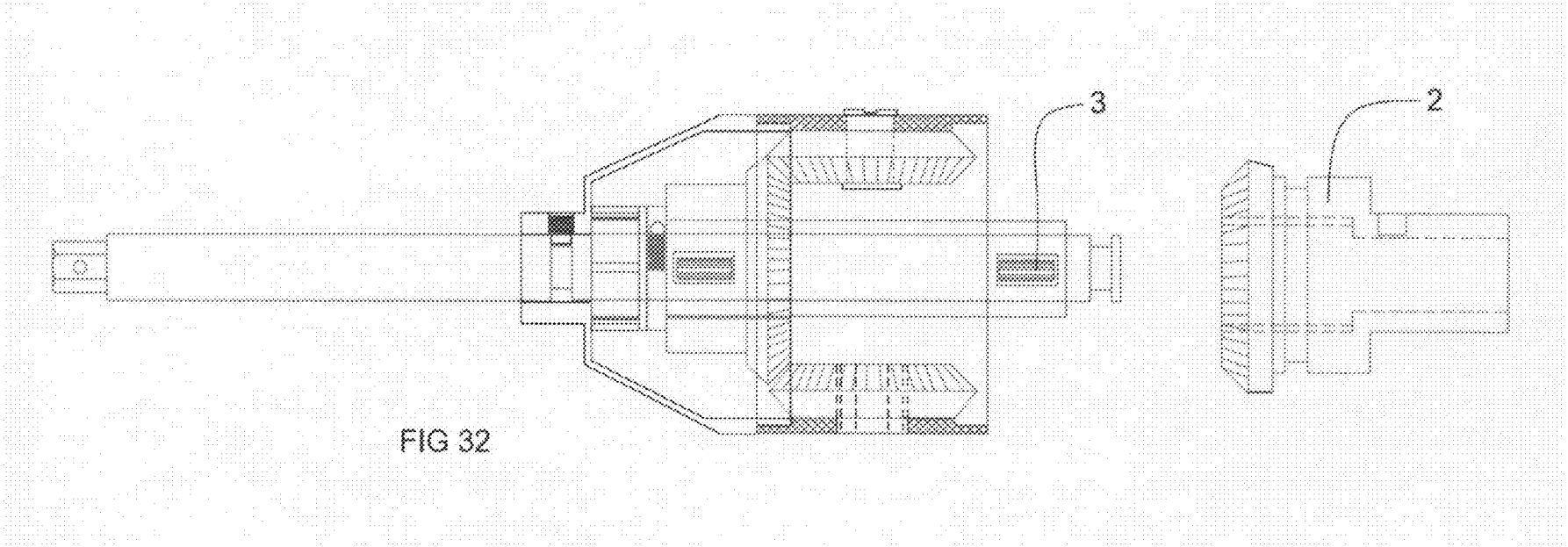
FIG. 32: The First Driving Element 2, is prepared to be slid onto Components 3 of the Clutching Element.
Figure 33:
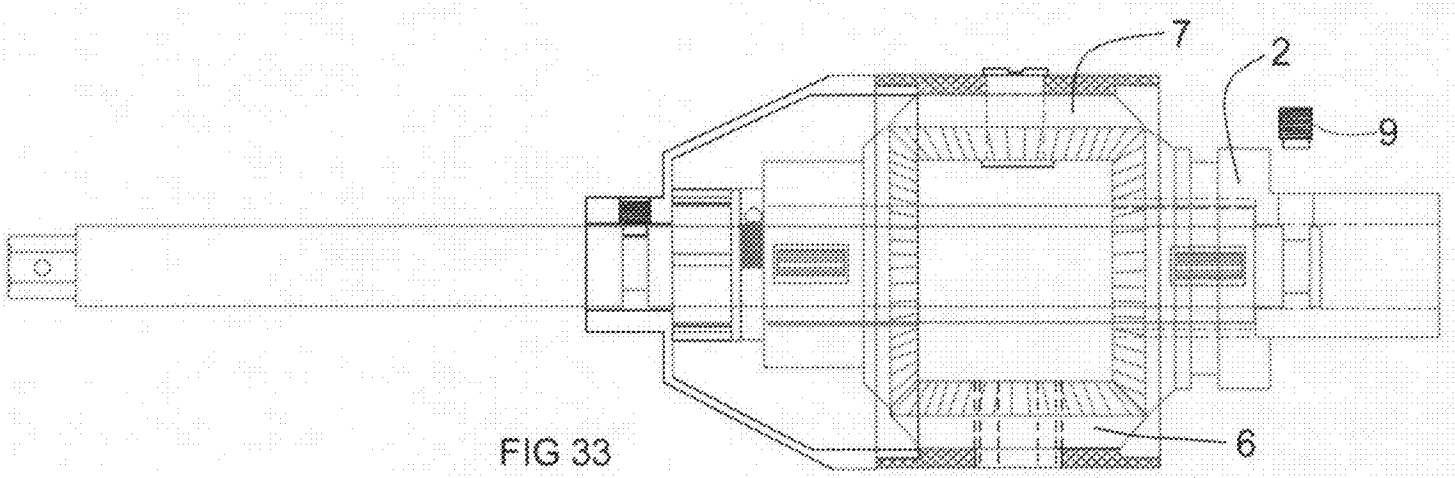
FIG. 33: The First Driving Element 2, is slid onto Components 3 of the Clutching Element and meshing with the First Rotating Element 6 and Second Rotating Element 7 of the Reversing Mechanism. Retainer Element 9 is prepared to be installed.
Figure 34:
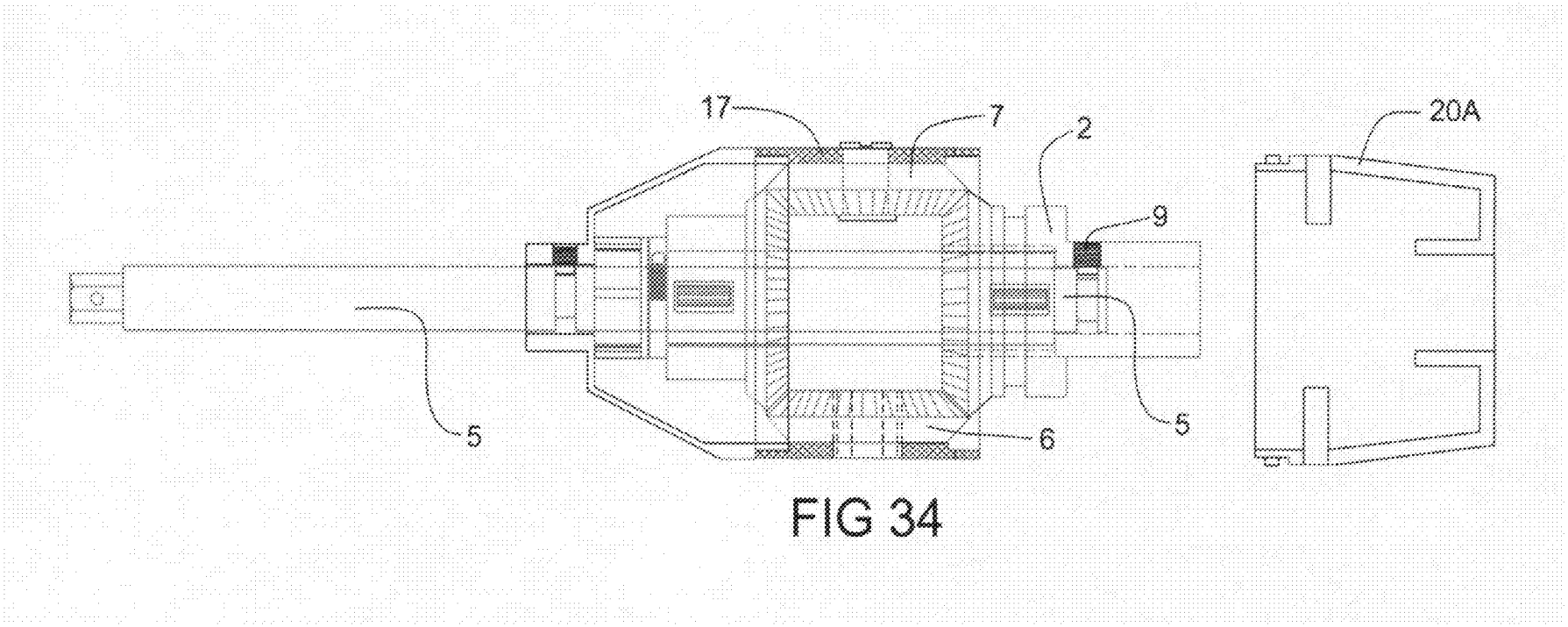
FIG. 34: Retainer Element 9 is installed to retain Second Driving Element 2 in position on Drive Shaft 5. Posterior Housing 20A is prepared for being slid over First Driving Element 2, then inserted into Reversing Mechanism Housing 17.
Figure 35:
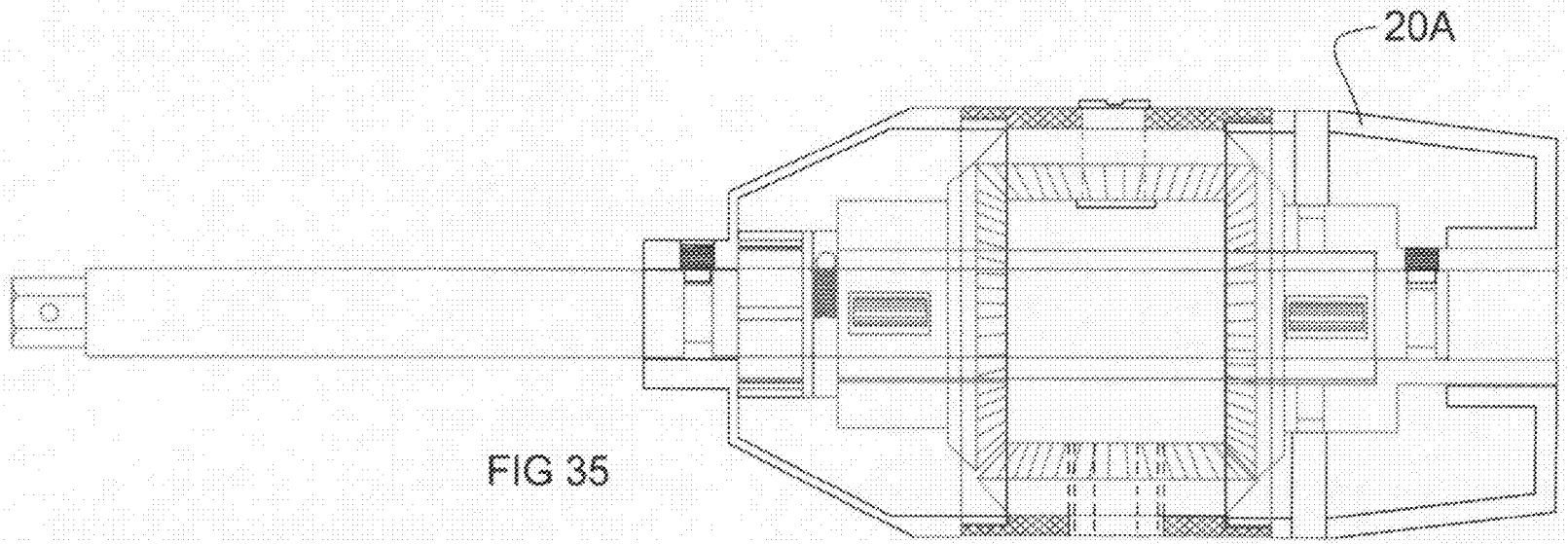
FIG. 35: Posterior Housing 20A, is slid onto First Driving Element 2, then inserted into Reversing Mechanism Housing 17.
Figure 36:
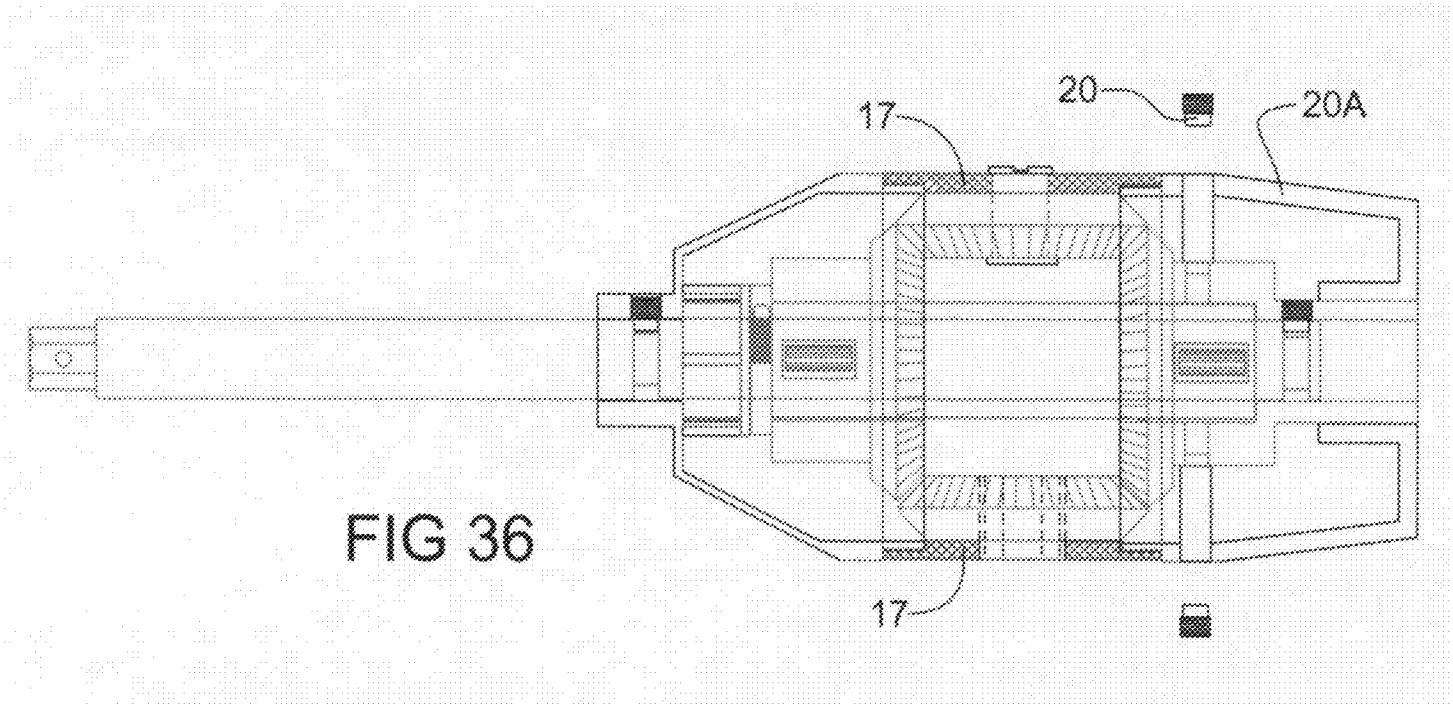
FIG. 36: A plurality of Retaining Elements 20, are prepared to be installed into Posterior Housing 20A.
Figure 37:
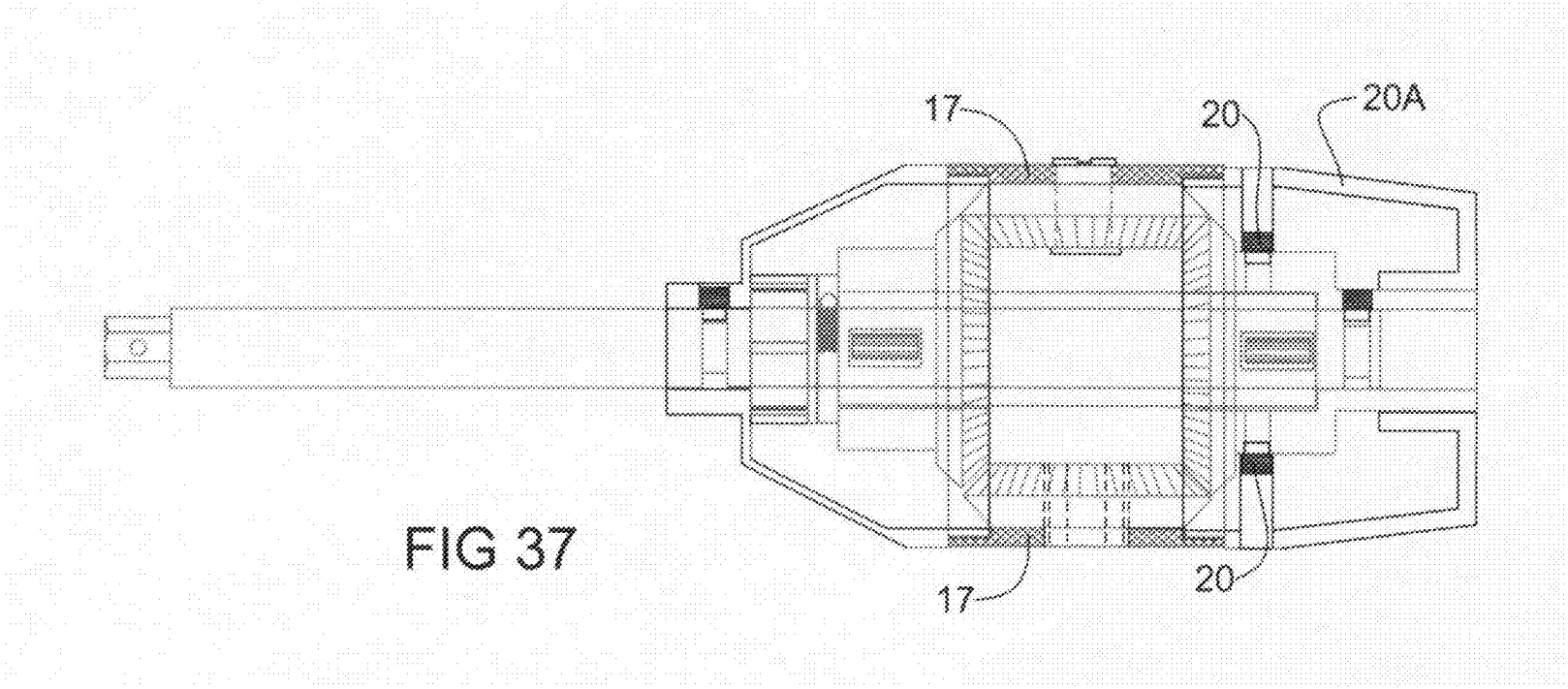
FIG. 37: A plurality of Retaining Elements 20 are installed, to secure First Driving Element 2, to Posterior Housing 20A.
Figure 38:
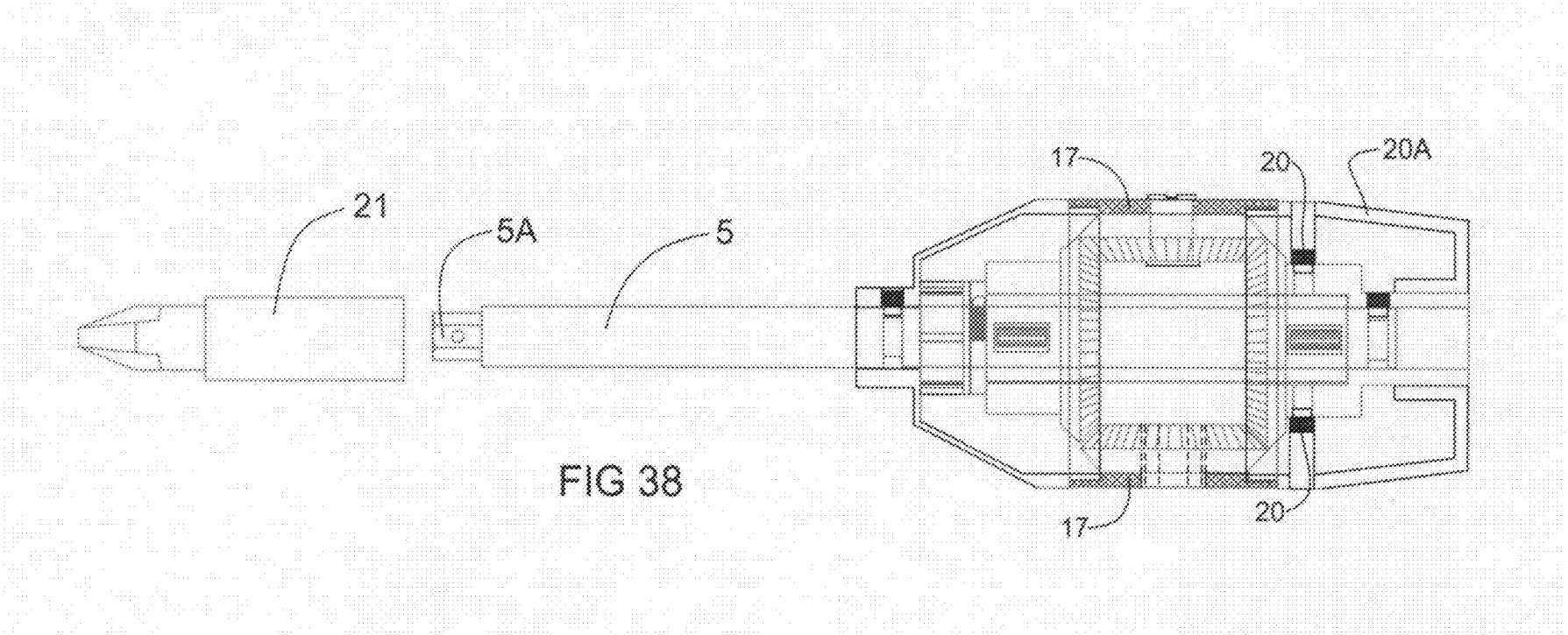
FIG. 38: Driver Bit 21 is prepared to be attached to Driving End 5*a* of Drive Shaft 5.
Figure 39:
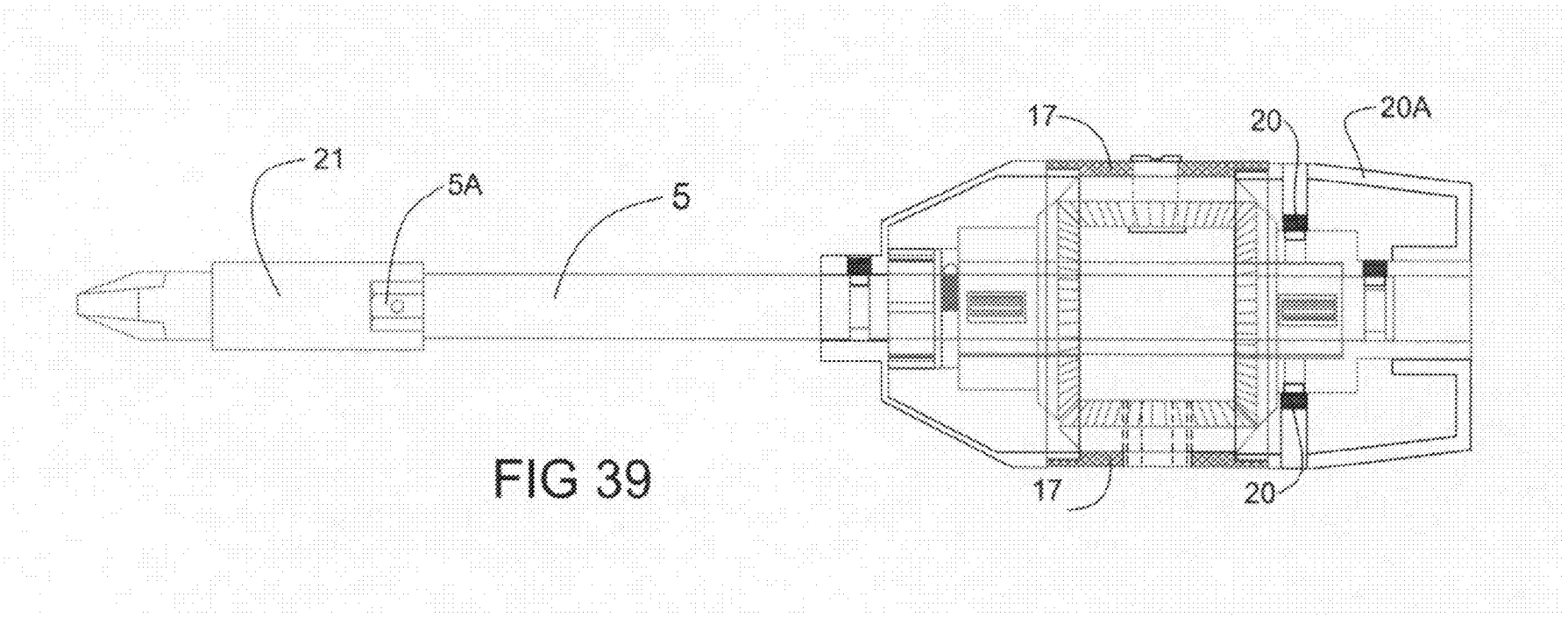
FIG. 39: Driver Bit 21 is attached to Driver End 5*a* of Drive Shaft 5.
Figure 40:
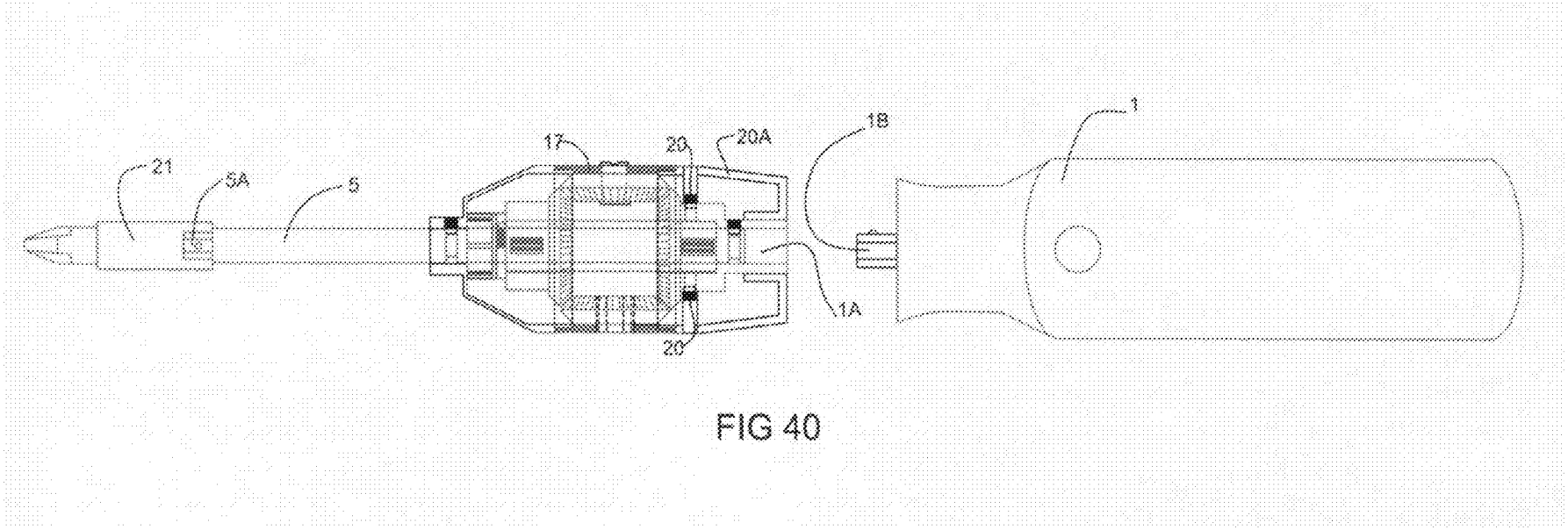
FIG. 40: Driving End 1B of Detachable Adjustable Handle 1, is prepared to be coupled to First Receptacle 1A of First Driving Element 2.
Figure 41:
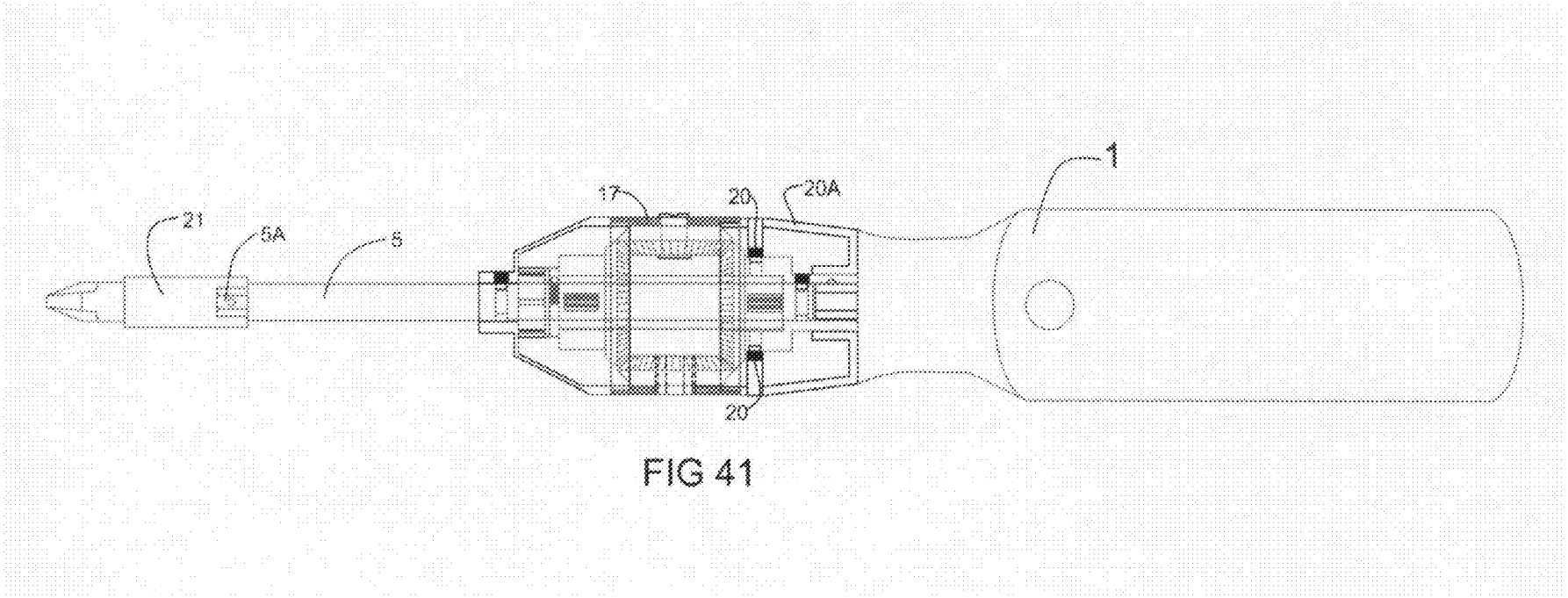
FIG. 41 is used to identify each component numerically, for the following suggested assembly procedure.
Figure 42:
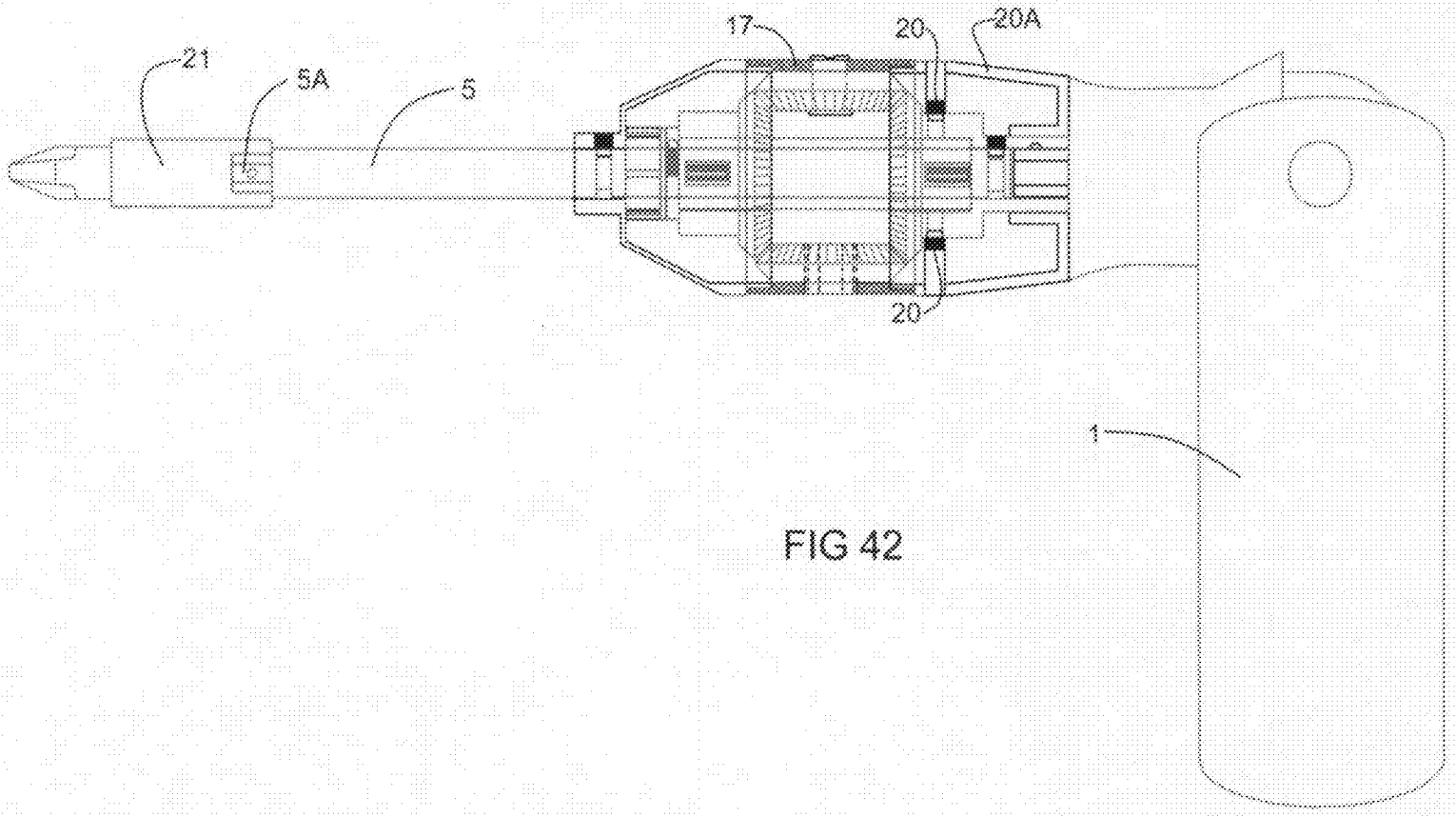
FIG. 42: Detachable Adjustable Handle 1 is pivoted to an angle to increase torque.
Figure 43:
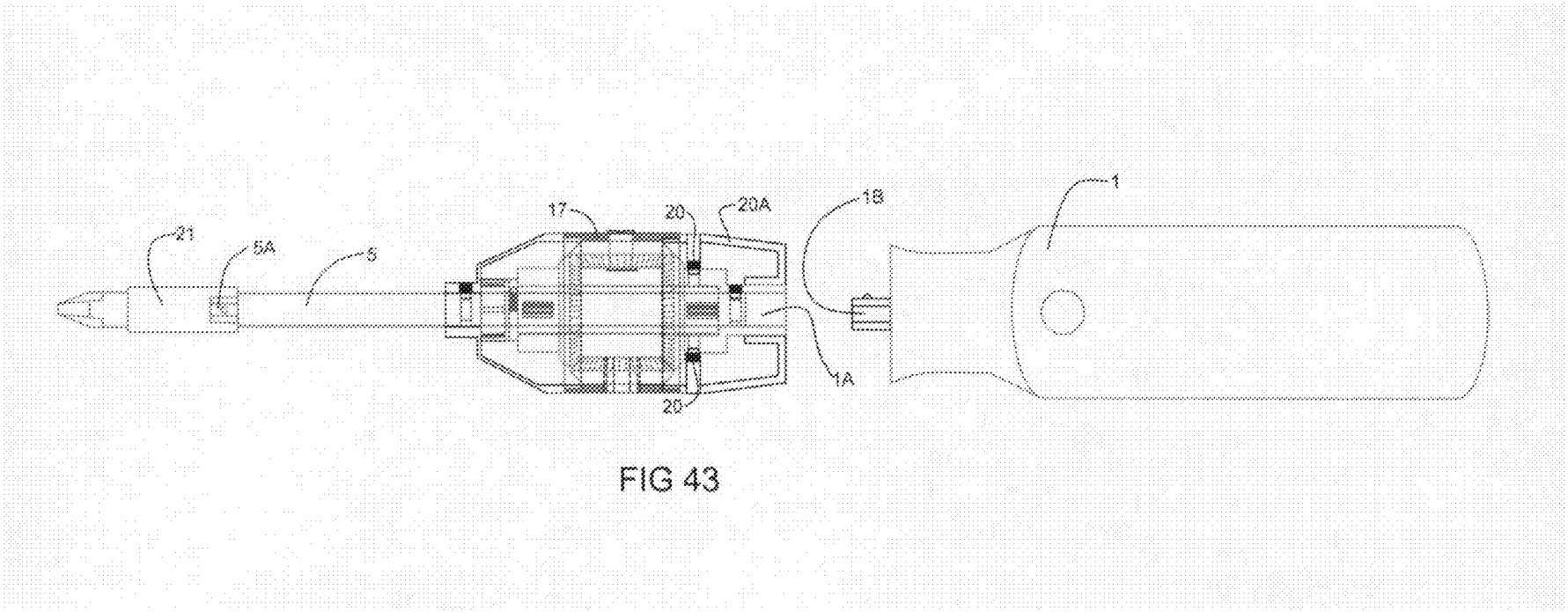
FIG. 43: Detachable Adjustable Handle 1 is decoupled from First Receptacle 1A of First Driving Element 2.
Figure 44:
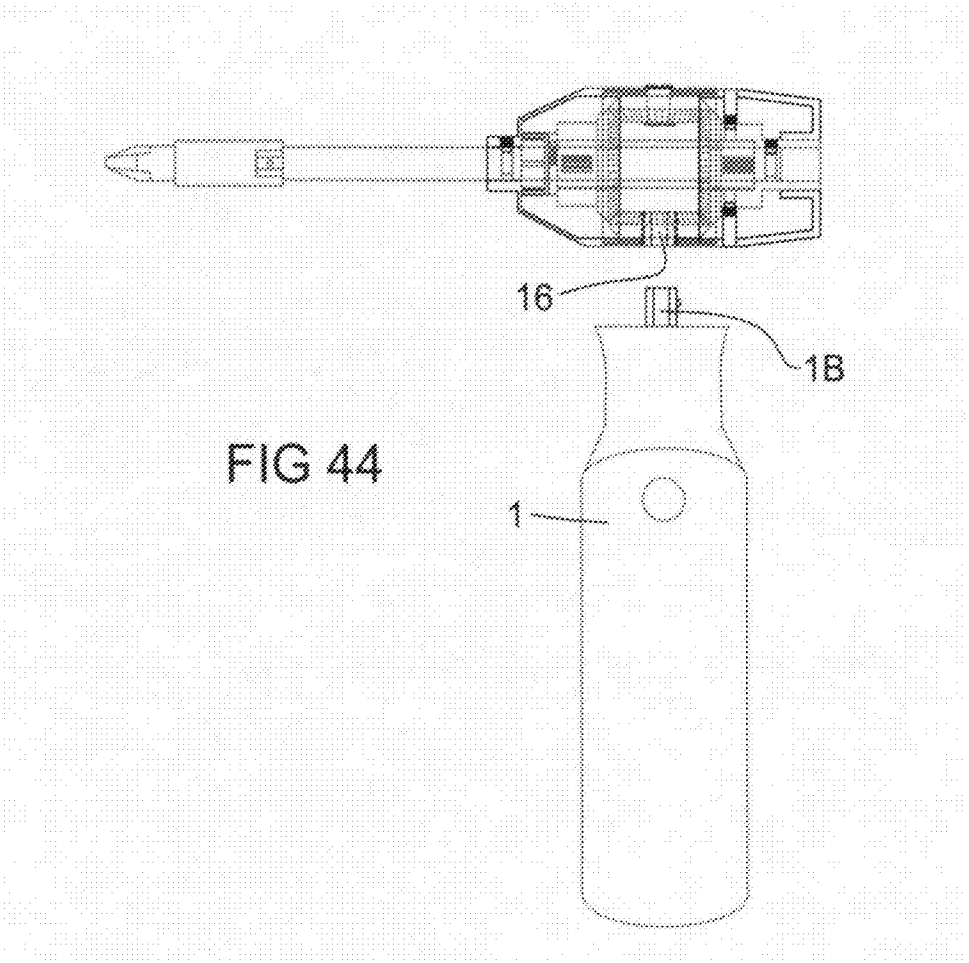
FIG. 44: Detachable Adjustable Handle 1 is prepared for being coupled to Second receptacle 16 of a gear of the Reversing Element
Figure 45:
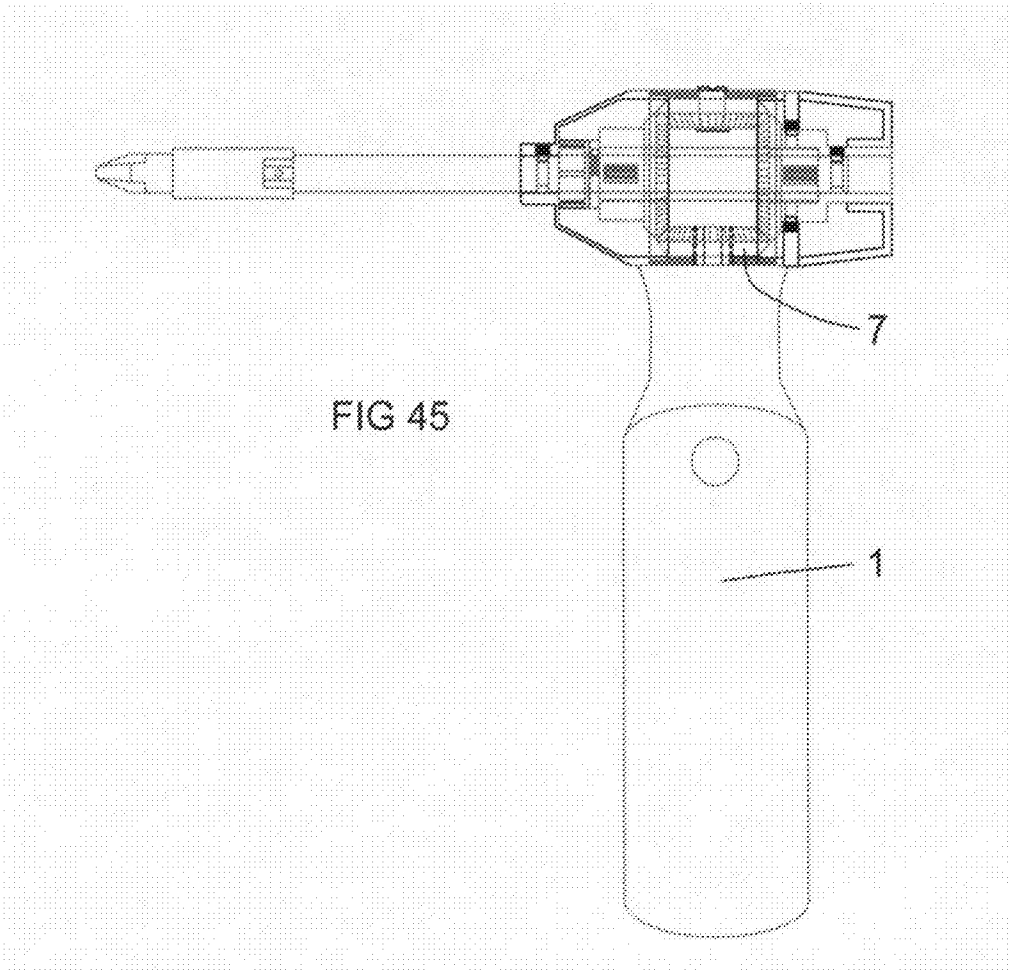
FIG. 45: Detachable Adjustable Handle 1 is coupled to Receptacle 16 of Second Rotating Element 7 of the Reversing Element.
Figure 46:
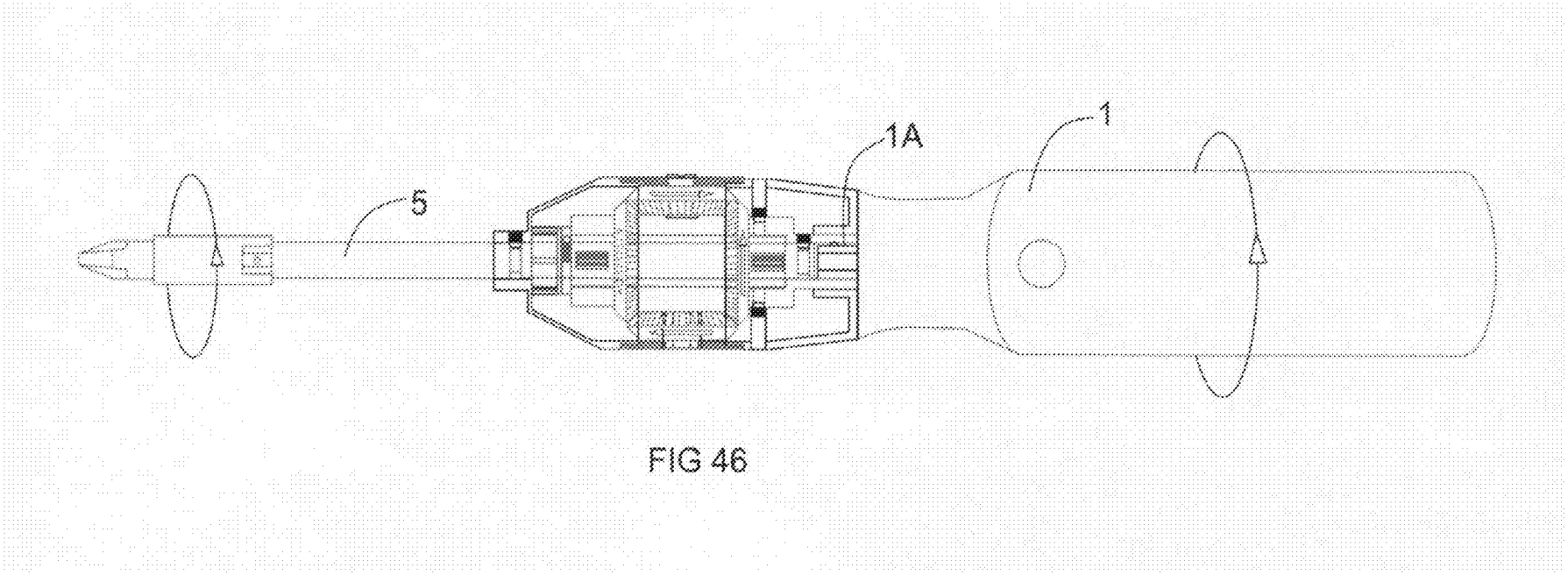
FIG. 46: Component rotation analysis, with Detachable Adjustable Handle 1 coupled to First Input Receptacle 1A and with double-drive mechanism set to clockwise output mode; clockwise input produces clockwise output.
Figure 47:
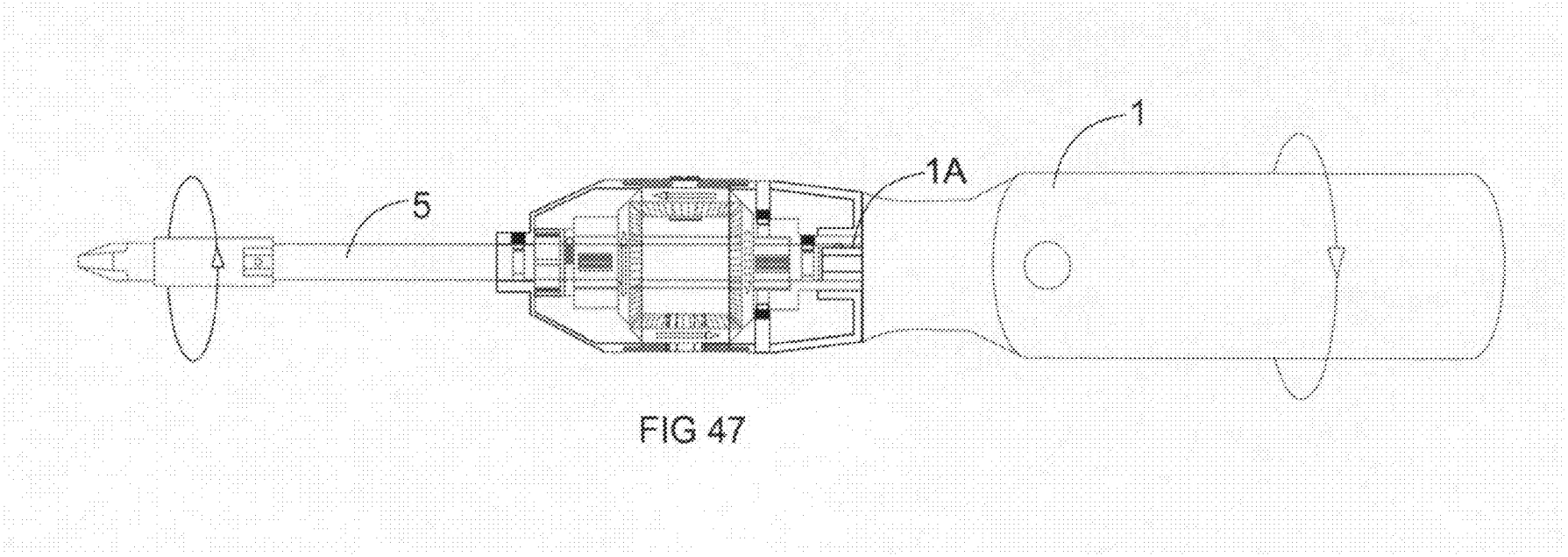
FIG. 47: Component rotation analysis with Detachable Adjustable Handle 1 coupled to First Input Receptacle 1A and with double-drive mechanism set to clockwise output mode; counter-clockwise input produces clockwise output. Solid arrows indicate direction of rotation; dashed arrows indicate direction of overrun.
Figure 48:
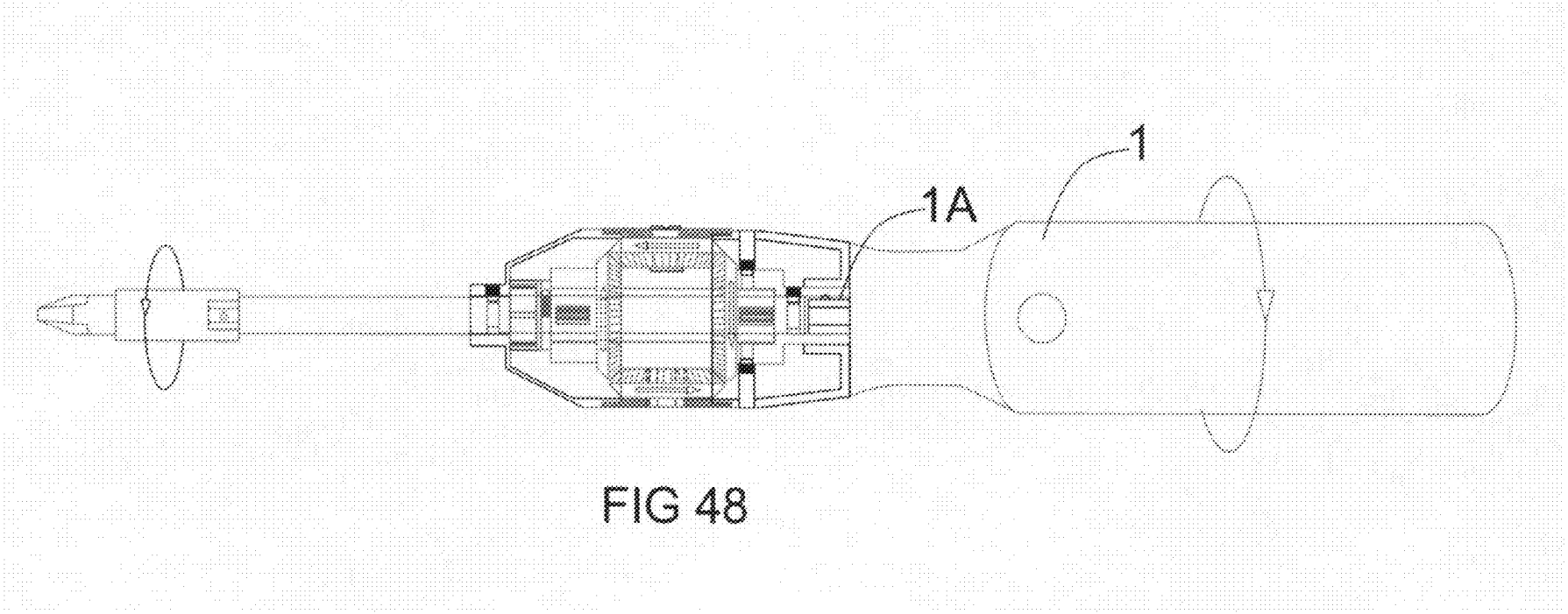
FIG. 48: Component rotation analysis with Detachable Adjustable Handle 1 coupled to First Input Receptacle 1A and with double-drive mechanism set to counter-clockwise output mode; counter-clockwise input produces counter-clockwise output. Solid arrows indicate direction of rotation; dashed arrows indicate direction of overrun.
Figure 49:
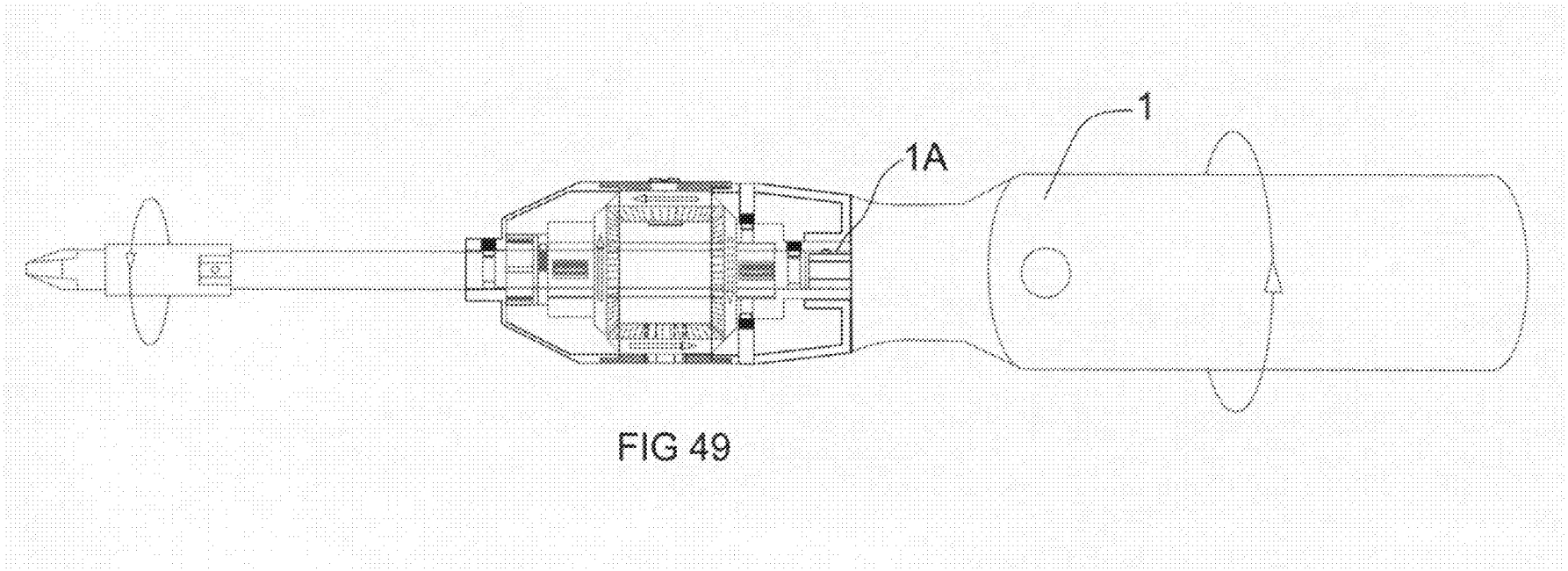
FIG. 49: Component rotation analysis with Detachable Adjustable Handle 1 coupled to First Input Receptacle 1A and with double-drive mechanism set to counter-clockwise output mode; clockwise input produces counter-clockwise output. Solid arrows indicate direction of rotation; dashed arrows indicate direction of overrun.
Figure 50:
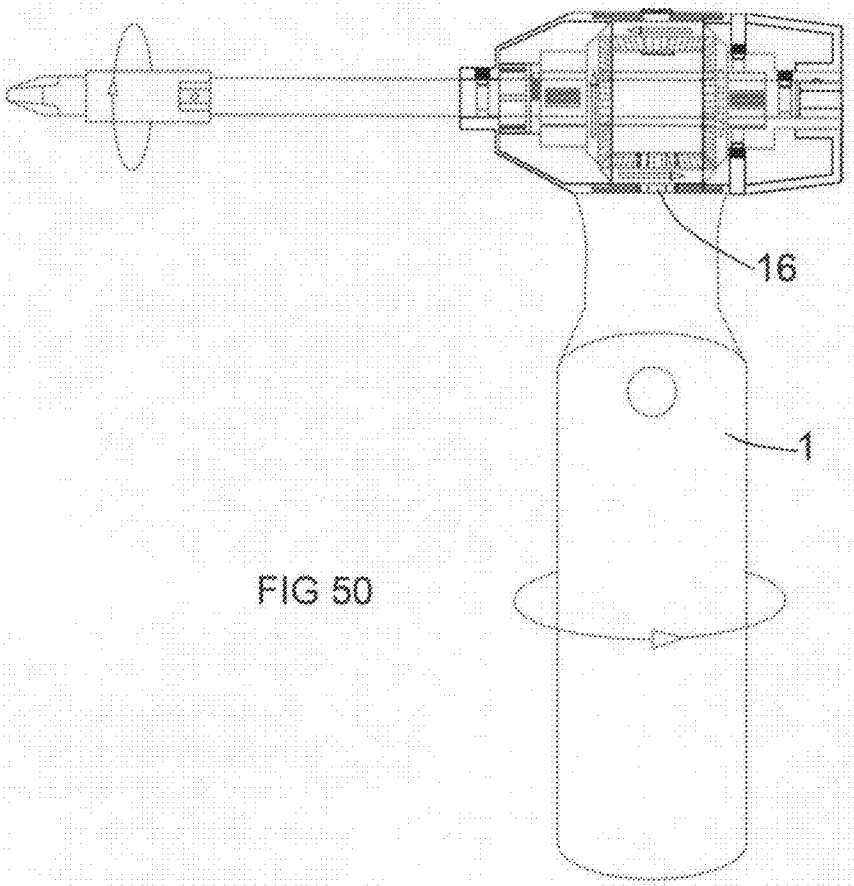
FIG. 50: Component rotation analysis with Detachable Adjustable Handle 1 coupled to Second Input Receptacle 16 and with double-drive mechanism set to clockwise output mode; clockwise input produces clockwise output. Solid arrows indicate direction of rotation; dashed arrows indicate direction of overrun.
Figure 51:
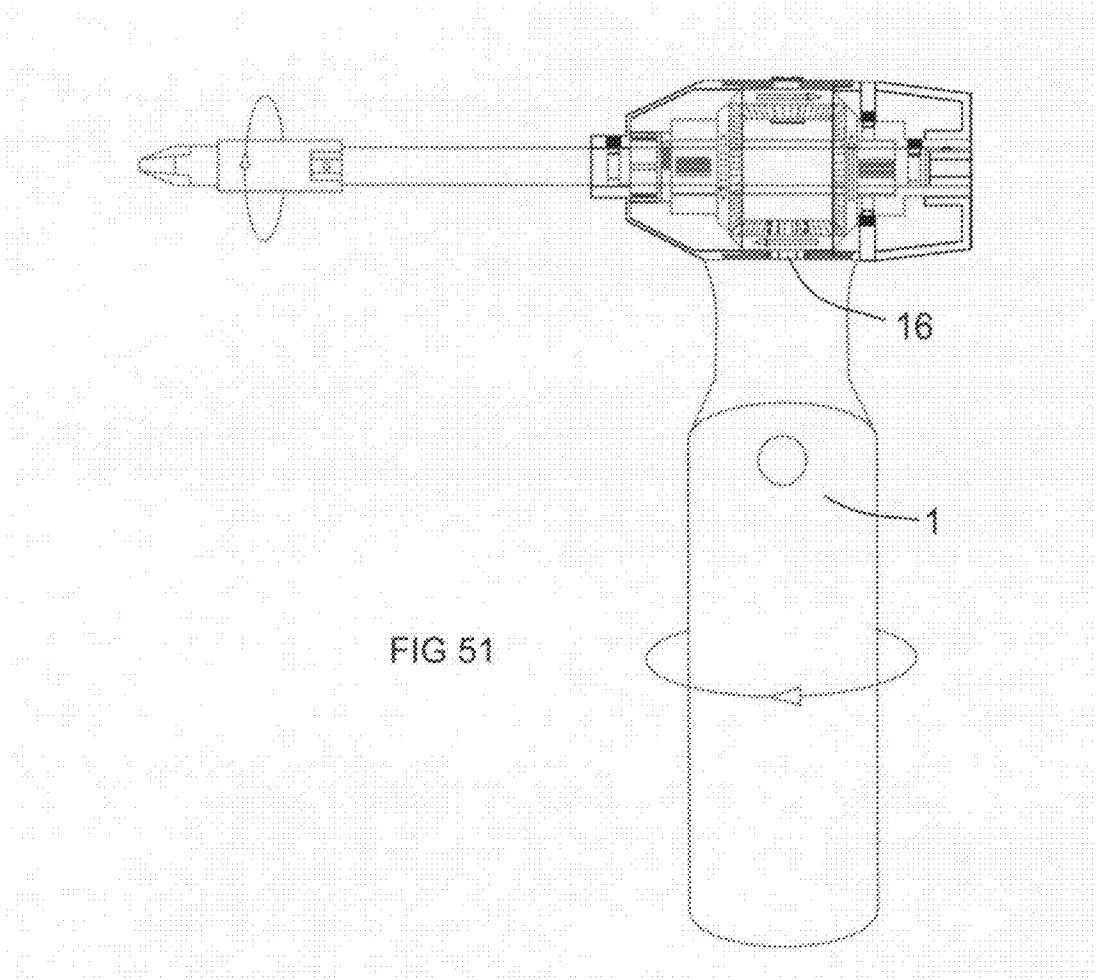
FIG. 51: Component rotation analysis with Detachable Adjustable Handle 1 coupled to Second Input Receptacle 16 and with double-drive mechanism set to clockwise output mode; counter-clockwise input produces clockwise output. Solid arrows indicate direction of rotation; dashed arrows indicate direction of overrun.
Figure 52:
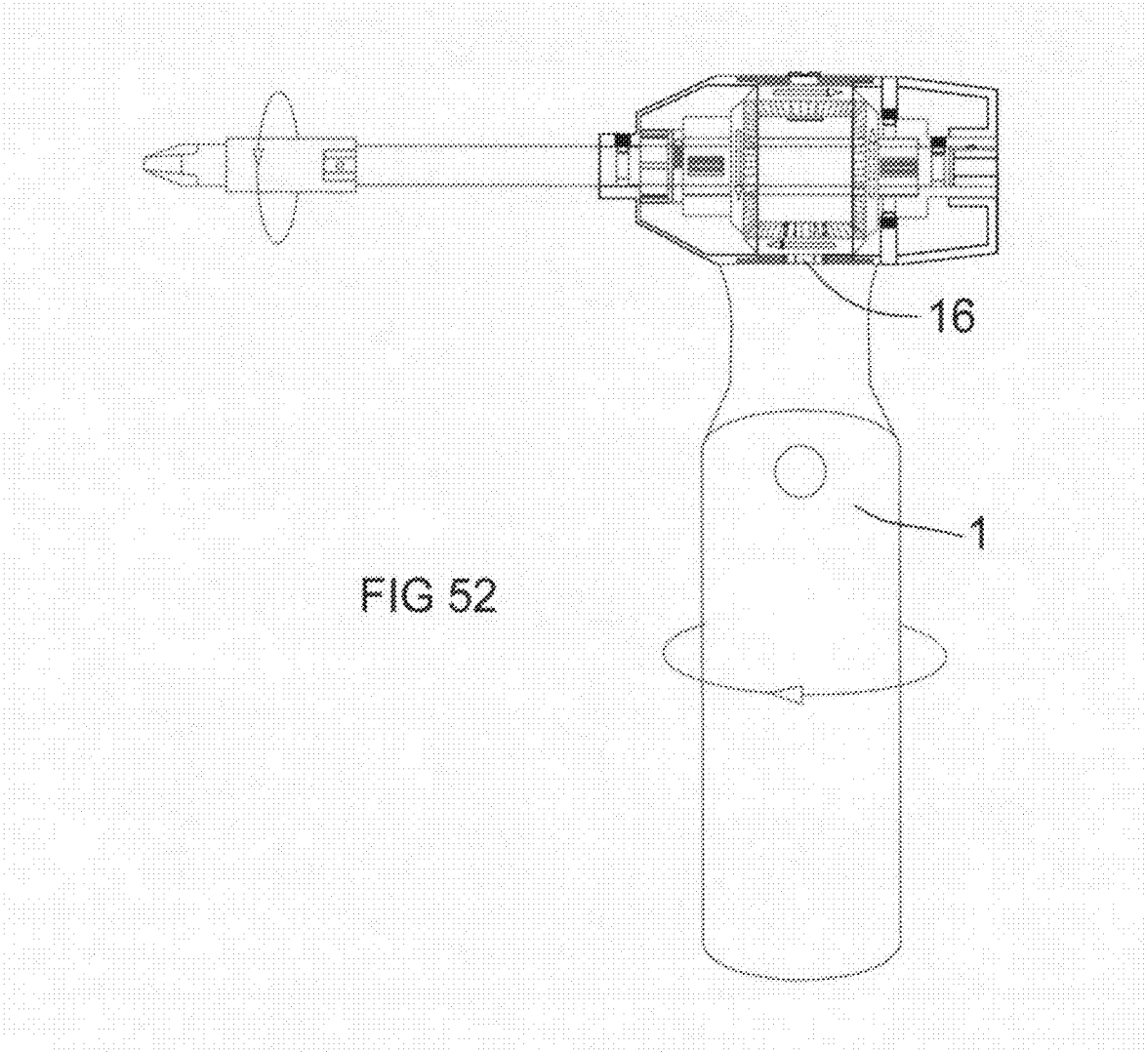
FIG. 52: Component rotation analysis with Detachable Adjustable Handle 1 coupled to Second Input Receptacle 16 and with double-drive mechanism set to counter-clockwise output mode; counter-clockwise input produces counter-clockwise output. Solid arrows indicate direction of rotation; dashed arrows indicate direction of overrun.
Figure 53:
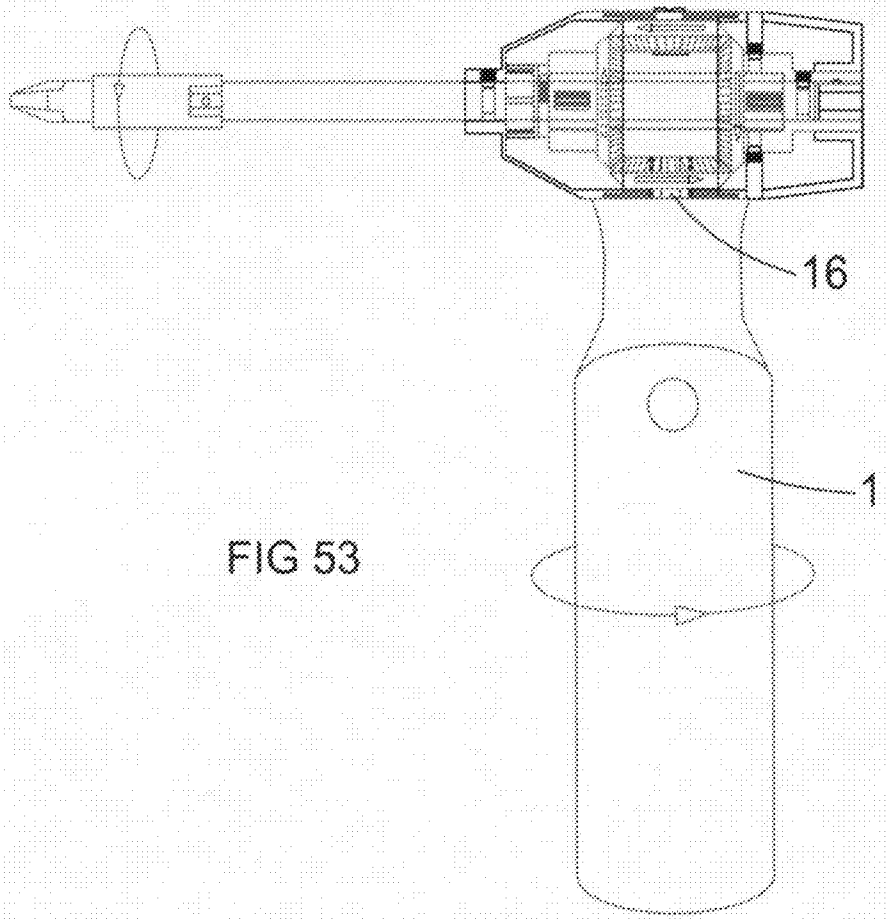
Figure 54:
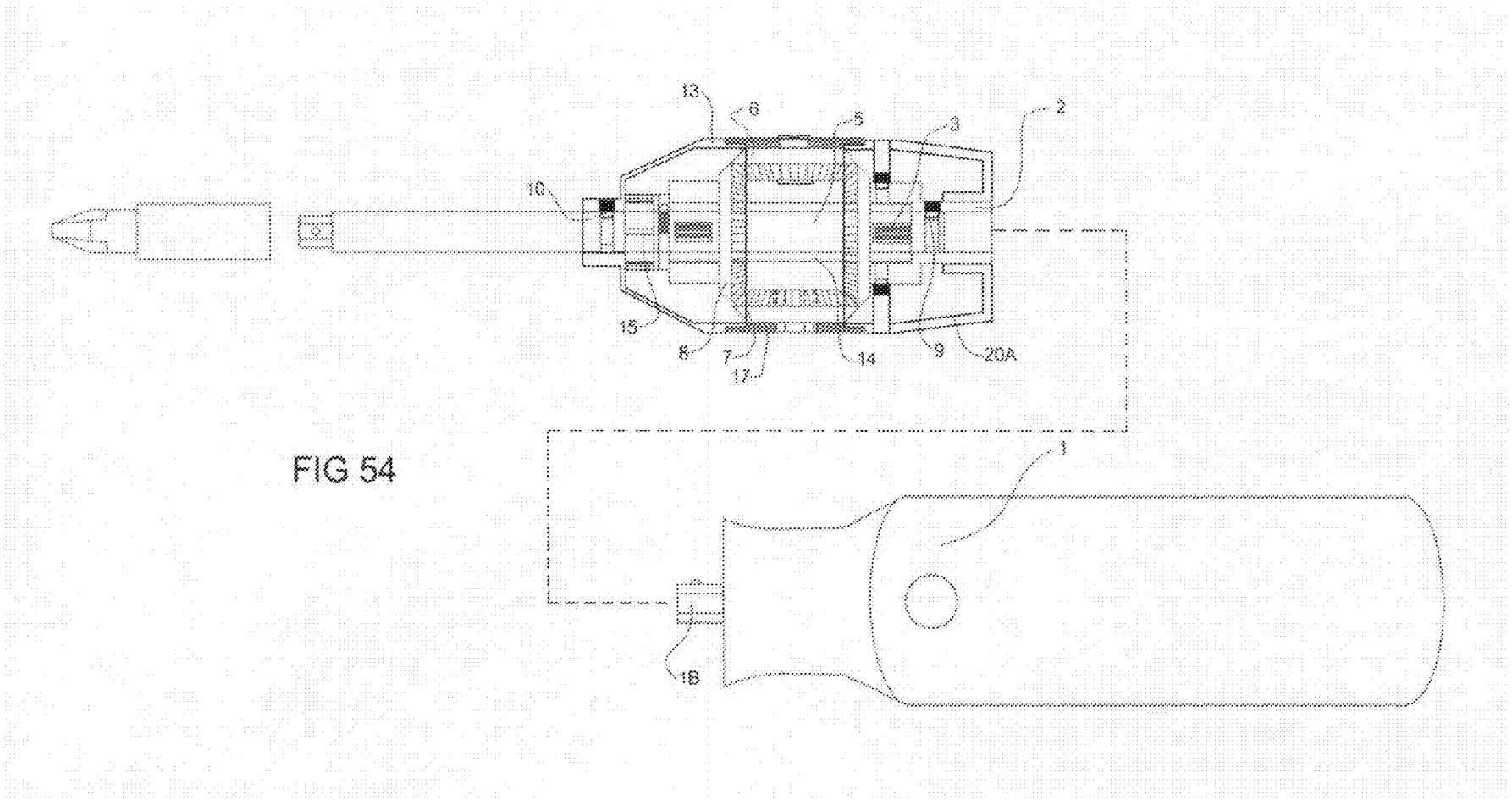
FIG. 54: Components are identified numerically to coincide with written description of the mechanics of the double-drive mechanism, that is set to clockwise output mode with clockwise rotation applied to the First Input Receptacle 1A.

In FIG. 54, with the dual-drive self-ratcheting mechanism secured into clockwise shaft-rotation mode, Detachable Adjustable Handle 1, is provided with Coupling Member 1B, that is coupled concentrically into the hub of First Driving Element 2 and turned clockwise axially, while Reversing Mechanism Housing 17 is held stationary, causing said First Driving Element 2 to rotate clockwise and entrain a plurality of Member 3 which become wedged between bore of First Driving Element 2 and Drive Shaft 5; causing Drive Shaft 5 to rotate clockwise; while Second Rotating Element 6 of Reversing Mechanism, is caused to rotate clockwise and First Rotating Element 7 of Reversing Mechanism is caused to rotate counterclockwise; causing Second Driving Element 8, to rotate counterclockwise to override Drive Shaft 5.

Regardless of the direction of axial rotation applied to Detachable Adjustable-Angle Handle 1, in clockwise output mode, Drive Shaft rotation is always clockwise.

Anterior Housing 13, rotatably mounted onto Drive Shaft 5 and keyed to Switch Element 15, which is coupled to Clutch Element Housing 14, is a switching means to change the double-drive self-ratcheting mechanism, from clockwise to counterclockwise shaft rotation and from counterclockwise to clockwise shaft rotation.

Retaining Element 9 in a groove in Drive Shaft 5, retains Anterior Housing 13 in place on Drive Shaft 5, to prevent longitudinal movement of Anterior Housing.

Retaining Element 10 in a groove in Drive Shaft 5, retains Drive Shaft 5 and Posterior Housing 20A, to prevent their longitudinal movement.

Figure 55:
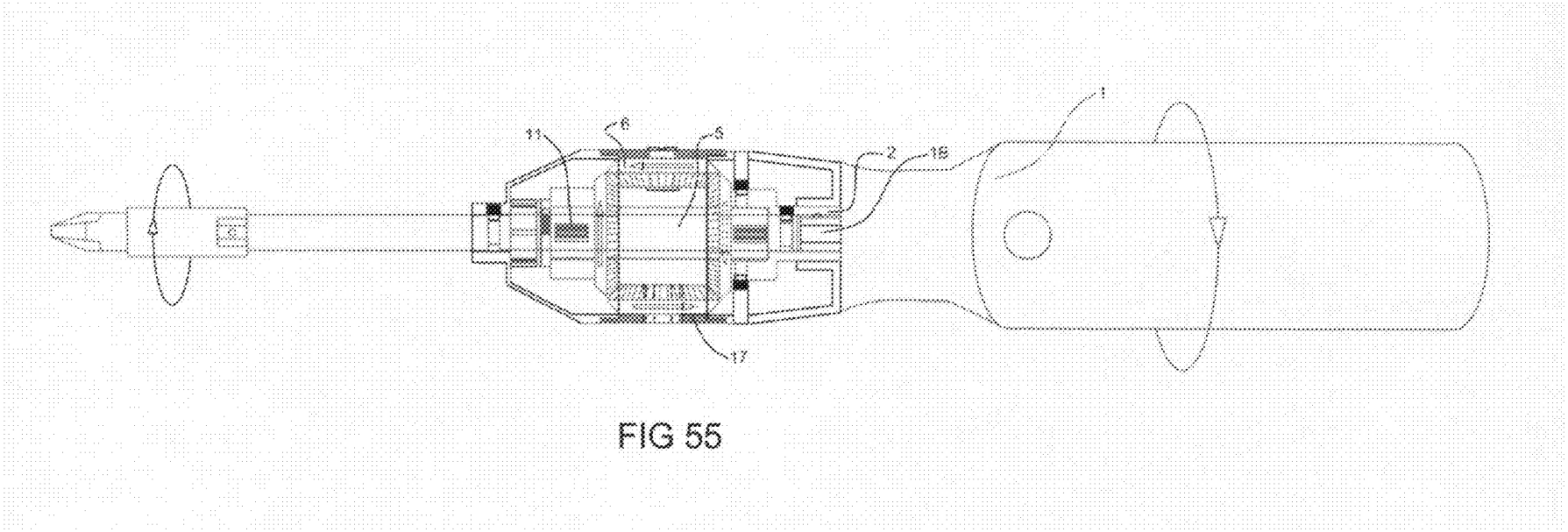
FIG. 55: Components are identified numerically to coincide with written description of the mechanics of the double-drive mechanism, that is set to clockwise output mode with counter clockwise rotation applied to the First Input Receptacle.

In FIG. 55, with the dual-drive mechanism secured into clockwise shaft-rotation mode, Detachable Adjustable Handle 1 is provided with Driving Element 1B, that is inserted into hub of 1st Driving Element 2 and turned counterclockwise axially, while Reversing Mechanism Housing 17 is held stationary, causing said 1st Driving Element 2 to rotate counterclockwise and override Drive Shaft 5; while Second Rotating Element 6 of Reversing Mechanism, is caused to rotate counterclockwise and First Rotating Element 7 of Reversing Mechanism is caused to rotate clockwise; causing Second Driving Element 8, to rotate clockwise to entrain a plurality of Member 11 which become wedged between bore of Driving Element 2 and Drive Shaft 5; causing Drive Shaft 5 to rotate clockwise.

Regardless of the direction of rotation applied to Detachable Adjustable Handle 1, in clockwise output mode, Drive Shaft 5 axial rotation is always clockwise.

Figure 56:
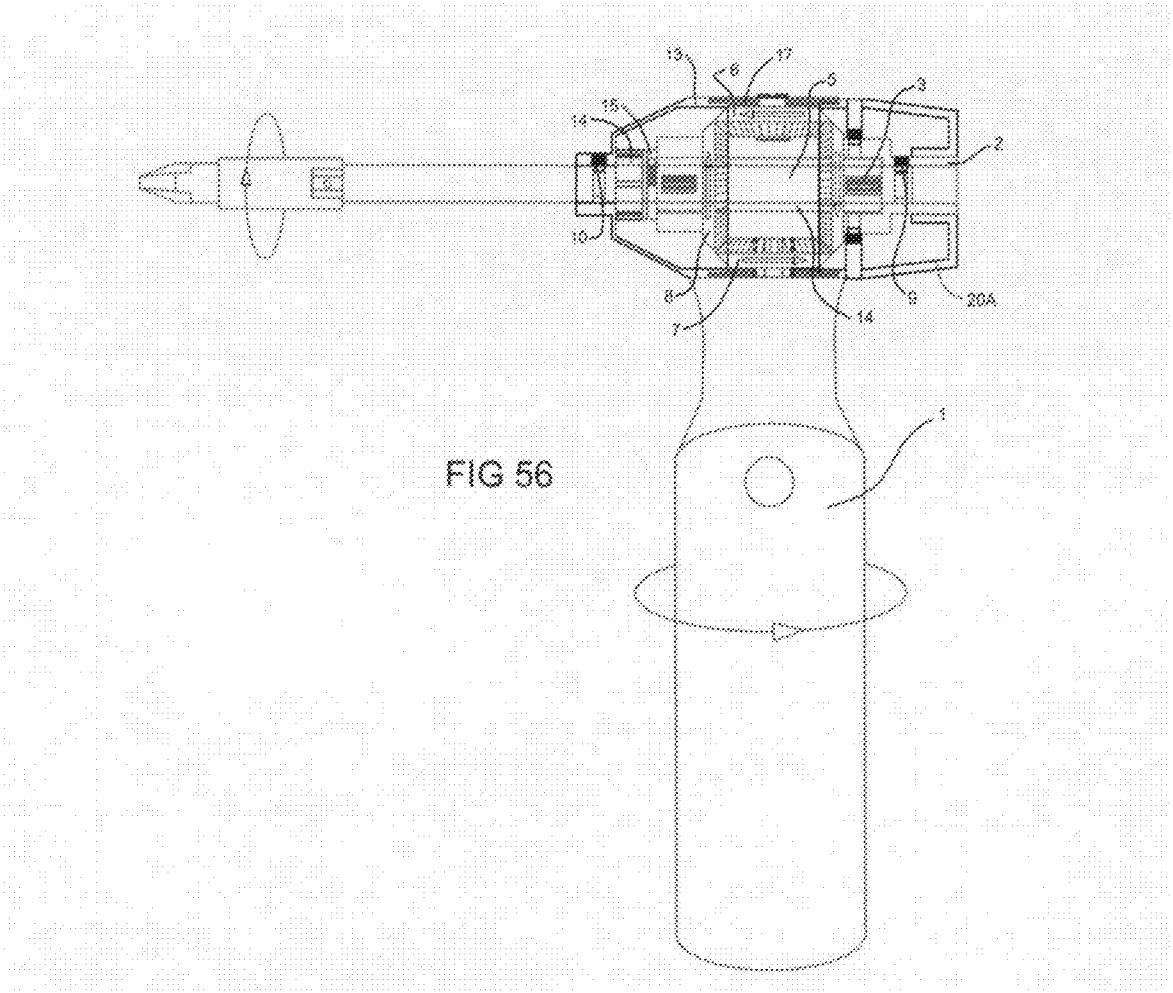
FIG. 56: Components are identified numerically to coincide with written description of the mechanics of the double-drive mechanism, which is set to clockwise output mode with clockwise rotation applied to the Second Input Receptacle 16.

In FIG. 56, with the dual-drive mechanism secured into clockwise shaft-rotation mode, Driving Element 1B of Detachable Adjustable Handle 1, is coupled to Second Rotating Element 6 of Reversing Mechanism for right-angle driving. Detachable Adjustable Handle 1 is turned axially clockwise to cause the same component rotation, as described in FIG. 54.

Figure 57:
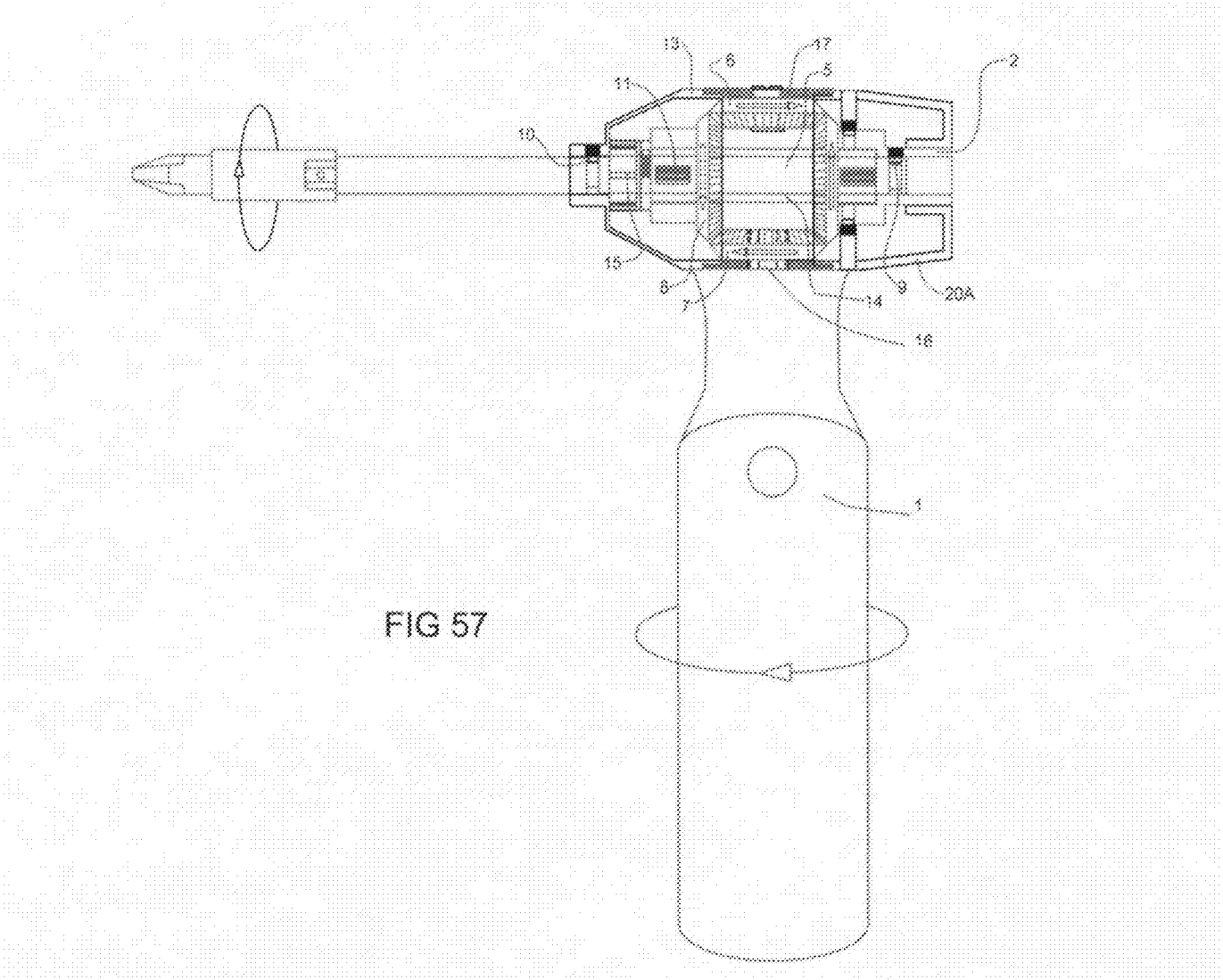
FIG. 57: Double-drive mechanism is set to clockwise output mode with clockwise rotation applied to the Second Input Receptacle 16.
Figure 58:
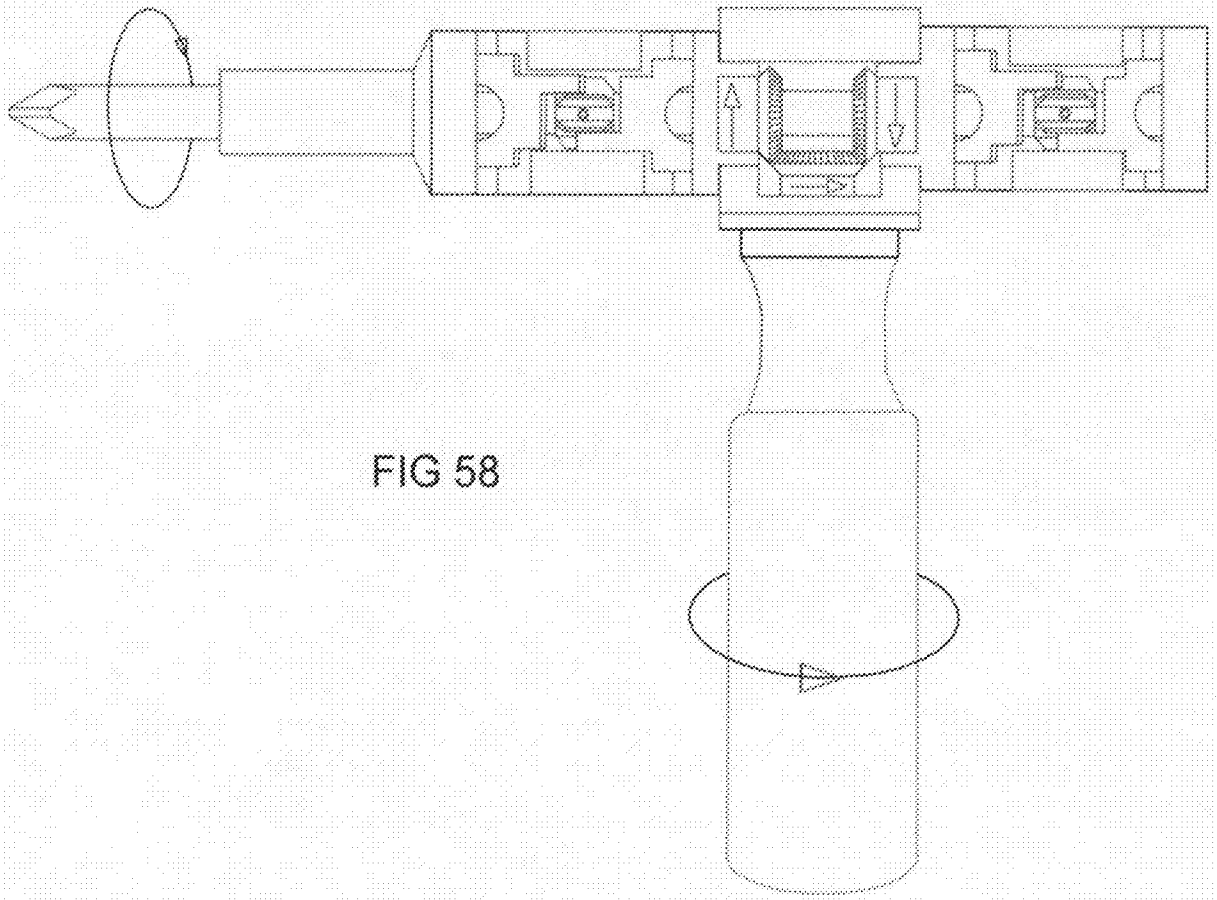
FIG. 58: Because the dual-drive self-ratcheting mechanism can employ any mechanical means, such as, but, not limited to, at least a pair of ratchet wheels and pawls or roller type clutches, or their equivalents, to entrain a driveshaft to rotate axially in only one direction.
Figure 59:
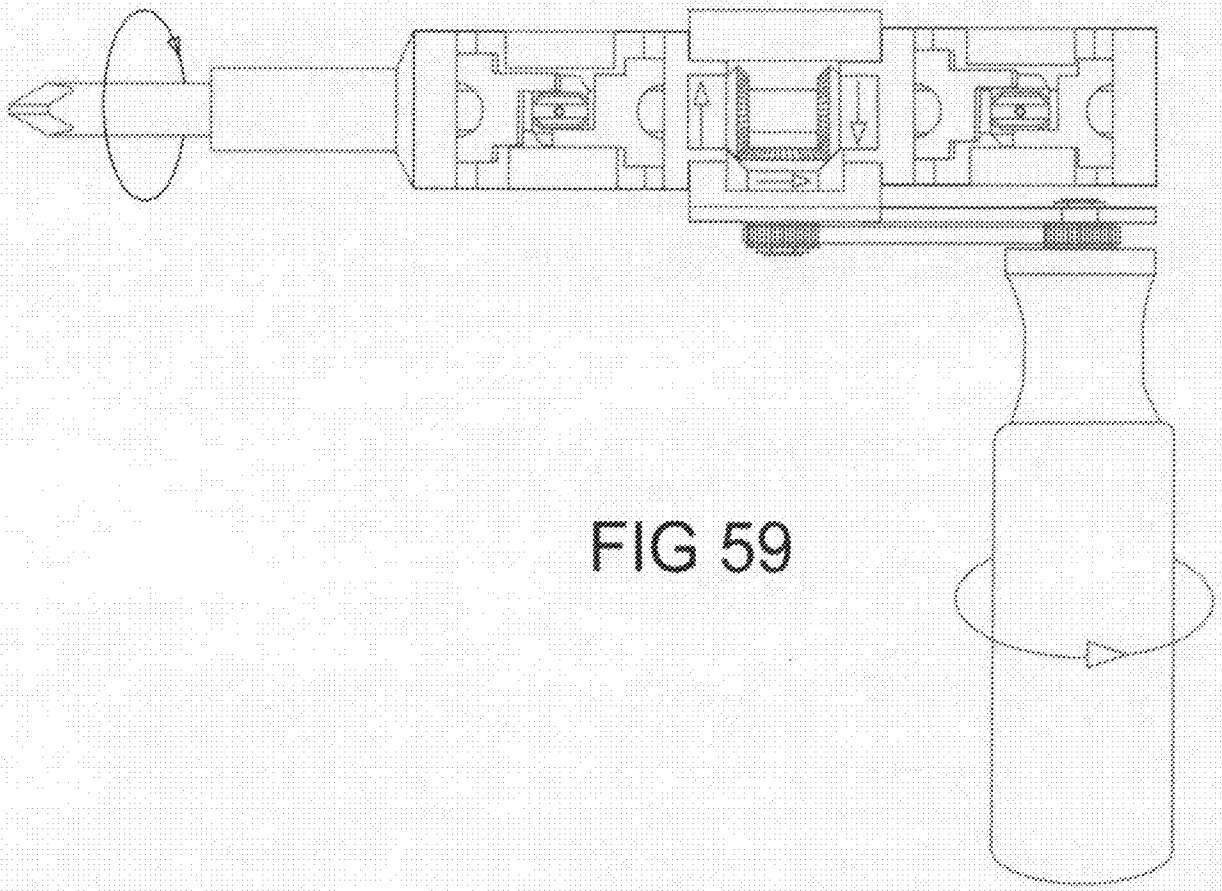
FIG. 59: In this arrangement, a pair of ratchet wheels and pawls are employed to cause the dual-drive, self-ratcheting action. Shown is a belt-drive or chain-drive arrangement for coupling the input handle 'indirectly', to the reversing mechanism.
Figure 60:
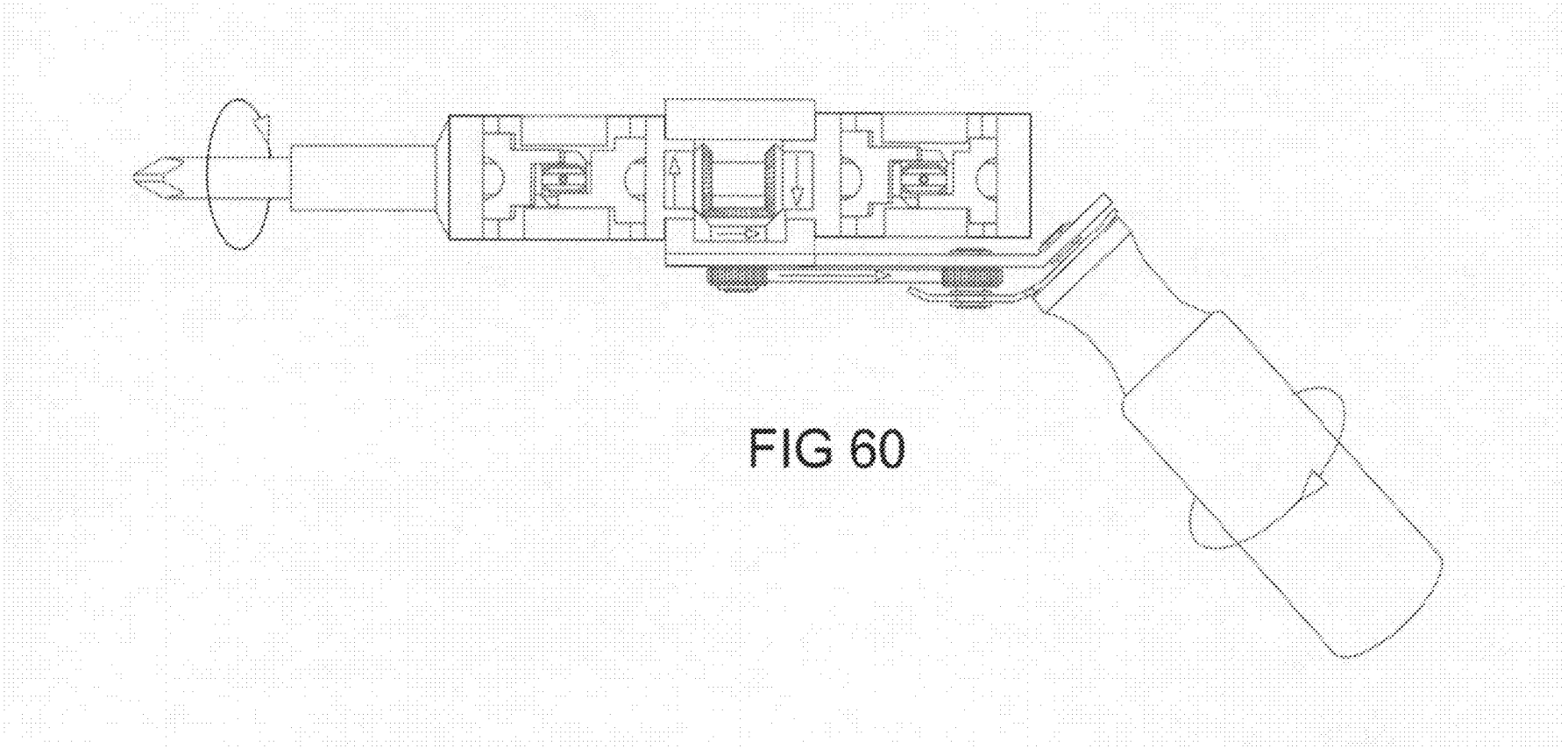
FIG. 60: In this arrangement, a pair of ratchet wheels and pawls are employed to cause the dual-drive, self-ratcheting action. Shown is a belt-drive or chain-drive arrangement with an ergonomic angled-handle, for coupling the input handle 'indirectly', to the reversing mechanism.
Figure 61:
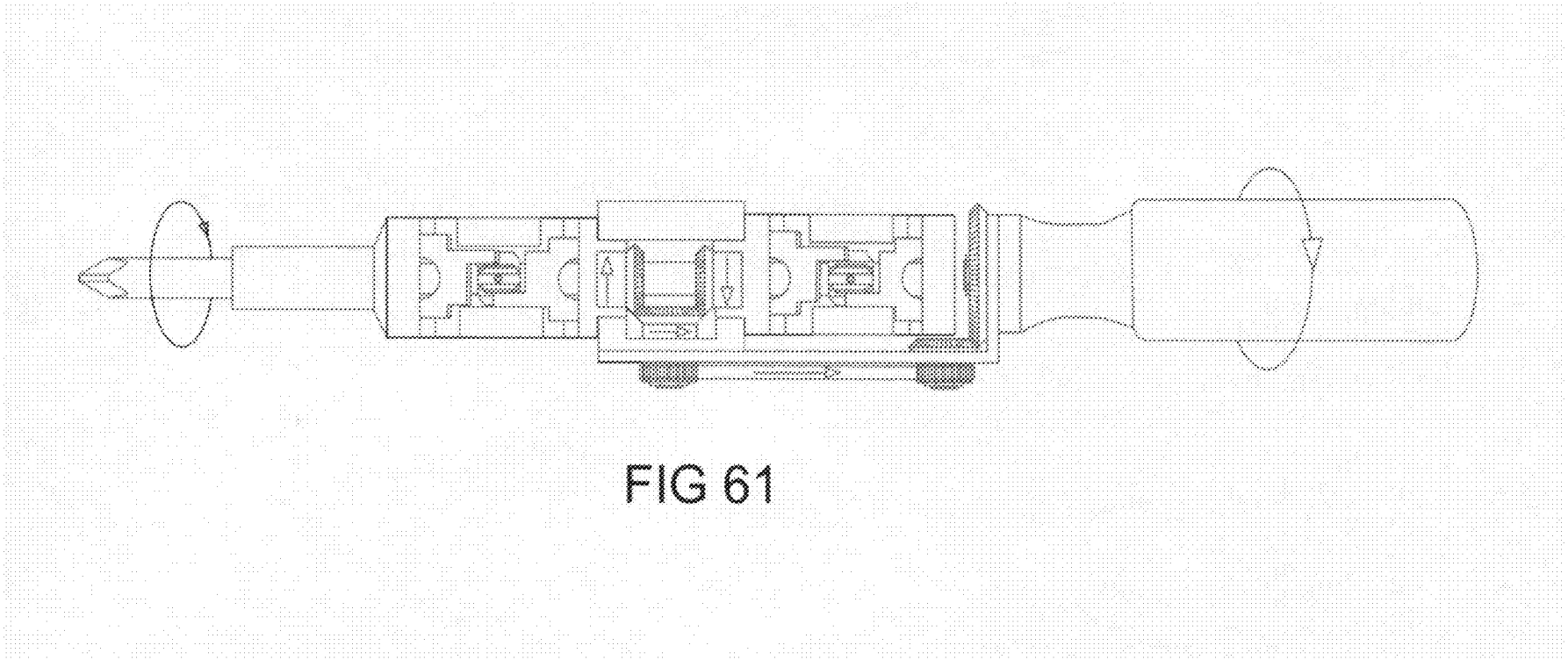
FIG. 61: In this arrangement, a pair of ratchet wheels and pawls are employed to cause the dual-drive, self-ratcheting action. Shown is a belt-drive or chain-drive with an in-line arrangement, for coupling the input handle 'indirectly', to the reversing mechanism.
Figure 62:
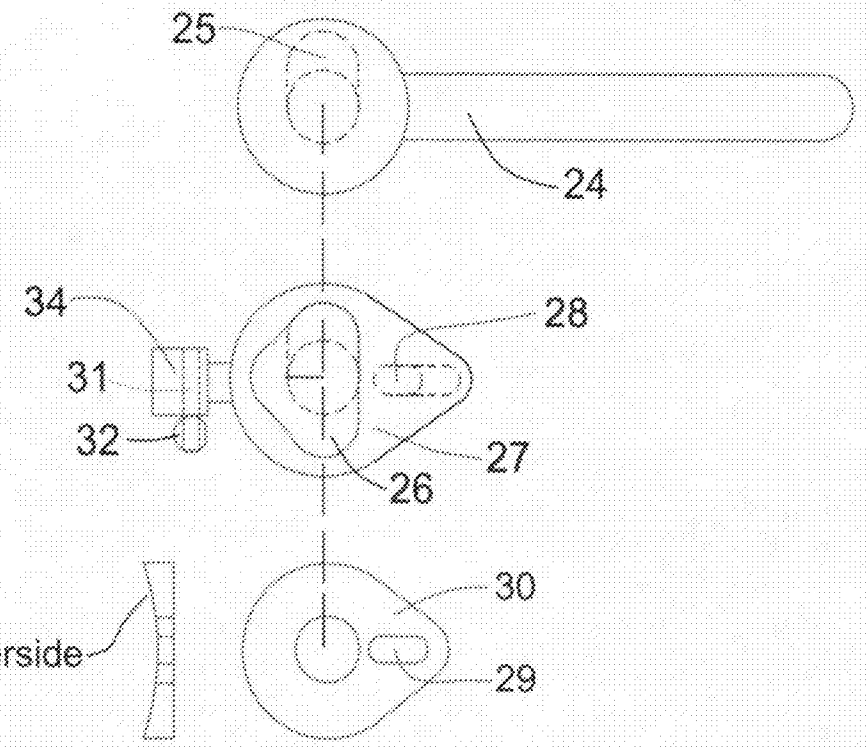
FIG. 62: Exploded-view of the Anti-Rotation Mechanism, that enables the device to be operated in a direct-drive, non-ratcheting mode, includes Pivoting Stabilizer Lever 24 with Cam 25 on its underside, that rotates in Triangular Slot 26 of slideable Follower Frame 27 with Extension 34, Follower 31, Anti-Rotation Post 32. Saddle 30 has curved underside, a Straight Slot 29 and a centered opening to receive fastening hardware not shown.
Figure 63:
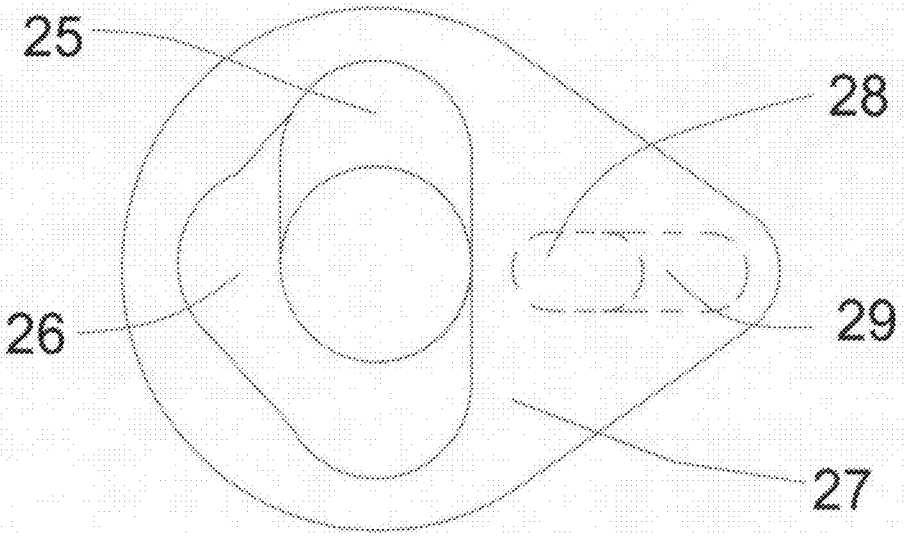
FIG. 63: Cam 25 is in initial position in triangular slot 26, while Knob 28 on underside of Follower Frame 27, is prepared to be guided in straight-slot 29 of Saddle, to cause linear displacement of Follower Frame 27.
Figure 64:
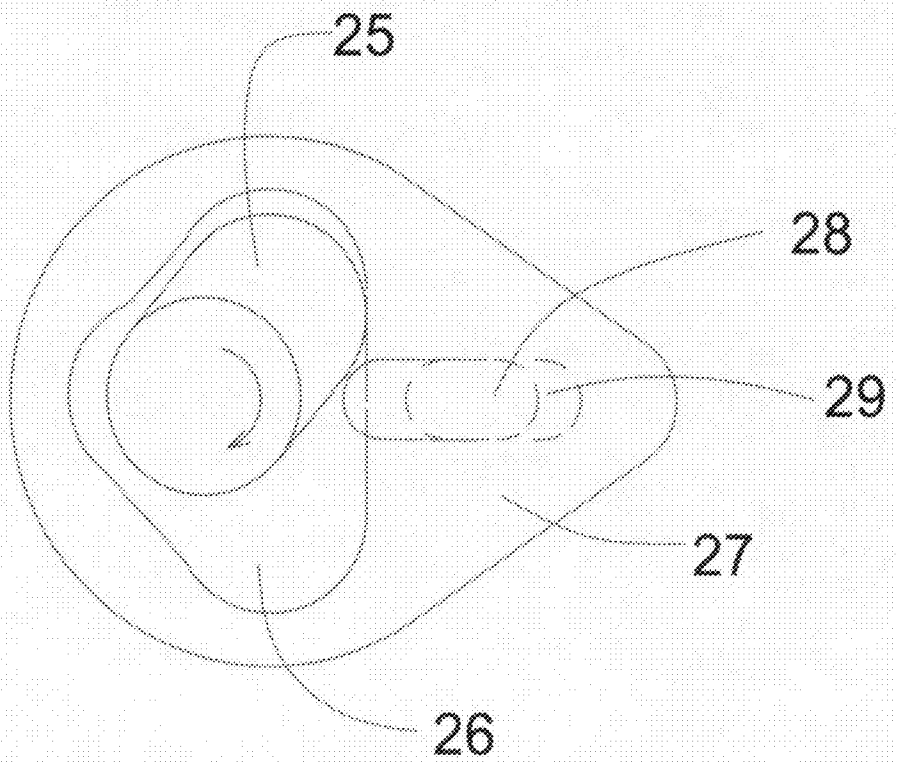
FIG. 64: Cam 25 is partially rotated in triangular slot 26, while Knob 28 on underside of Follower Frame 27, is guided in straight-slot 29 of Saddle, to cause linear displacement of Follower Frame 27.
Figure 65:
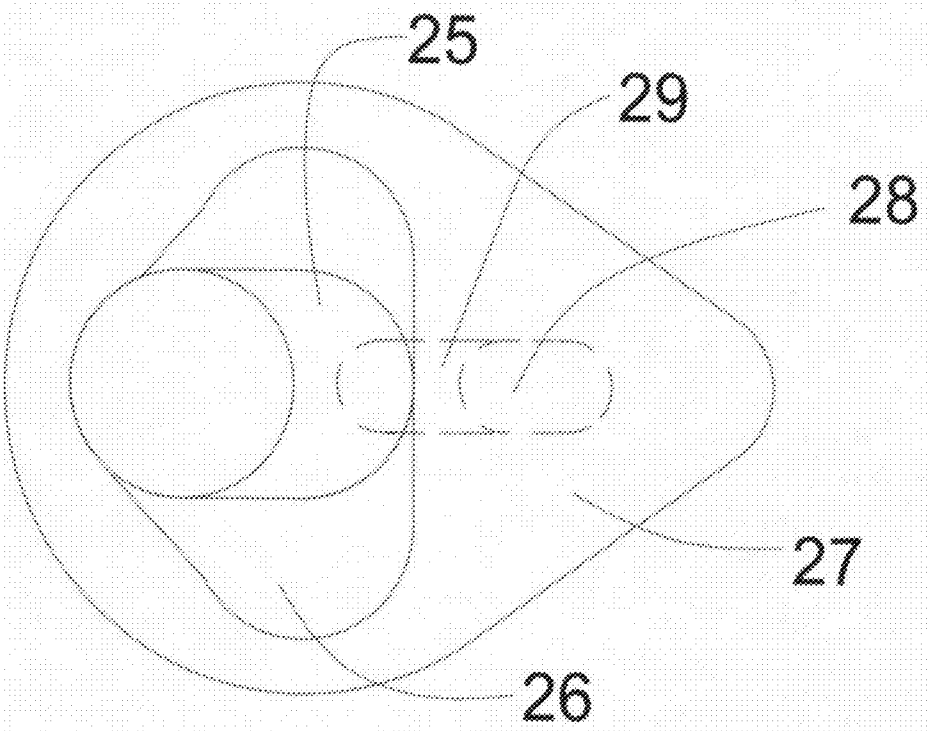
FIG. 65: Cam 25 is partially rotated further in triangular slot 26, while Knob 28 on underside of Follower Frame 27, is guided in straight-slot 29 of Saddle, to cause linear displacement of Follower Frame 27
Figure 66:
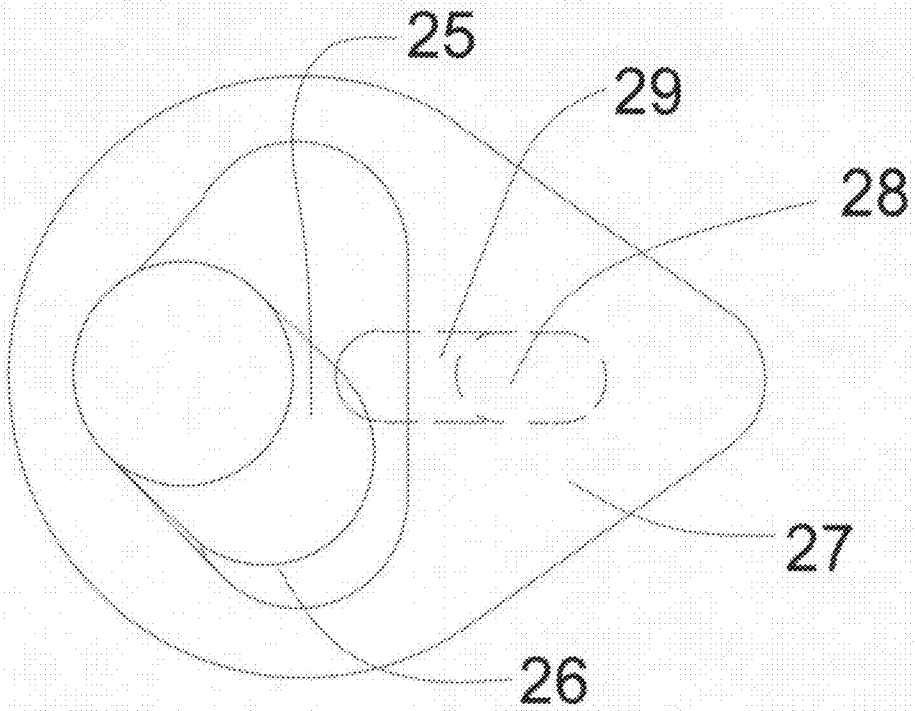
FIG. 66: Cam 25 is partially rotated further in triangular slot 26, while Knob 28 on underside of Follower Frame 27, is guided in straight-slot 29 of Saddle, to cause linear displacement of Follower Frame 27
Figure 67:
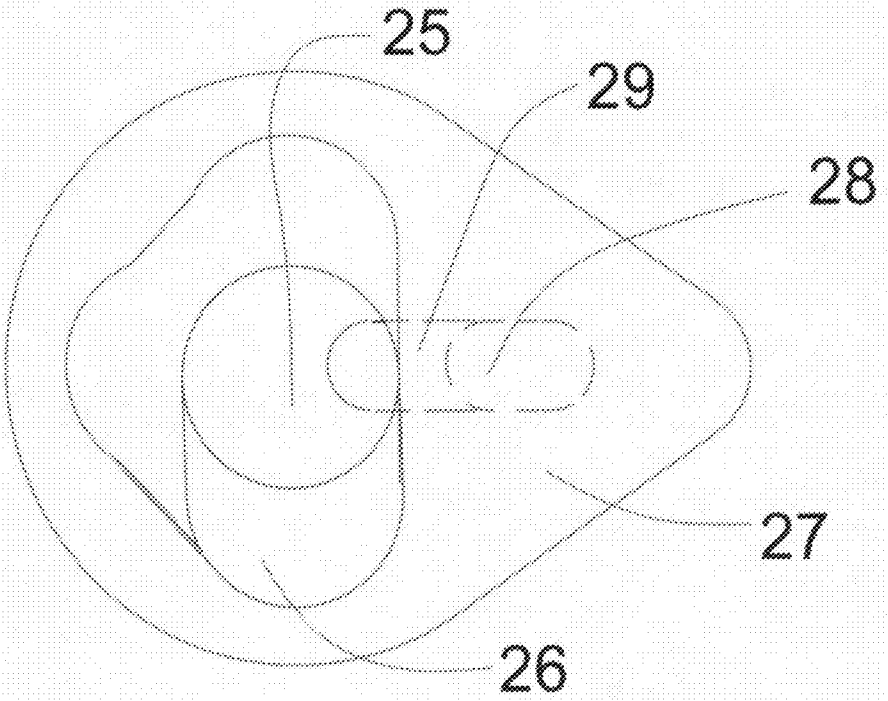
FIG. 67: Cam 25 is rotated 180-degrees from initial position in triangular slot 26, while Knob 28 on underside of Follower Frame 27, is guided in straight-slot 29 of Saddle, to cause full linear displacement of Follower Frame 27.
Figure 68:
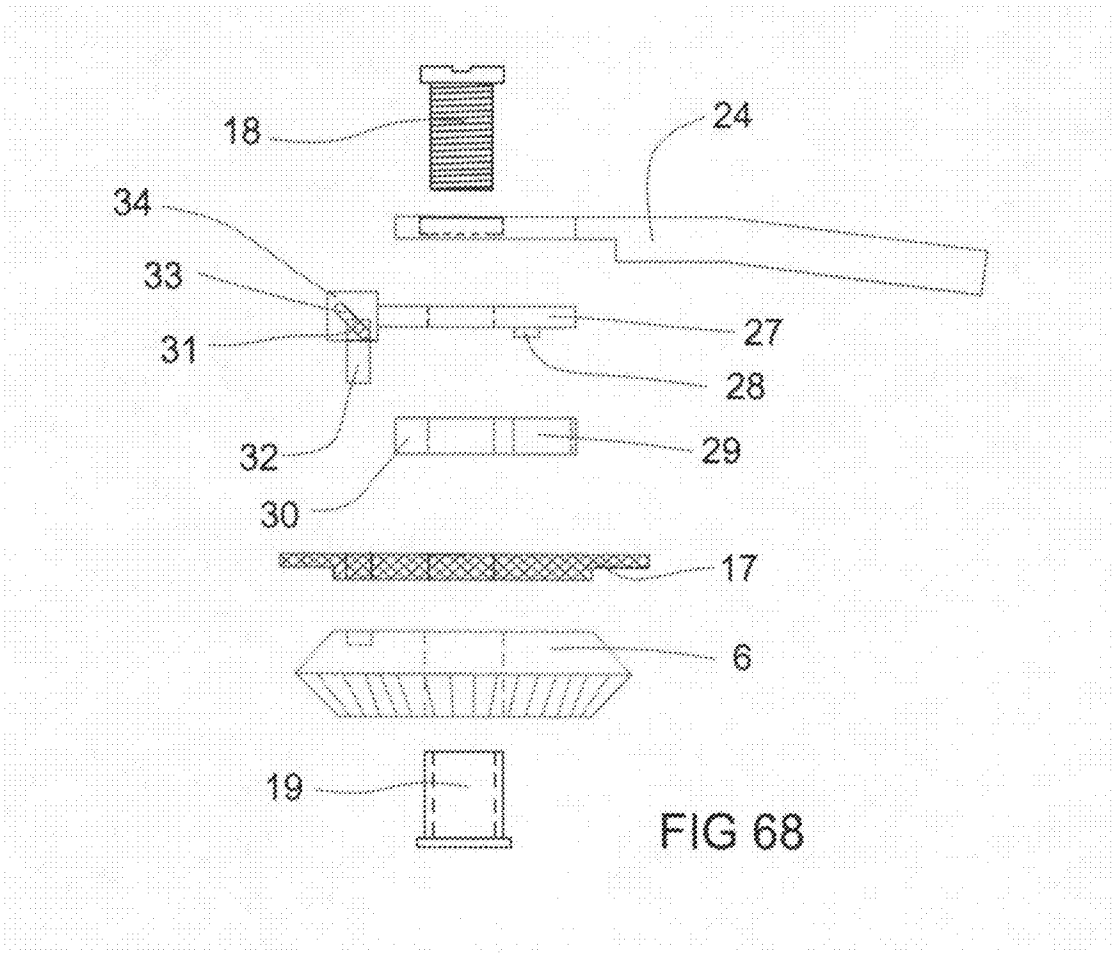
FIG. 68: Exploded view of the components of the Anti-Rotation Mechanism, in correct order for assembly. Axle Component 18, Pivoting Stabilizer Lever 24, Follower Frame (Extension 34, Angled Slot 33, Follower Pin 31, Anti-Rotation Post 32, Knob 28), Saddle 30 with Straight Slot 29, Housing 17, Reversing Element 6 and Axle Component 19.
Figure 69:
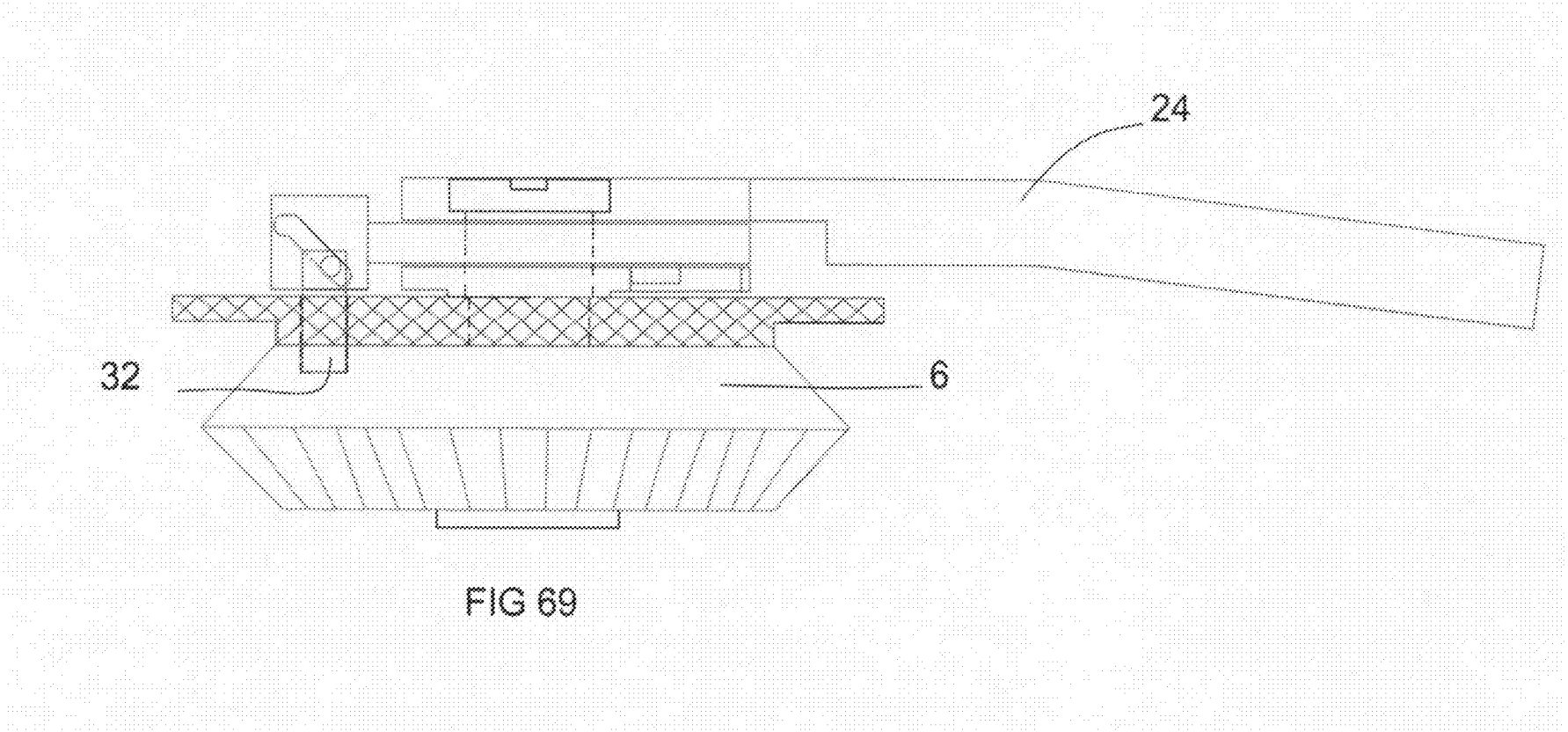
FIG. 69: The Pivoting Stabilizer Lever facing the input end. Anti-Rotation Post 32 is fully inserted into opening in Reversing Element 6, to prevent rotation of Reversing Element 6.
Figure 70:
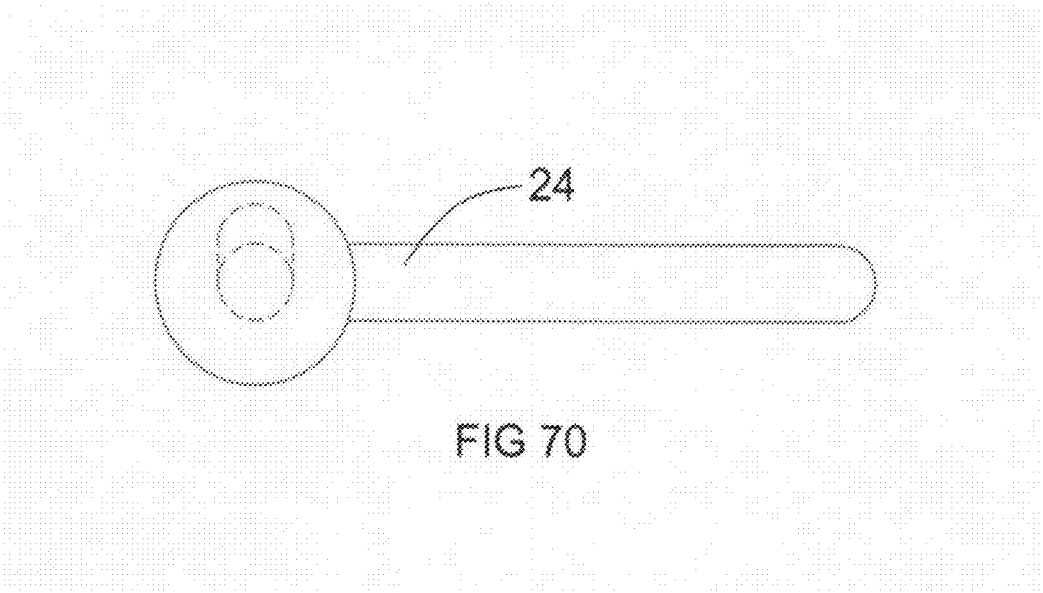
FIG. 70: Top view of the Pivoting Stabilizer Lever 24 facing the input end with Cam 25 on the underside, indicated by dashed lines.
Figure 71:
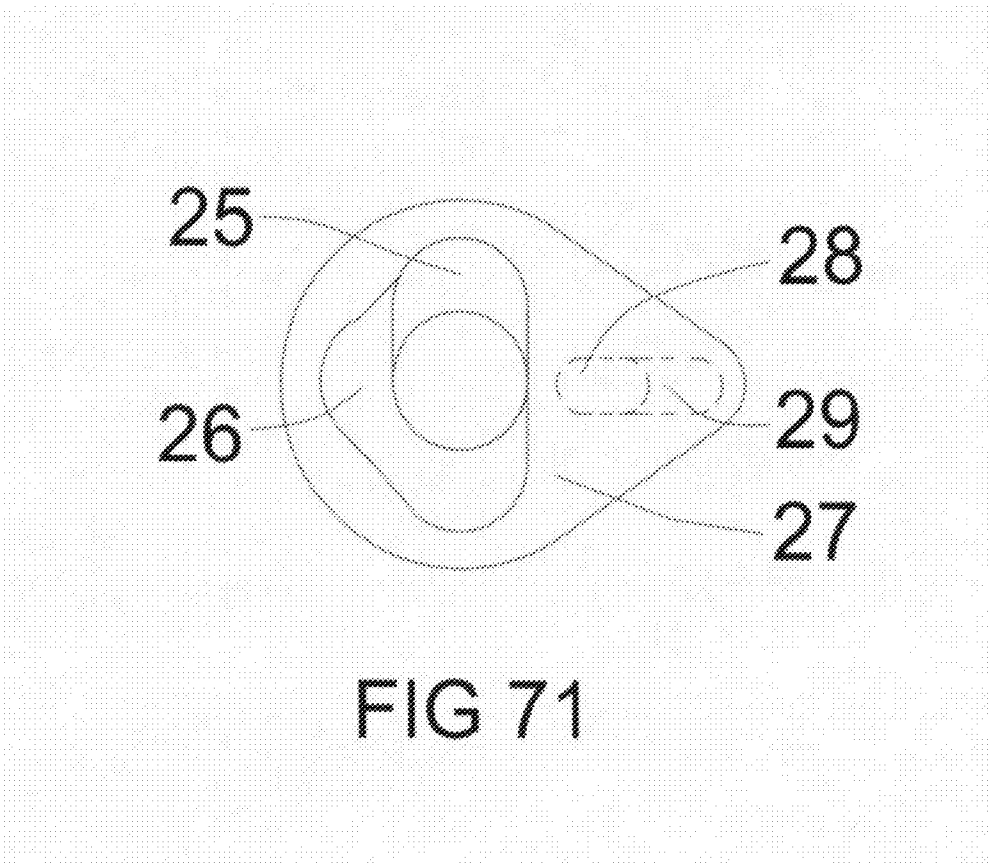
FIG. 71: The position of Follower Frame 27 of FIG. 69.
Figure 72:
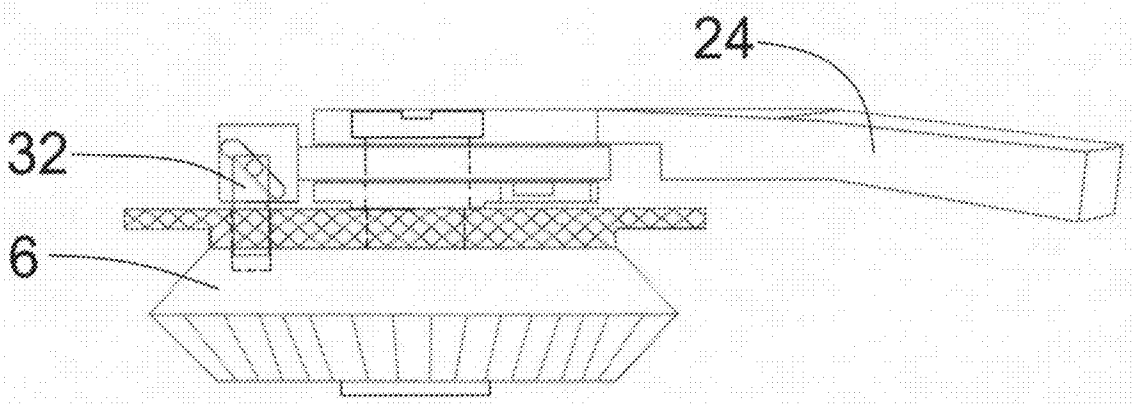
FIG. 72: Side view of the Pivoting Stabilizer Lever partially pivoted, causing Anti-Rotation Post 32 to be partially lifted from the opening in Reversing Element 6.
Figure 73:
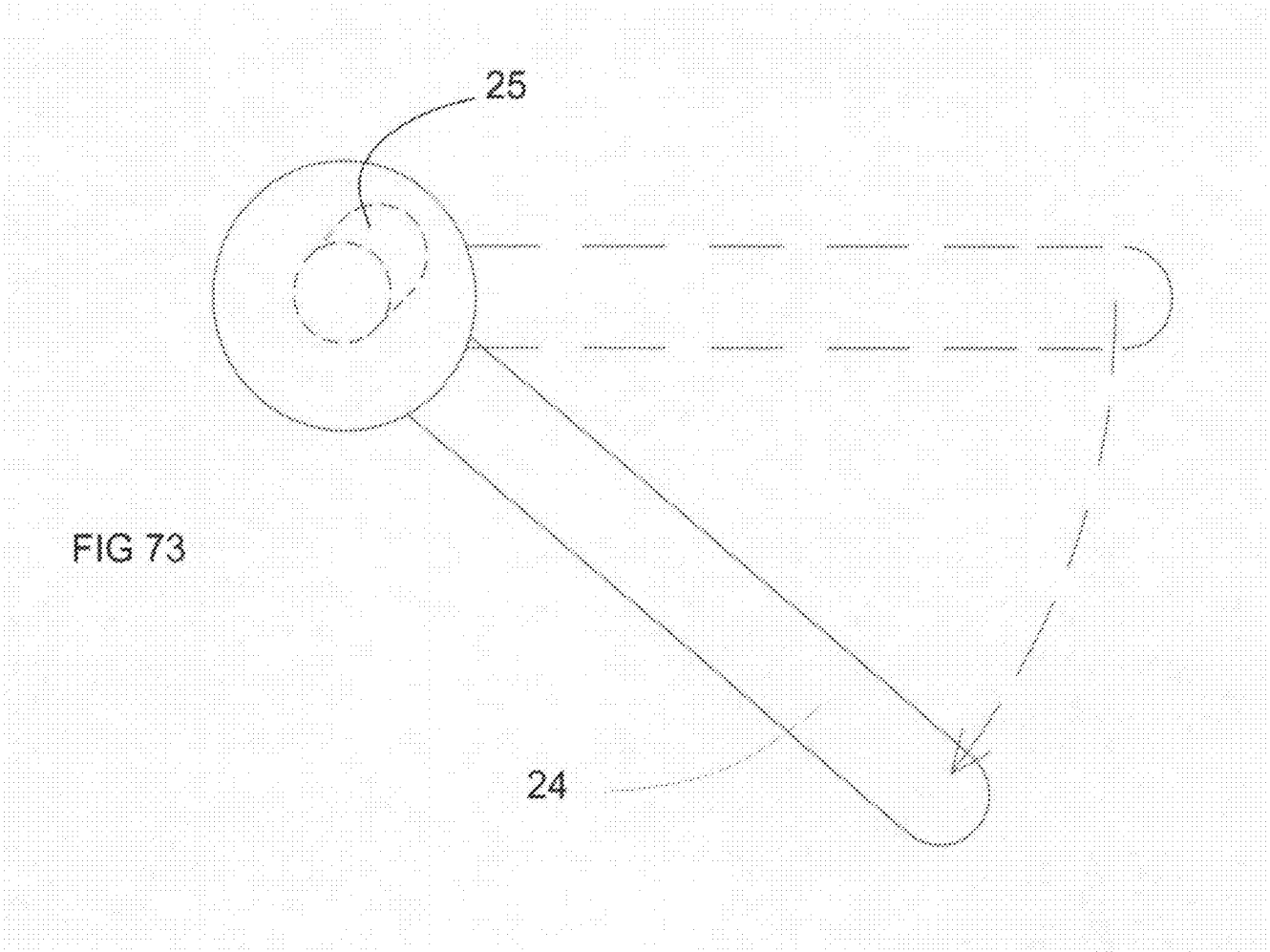
FIG. 73: Top view of the Pivoting Stabilizer Lever partially pivoted.
Figure 74:
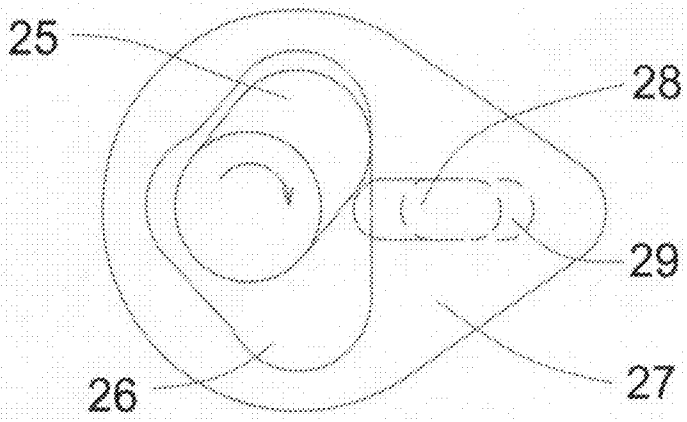
FIG. 74: Follower Frame is slightly displaced, from the partial pivoting of Pivoting Stabilizer Lever.
Figure 75:
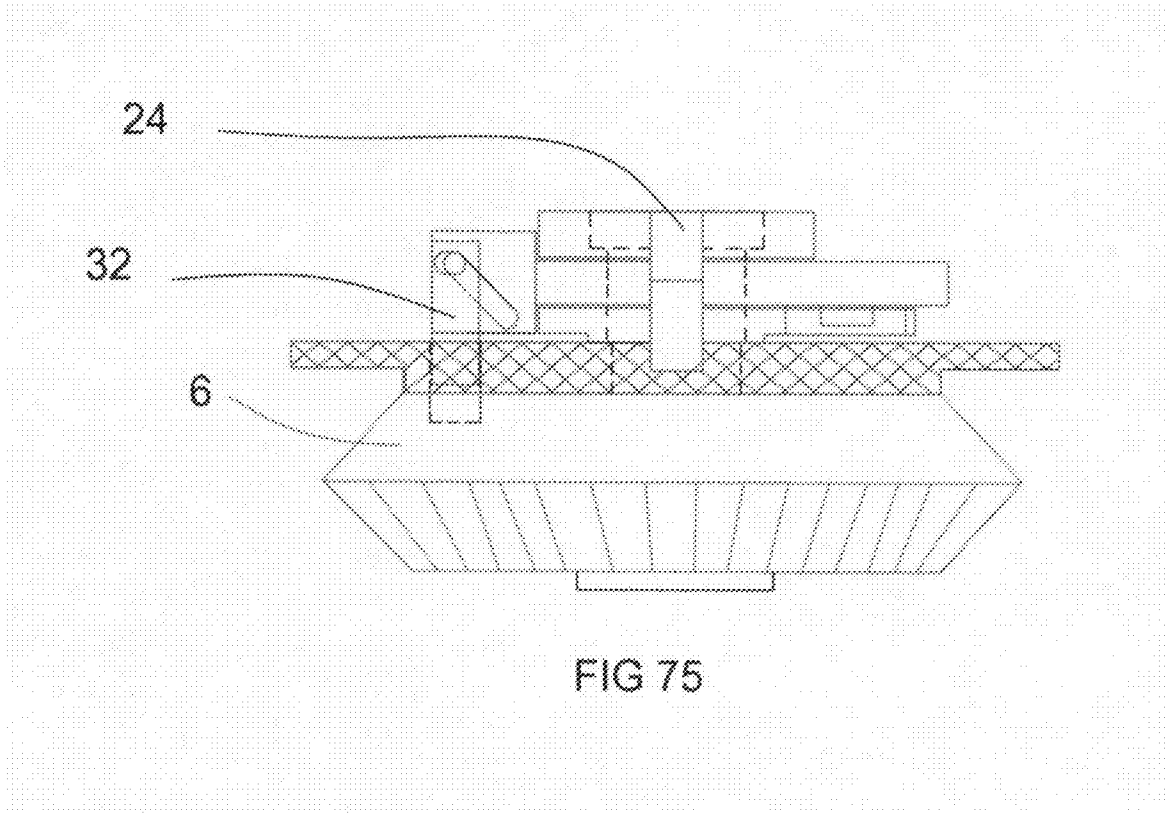
FIG. 75: Side view of Pivoting Stabilizer Lever 24, pivoted to perpendicular position; Anti-Rotation Post 32 is fully disengaged from opening in Reversing Element 6, thereby enabling Reversing Element 6 to rotate.
Figure 76:
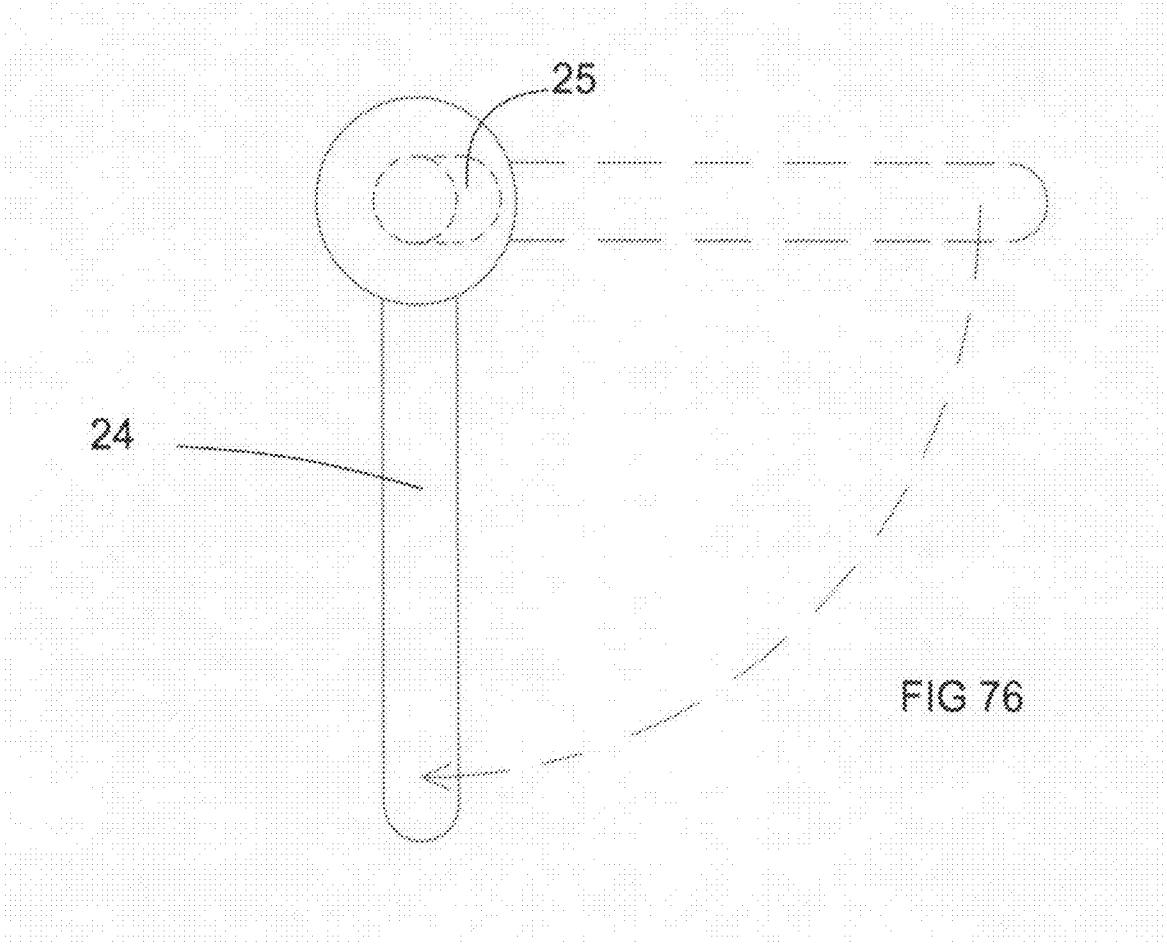
FIG. 76: Top view of the Pivoting Stabilizer Lever 24, pivoted 90 degrees, to disengage Anti-Rotation Post 32, to enable rotation of Reversing Element and activation of dual-drive mechanism. Cam 25 is shown with dashed lines to indicate its location on the underside.
Figure 77:
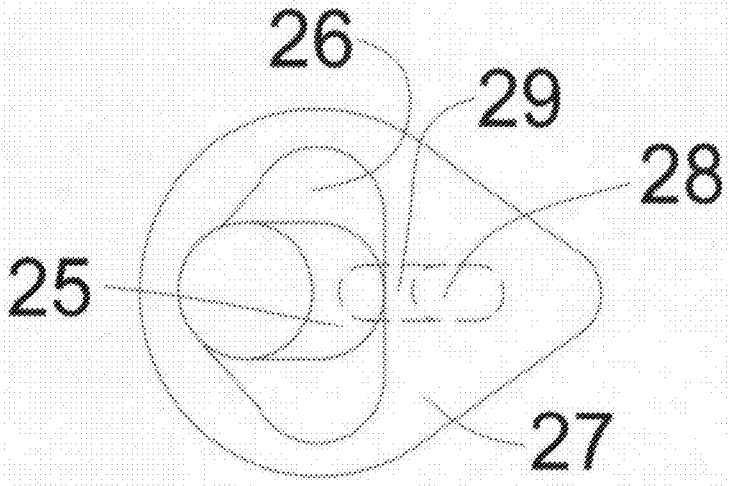
FIG. 77: Follower Frame is displaced fully forward.
Figure 78:
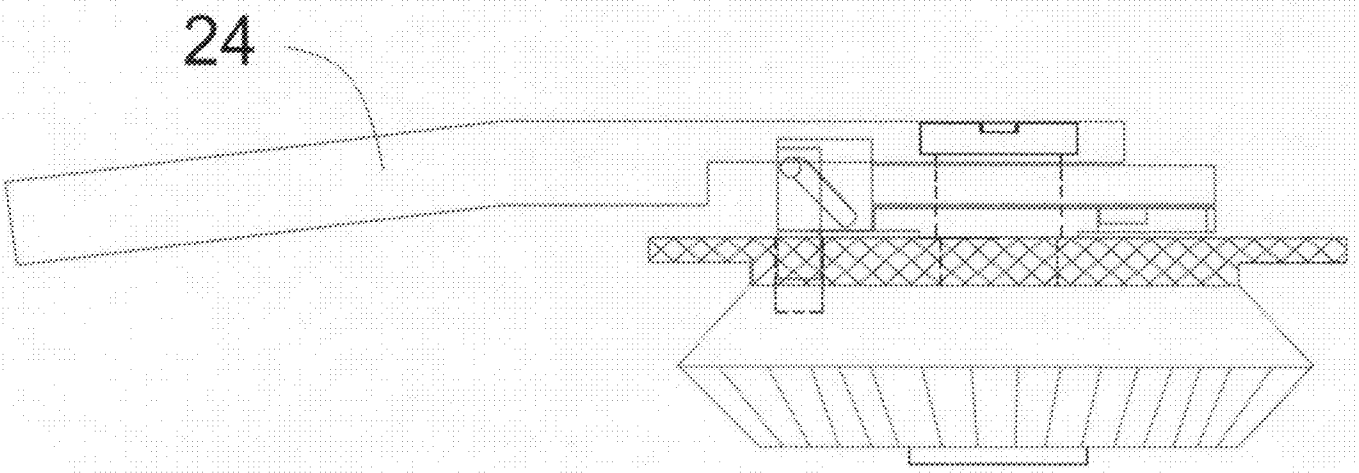
FIG. 78: Pivoting Stabilizer Lever 24 facing output end, 180-degrees from original position, for standard driving mode.
Figure 79:
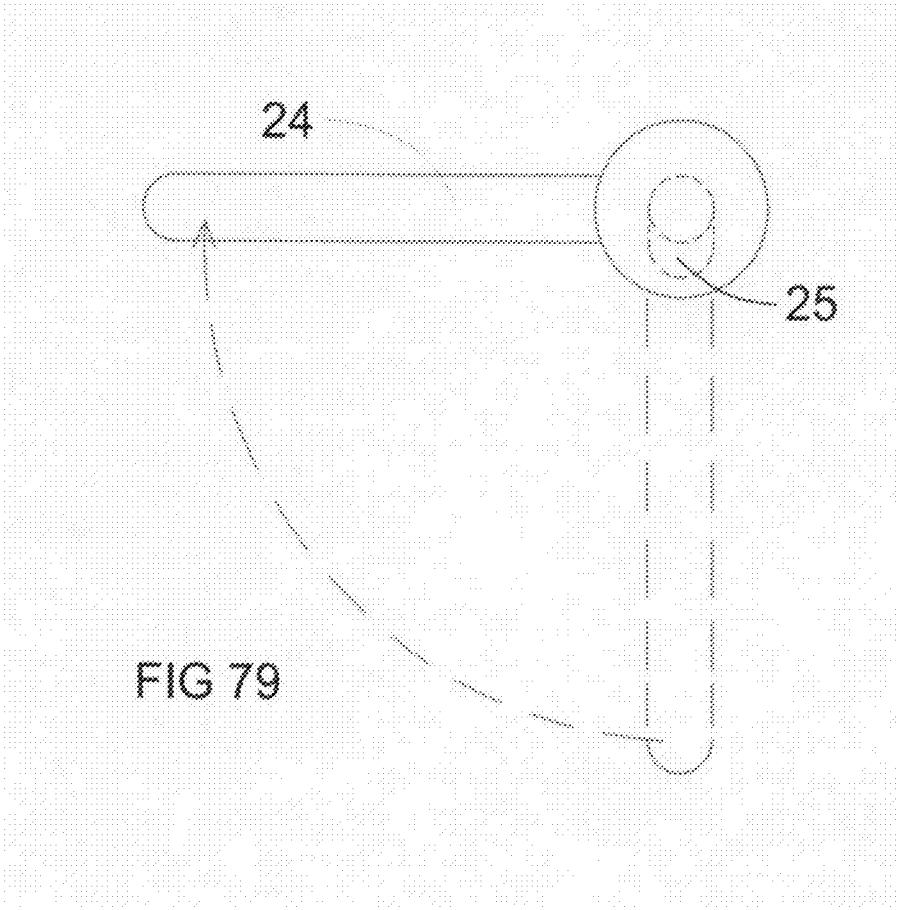
FIG. 79: Top view of Pivoting Stabilizer Lever 24, pivoted to 180-degrees from original position in FIG. 70, to face output-end for standard driving mode.
Figure 80:
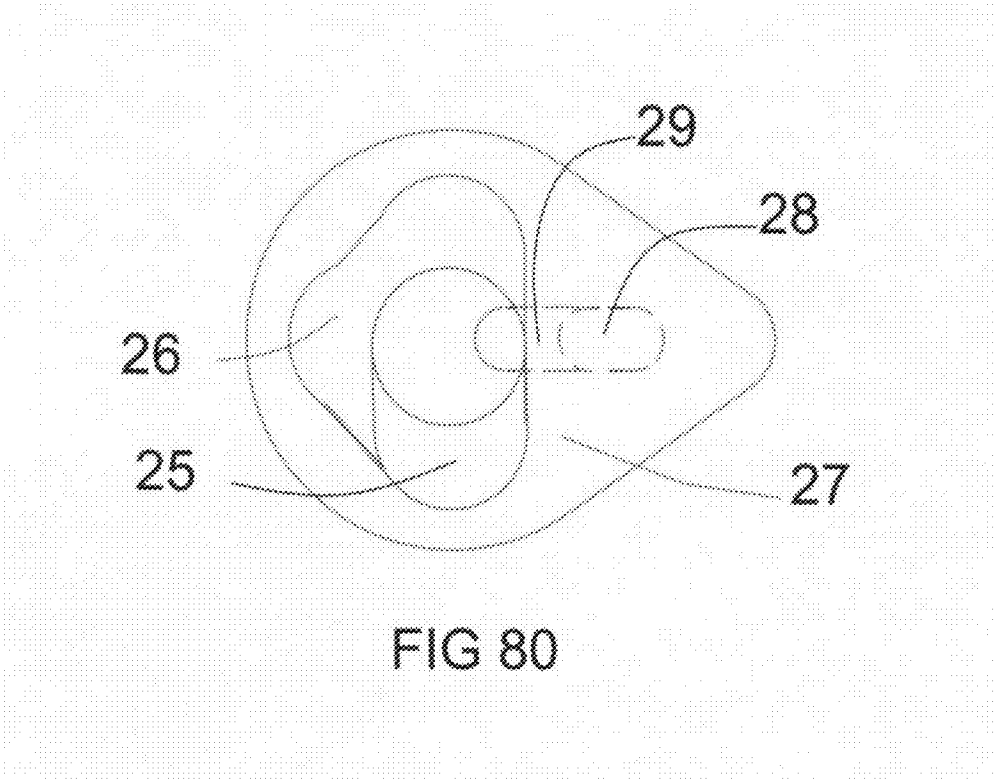
FIG. 80: Top view of Follower Frame displaced fully-forward, caused by Pivoting Stabilizer Lever, pivoted to face output end.
Figure 81:
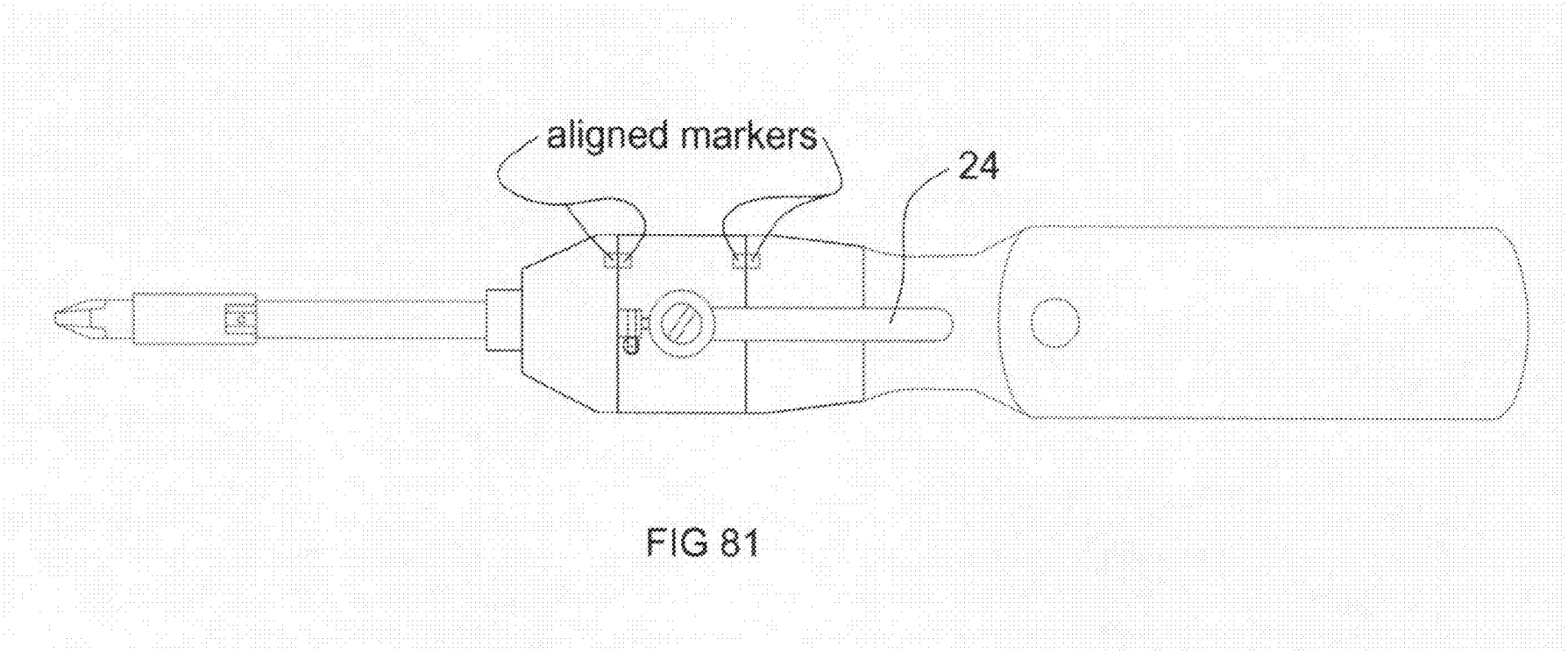
FIG. 81: Visual surface markers must be aligned, for the Anti-Rotation Post 32 to be lowered into opening provided in hub-side of Reversing Element 6, to prevent Reversing Element 6 from rotating.
Figure 82:
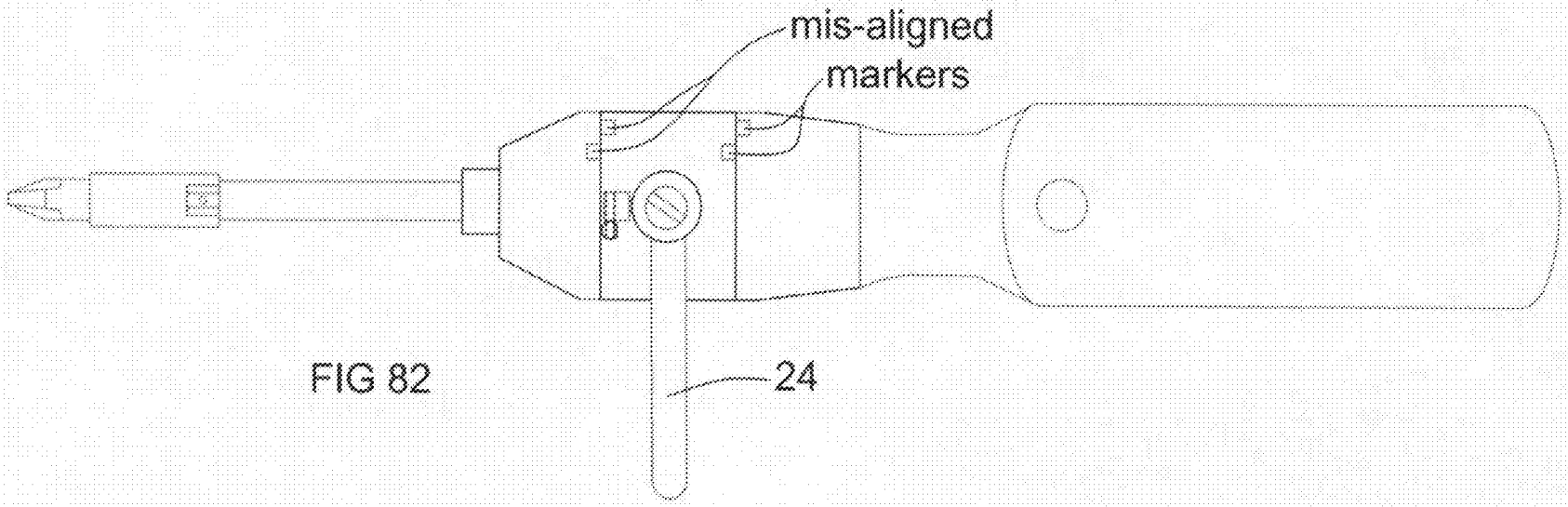
FIG. 82: Misaligned visual surface markers of FIG. 81, with the Pivoting Stabilizer Lever in perpendicular position, indicate the double-drive feature can be activated.
Figure 83:
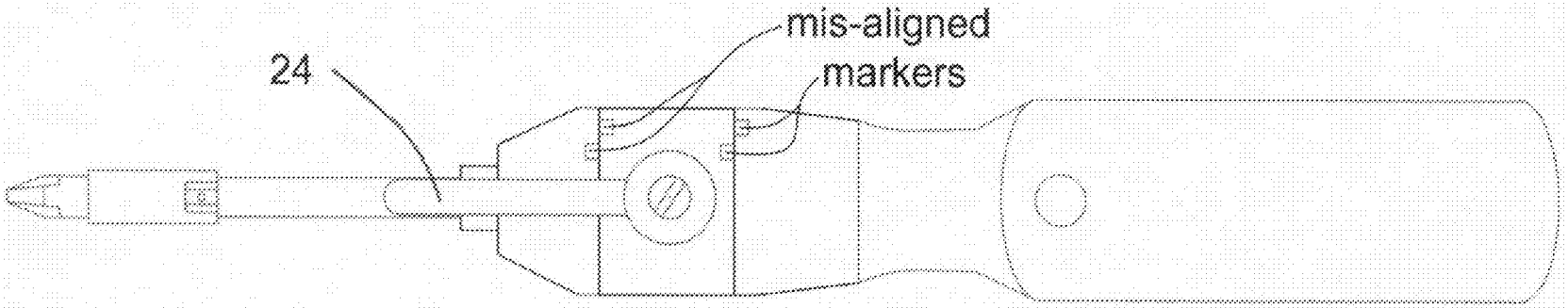
FIG. 83: Misaligned visual surface markers, with the Pivoting Stabilizer Lever 24, facing the output end, indicate the double-drive feature can be activated and can be employed as a conventional ratchet.
Figure 84:
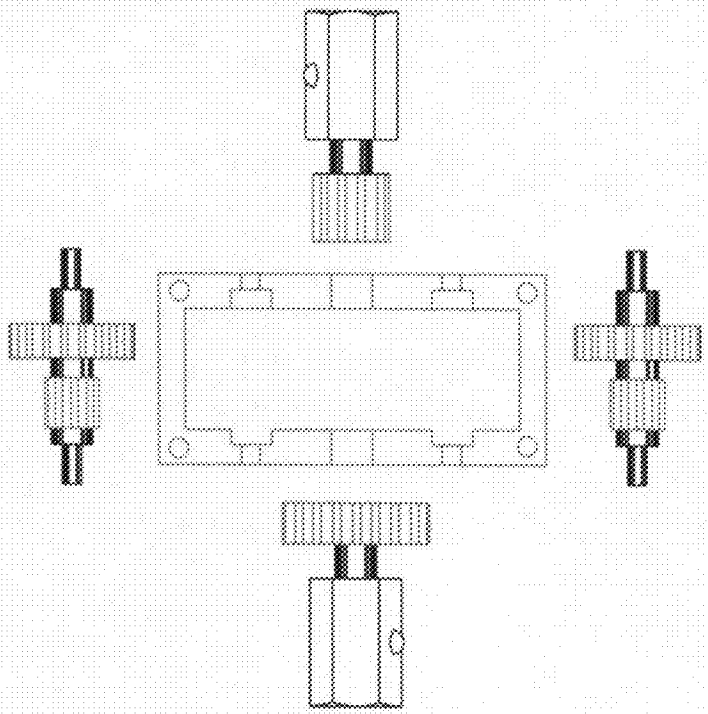
FIG. 84: Exploded-view of the gearing arrangement of an invertible step-up and step-down transmission attachment and its lower-half housing.
Figure 85:
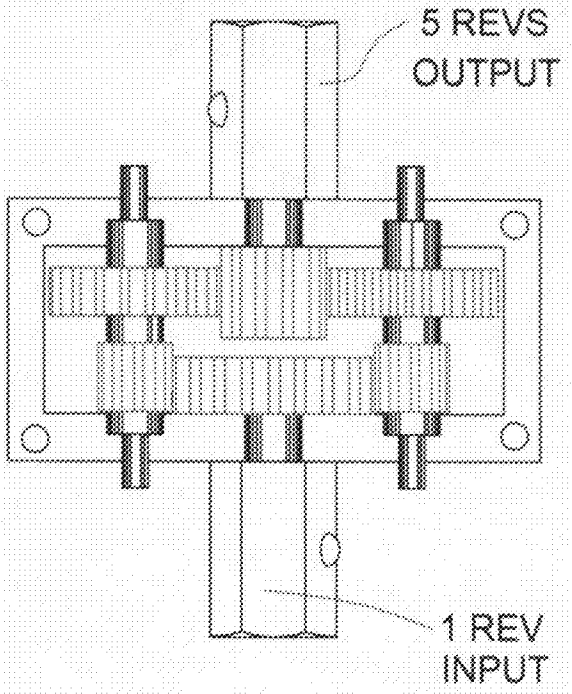
FIG. 85: Internal view of a gearing arrangement of a transmission in step-up orientation, nested in its lower-half housing. Numerous step-up ratios are possible; this arrangement produces 5 revolutions at the output. from one revolution of the input.
Figure 86:
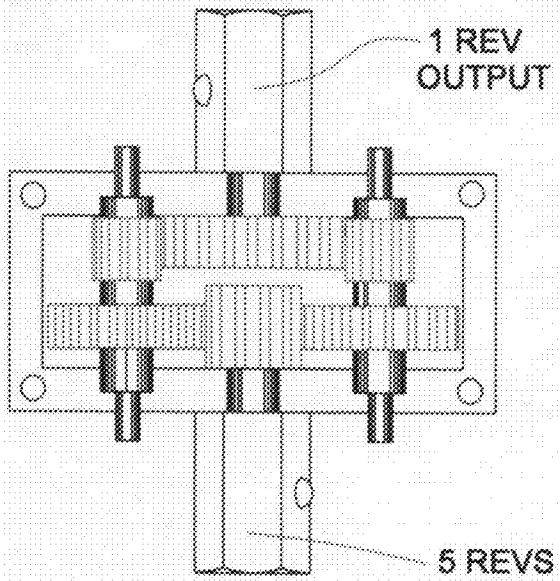
FIG. 86: View of the inverted gearing arrangement of the transmission of FIG. 85, for step-down; 5 revolutions of the input, causes 1 revolution at the output, for high torque requirements.
Figure 87:
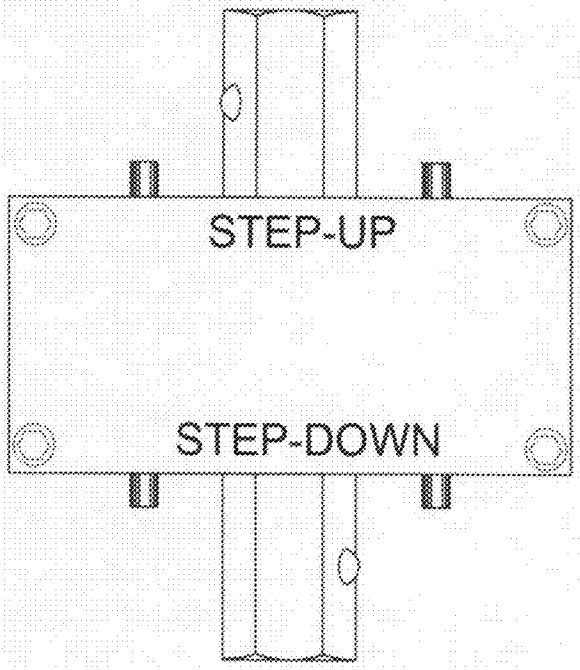
FIG. 87: Assembled step-up and step-down invertible transmission attachment, with cover installed with fastening hardware.
Figure 88:
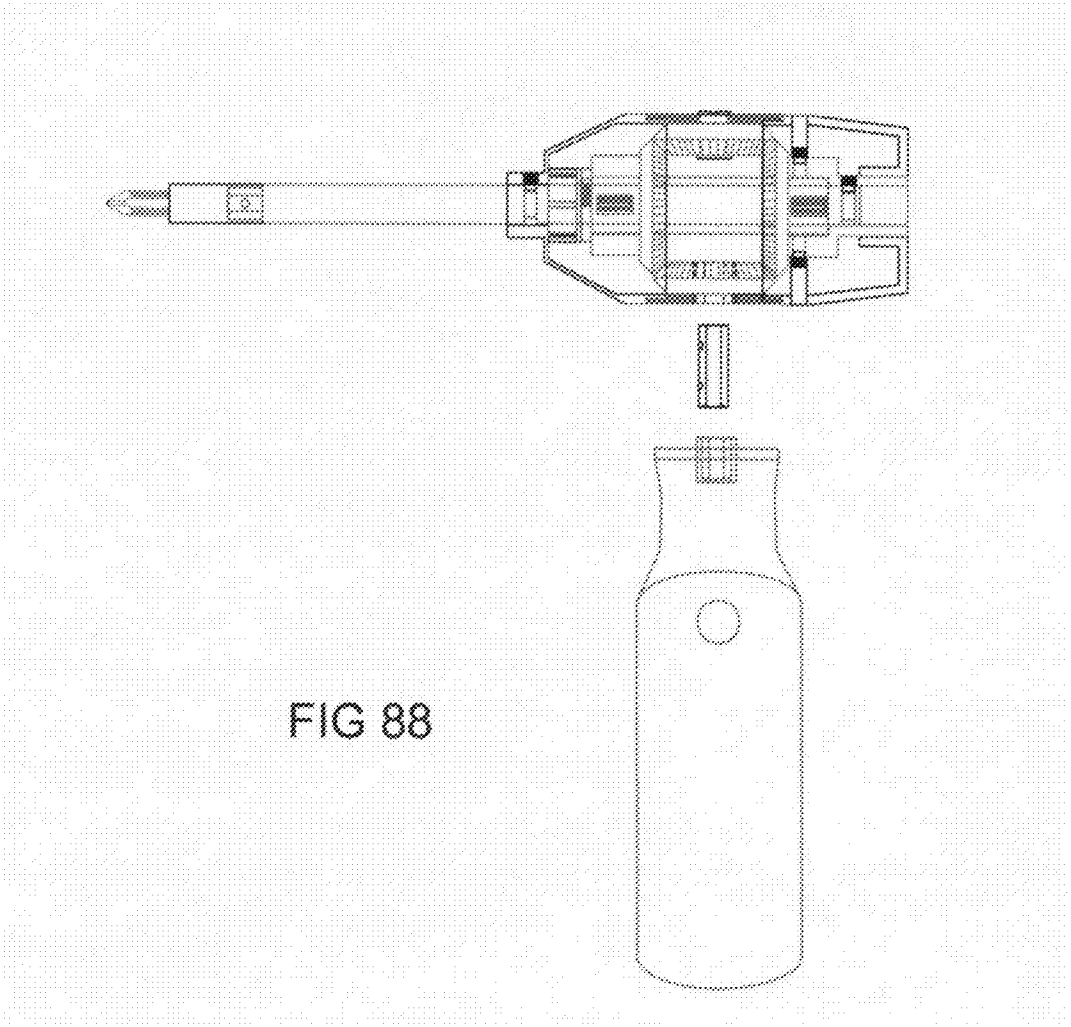
FIG. 88: Adapter with a spring-loaded ball retainer installed at each end, is prepared to be attached to couple the Detachable Adjustable Handle 1 to a Reversing Element, for right-angle driving.
Figure 89:
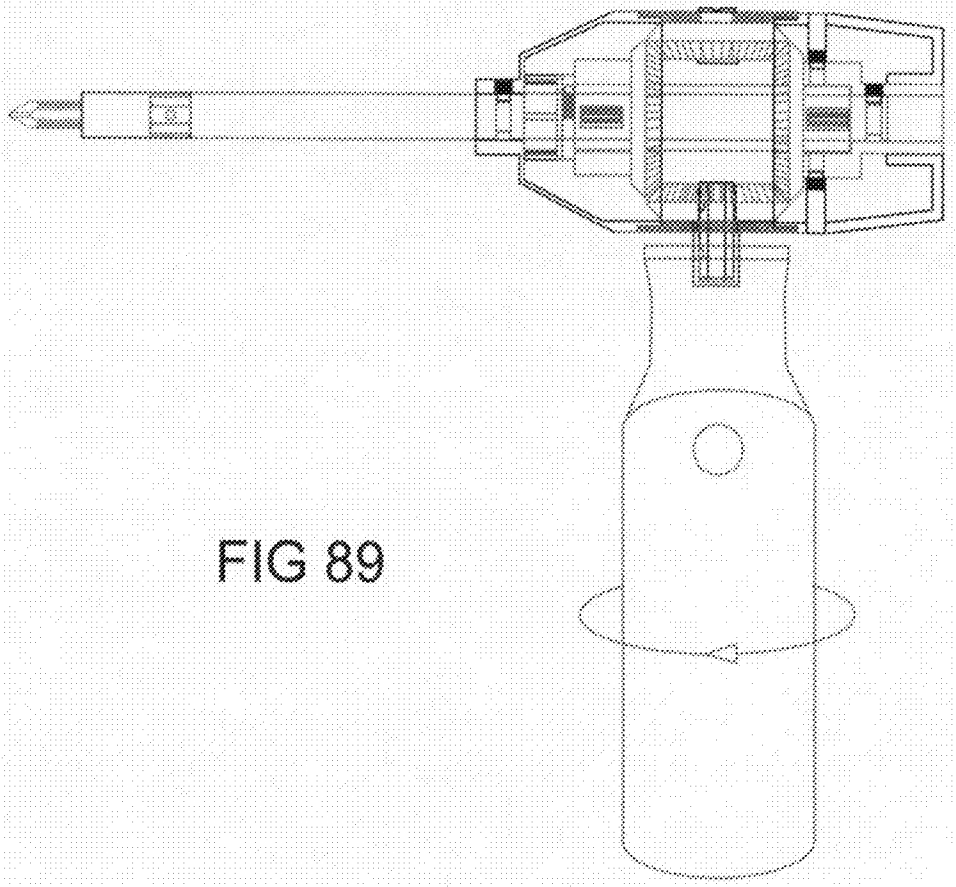
FIG. 89: Adapter with a spring-loaded ball retainer installed at each end, is coupled to retain Detachable Adjustable Handle 1 for right-angle driving.
Figure 90:
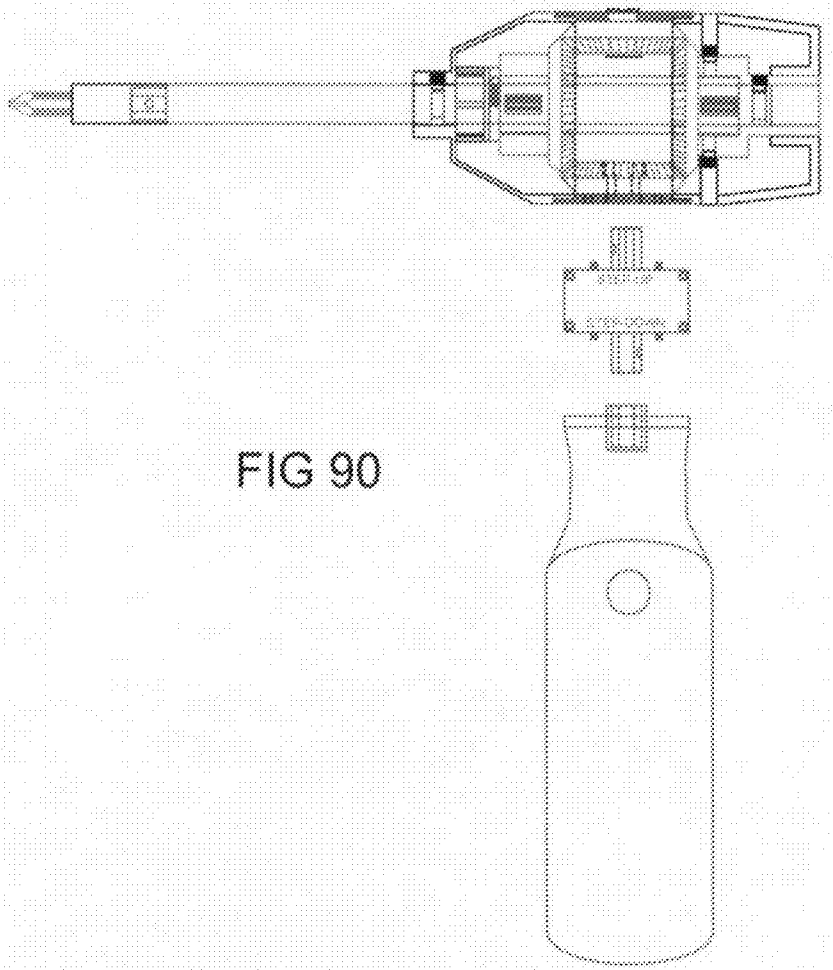
FIG. 90: The step-up end of the step-up and step-down transmission, is prepared to be attached to a Reversing Element.
Figure 91:
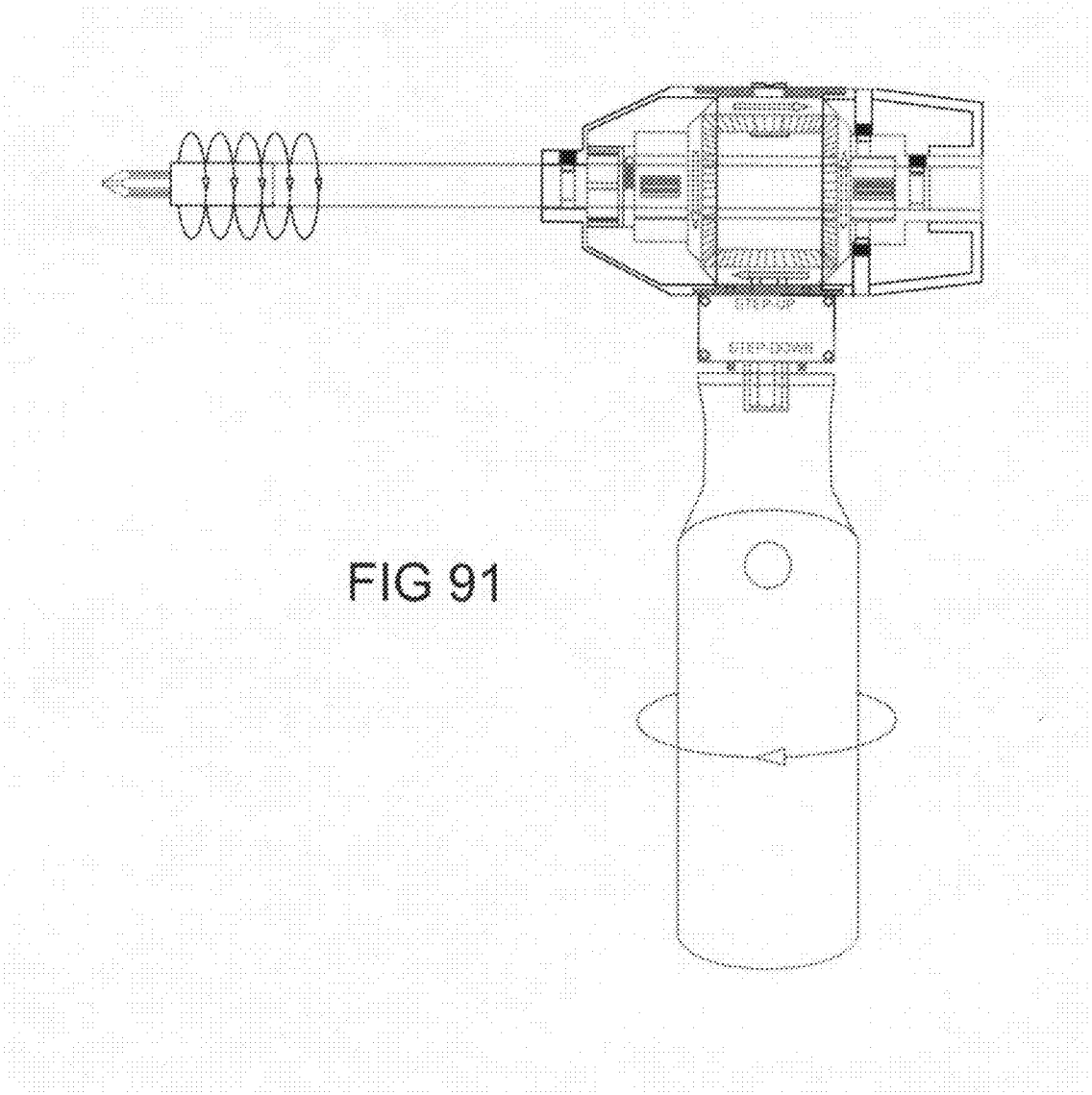
FIG. 91: The step-up end of the step-up and step-down transmission, is coupled to a Reversing Element. One revolution applied to Detachable Adjustable Handle 1, causes 5 revolutions of Reversing Element for a right-angle drive.
Figure 92:
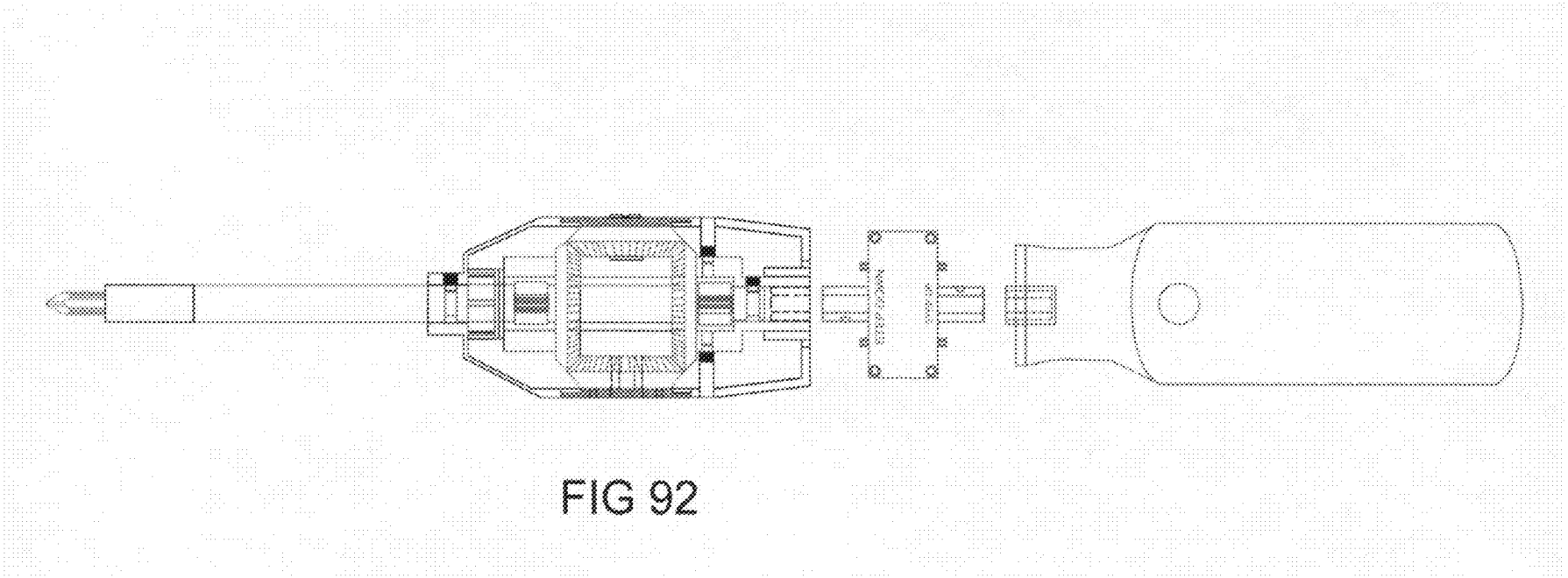
FIG. 92: The step-down end of the step-up and step-down transmission, is prepared to be coupled to Driving Element 2.
Figure 93:
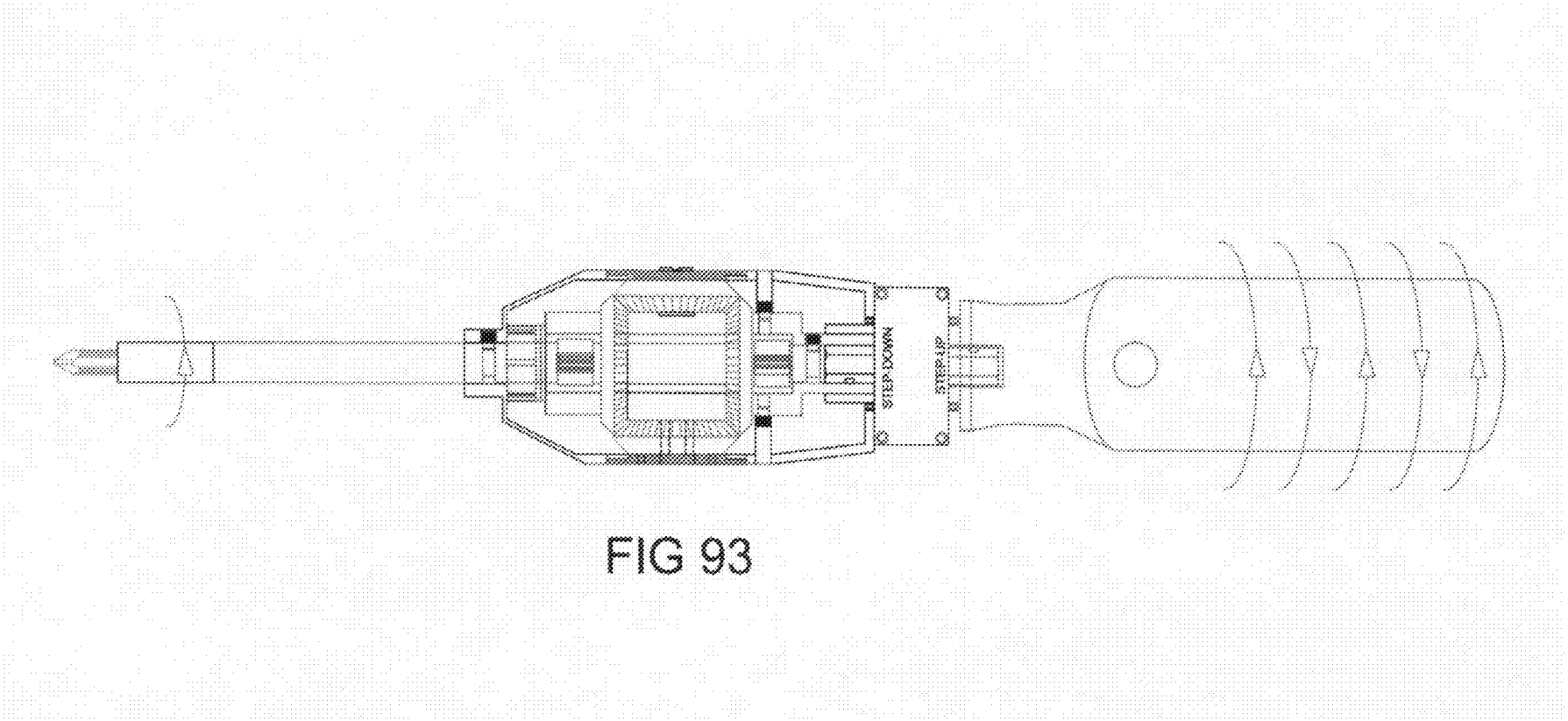
FIG. 93: For increased torque to finish-tightening a fastening hardware, the step-down end of the step-up and step-down transmission, is coupled to First Driving Element 2. Five alternating 180-degree turns of Detachable Adjustable Handle 1, causes ½ rotation at the output. Device shown, is set to clockwise output mode.
Figure 94:
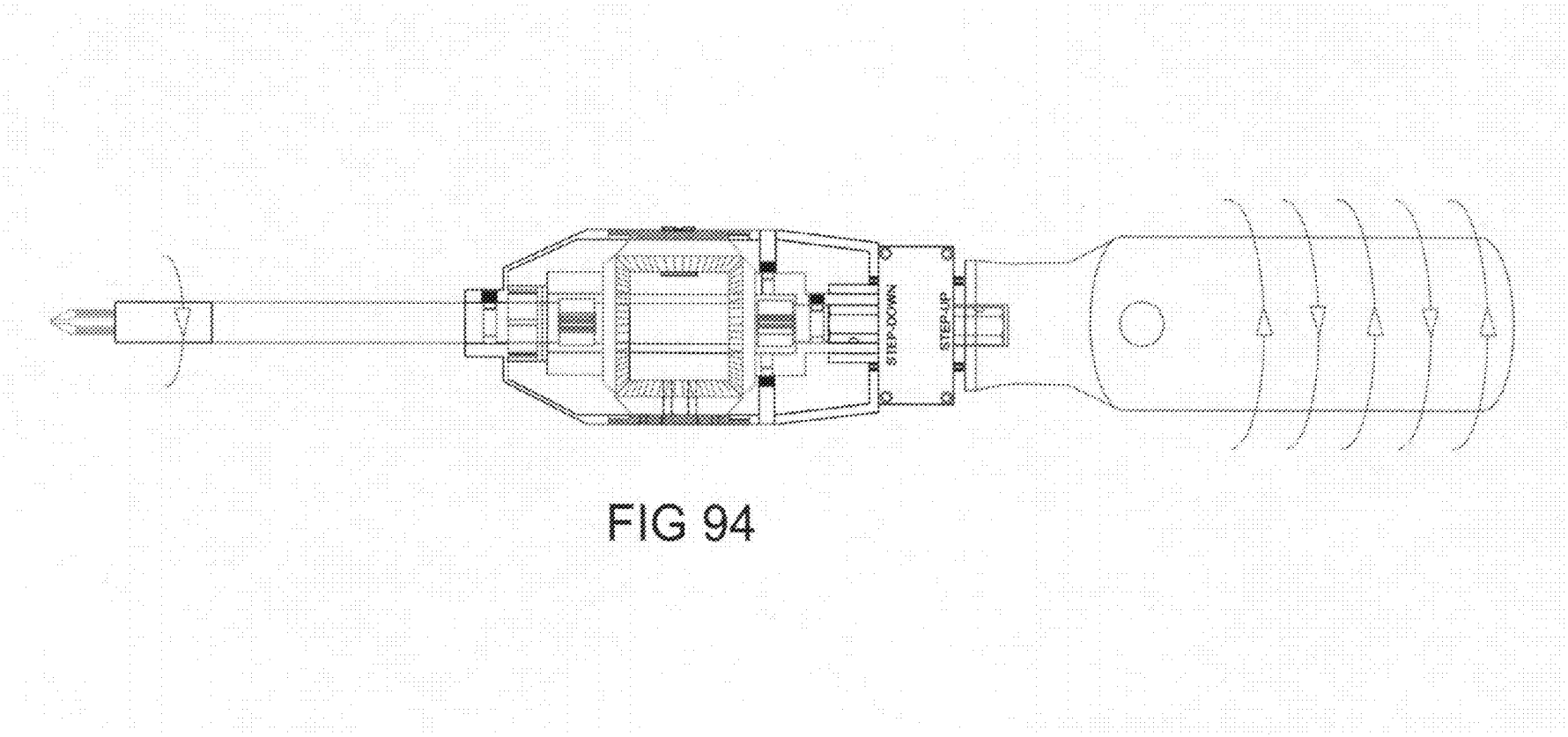
FIG. 94: For increased torque to finish-tightening a fastening hardware, the step-down end of the step-up and step-down transmission, is coupled to First Driving Element 2. Five alternating 180-degree turns of Detachable Adjustable Handle 1, causes ½ rotation at the output. Device shown, is set to counterclockwise output mode.
Figure 95:
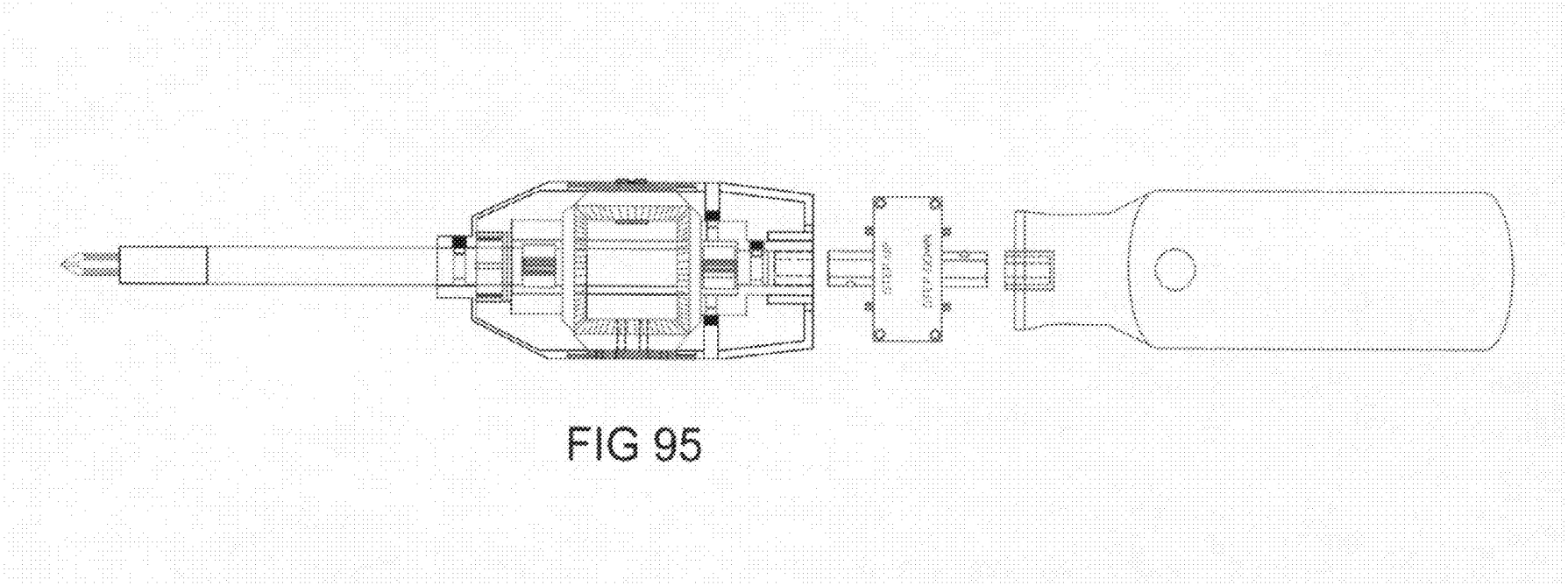
FIG. 95: The step-up end of the step-up and step-down transmission, is prepared to be coupled to the First Driving Element 2.
Figure 96:
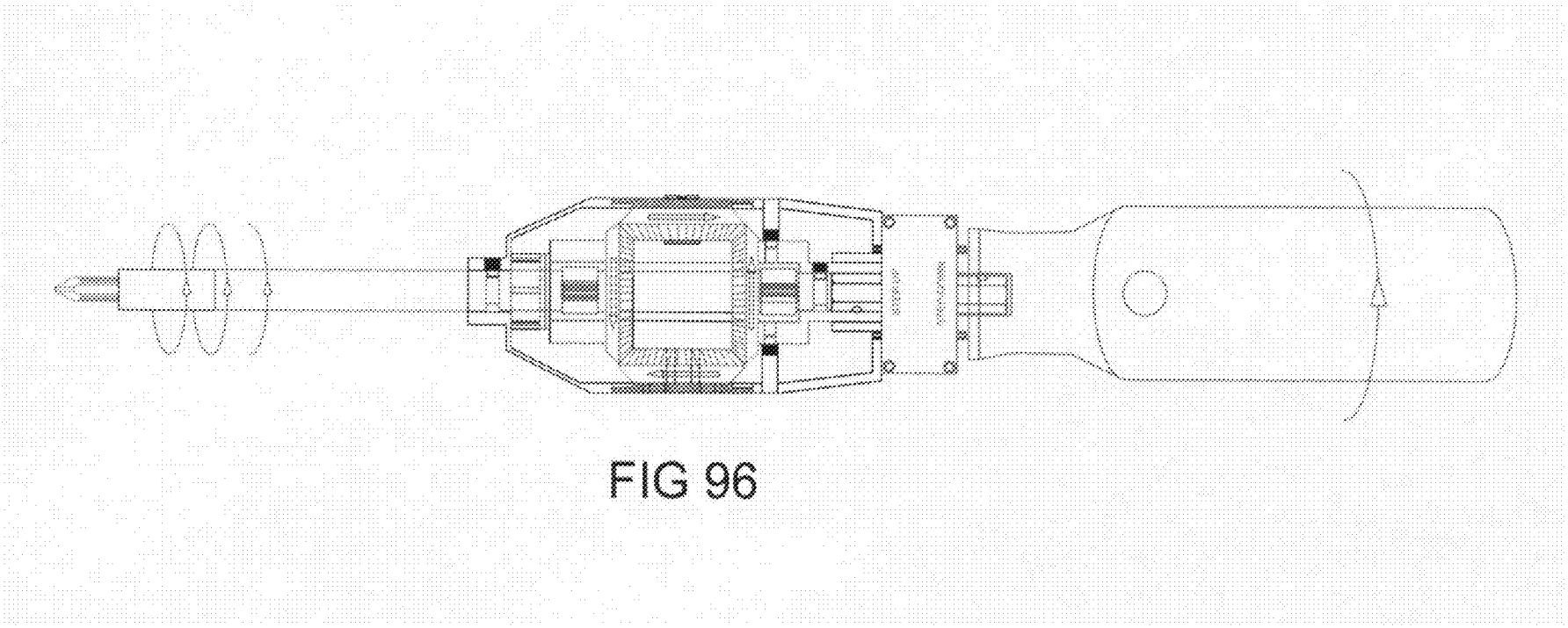
FIG. 96: The step-up end of the step-up and step-down transmission, is coupled to the First Driving Element 2. ½ clockwise revolution applied to the Detachable Adjustable Handle 1, produces 2½ clockwise revolutions at the output.
Figure 97:
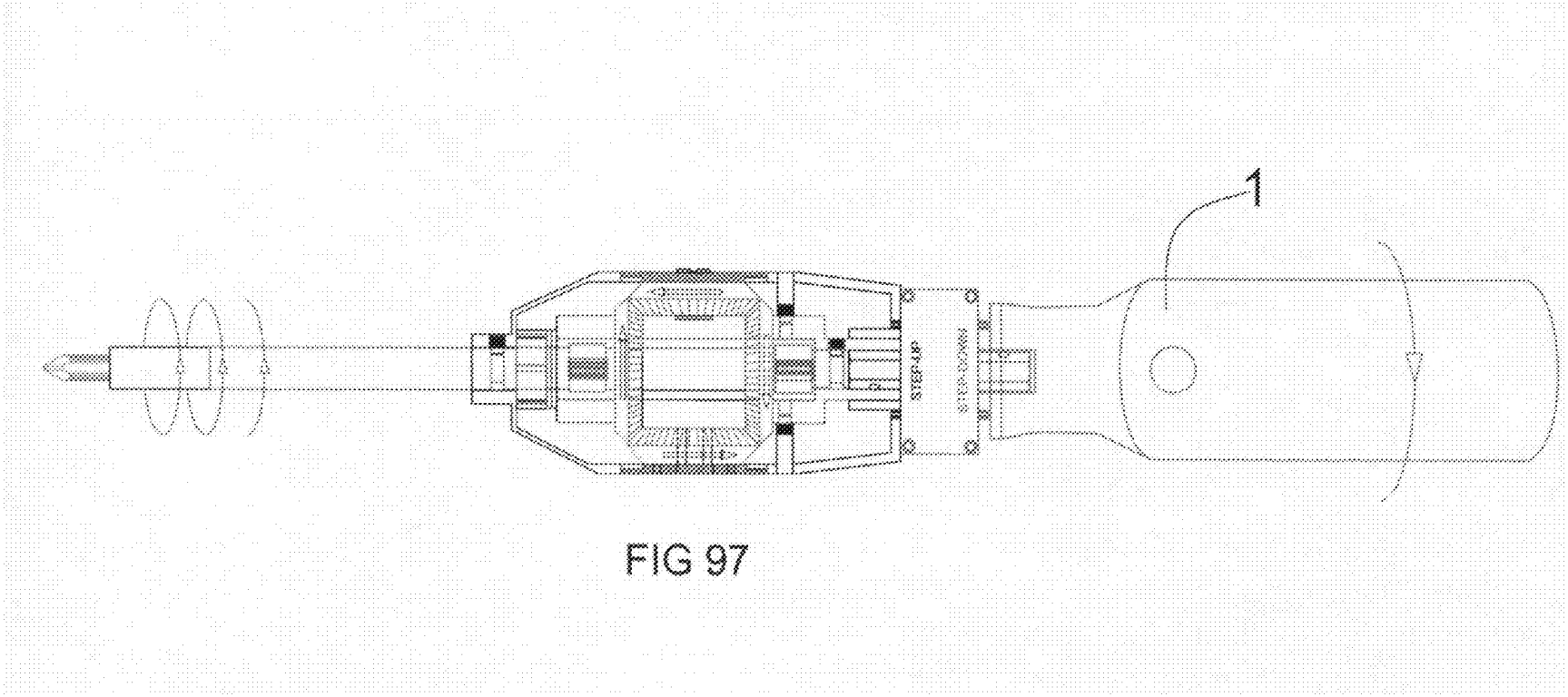
FIG. 97: For increased speed for driving a fastener, the step-up end of the step-up and step-down transmission, is coupled to the First Driving Element 2. One half counter-clockwise revolution applied to the Detachable Adjustable Handle 1, produces 2½ clockwise revolutions at the output.

In FIG. 57, right-angle drive, with the dual-drive mechanism secured into clockwise shaft-rotation mode, Driving Element 1B of Detachable Adjustable Handle 1, is coupled to Second Rotating Element of Reversing Mechanism. Detachable Adjustable Handle 1 is turned axially counterclockwise to cause the same component rotation as described in FIG. 55.

While the description contains many specificities, these must not be construed as limitations on the scope of the invention, but rather as an exemplification of a general configuration thereof. Numerous alternative arrangements of identical and/or equivalent mechanical components, are possible for producing a clockwise output from an oscillatory input and for producing counter-clockwise output from an oscillatory input, within the same embodiment. Even though the self-ratcheting double-drive mechanism invention has numerous applications such as rotary-operated hand tools, kitchen gadgets, wine accessories, automotive accessories and industrial equipment, the manually-operated ratchet screwdriver is enlisted, not as the invention, but, as an ideal exemplification of an application for the invention, in order to explain the advantages of the mechanism.

What is claimed:

1. A dual drive mechanism configured for a clockwise rotational output mode for converting oscillatory motion applied to an input into a clockwise rotation motion at an output, a counterclockwise rotational output mode for converting oscillatory motion applied to the input into a counterclockwise rotation motion at the output and a direct drive non-ratcheting mode, comprising:

a drive shaft;

a housing mounted on the drive shaft;

a pair of driving elements mounted on said driveshaft within said housing, with each said driving element is coupled to a clutch component engaging the driveshaft so that the driveshaft is entrained in only one direction of axial rotation, when one of the driving elements is rotated in said one direction, while the driveshaft is overrun by the other driving element rotated in the opposite direction;

a reversing mechanism positioned with said housing including a first rotating element defined by a first gear and a second rotating element defined by a second gear coupling the pair of driving elements together and causing them to always rotate in opposite directions, so that one driving element entrains the driveshaft and the other driving element overrides the driveshaft, causing the driveshaft to always rotate axially, in only one direction, regardless of the direction of rotation of the driving elements;

a first input receptacle defining an inline input port disposed coaxially with the shaft enabling rotation of the drive shaft while the housing is held stationary;

a second input receptacle coupled to said at least one gear of the reversing mechanism defining a non-inline input port enabling single-handed rotation of the drive shaft while simultaneously preventing the rotation of the housing;

a detachable handle, for coupling to either the first input receptacle to rotate axially in clockwise and counterclockwise direction, the handle being pivotable for increased torque, or for coupling directly or indirectly to the second input receptacle to rotate axially in clockwise and counterclockwise direction as well as swing radially, in clockwise and counterclockwise direction; and an anti-rotation mechanism including a pivoting stabilizer lever, a slidable follower frame and a saddle with a curved underside, the pivoting stabilizer lever includes a cam at an underside thereof, the slidable follower frame having a triangular slot, an extension, a follower, an anti-rotation post and a knob, and the saddle includes a straight slide and a centered opening, wherein the cam is positioned in the triangular slot with the knob being guided in the straight slot causing a linear displacement of the follower frame, the anti-rotation mechanism enabling the drive mechanism to be operated in the direct drive non-ratcheting mode.

2. The dual drive mechanism of claim 1, wherein pivoting the stabilizer lever causes said linear displacement of the follower frame which in turn causes the anti-rotation post to engage or disengage the second rotating element preventing or allowing rotation of the second rotating element.

3. The dual drive mechanism of claim 1, wherein the drive mechanism further includes an invertible step-up and step-down transmission attachment for selectively increasing the speed or the torque at the output.

4. The dual drive mechanism of claim 1, further comprising markings to align the anti-rotation post for insertion into an opening of the reversing mechanism for preventing rotation of the reverse mechanism.

* * * * *